United States Patent [19]

Budelman

[11] 4,393,741

[45] Jul. 19, 1983

[54] ELECTRONIC ORGAN CIRCUIT

[75] Inventor: Gerald A. Budelman, Aloha, Oreg.

[73] Assignee: CBS, Inc., New York, N.Y.

[21] Appl. No.: 269,652

[22] Filed: Jun. 1, 1981

[51] Int. Cl.[3] ..... G10B 3/10; G10H 1/24

[52] U.S. Cl. ..... 84/1.01; 84/345; 84/370

[58] Field of Search ..... 84/1.01, 1.03, 341, 84/343-345, 369, 370

[56] References Cited

U.S. PATENT DOCUMENTS

| | | | |
|---|---|---|---|
| 4,092,895 | 6/1978 | Zabel | 84/345 |
| 4,173,167 | 11/1979 | Stanley | 84/345 |
| 4,294,155 | 10/1981 | Turner | 84/1.01 |
| 4,343,216 | 8/1982 | Swain et al. | 84/1.01 |

*Primary Examiner*—Stanley J. Witkowski

*Attorney, Agent, or Firm*—Klarquist, Sparkman, Campbell, Leigh, Whinston & Dellett

[57] ABSTRACT

An electronic organ circuit includes a multiplicity of keyers receiving control inputs from plural shift and store registers capable of operating any given keyer at different levels. The inputs for a given keyer are applied on a cyclic basis and for differing time periods in such manner that the keyer's output amplitude and waveshape vary in response to the number and duration of inputs. A processor responsive to keyboard key and stop actuation supplies information to shift register chains corresponding bit-wise to the operation of keyboard keys, and corresponding, in respect to bits destined for a given register, to the condition of organ stops. Individual registers are then operated on a duty cycle basis and provide outputs of selected duration for effecting different stop sounds.

16 Claims, 35 Drawing Figures

252
CLK.
254
SCLK
256
258
260
262
264
MREQ
250
CLK
WAIT
MI
RFSH
RD
WR
MREQ
IORQ
DB7
DBØ
INT
A15
AØ
266
DB4
MASACK
DKINT/
SLVSTB
268
DB3
SLVACK
MASSTB
274
270
DB2
DMAGO
DMAINT
272
DB1
TIMACK
TINT
IORQ
MI
278
276
A3
A2
A1
A0
015
014
013
012
011
010
09
08
07
06
05
04
03
02
01
00
IO15
IO14
ADCGO
ADCSTB
OPTSTB
SLVSTB
SLVDAT
MASSTB
IO5
DMAGO
KBDTR
KBDIN/MASDAT
IORQ
A7
279
COMM
EN1
ENØ

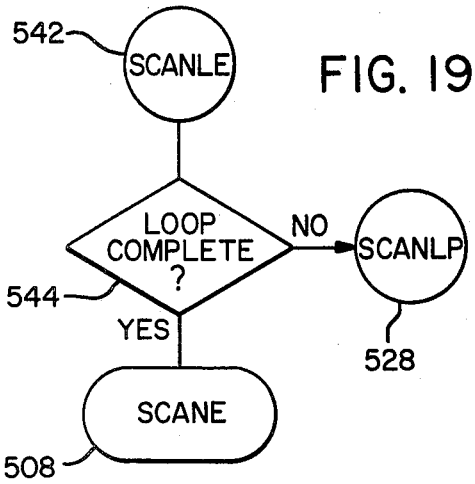
FIG. 19
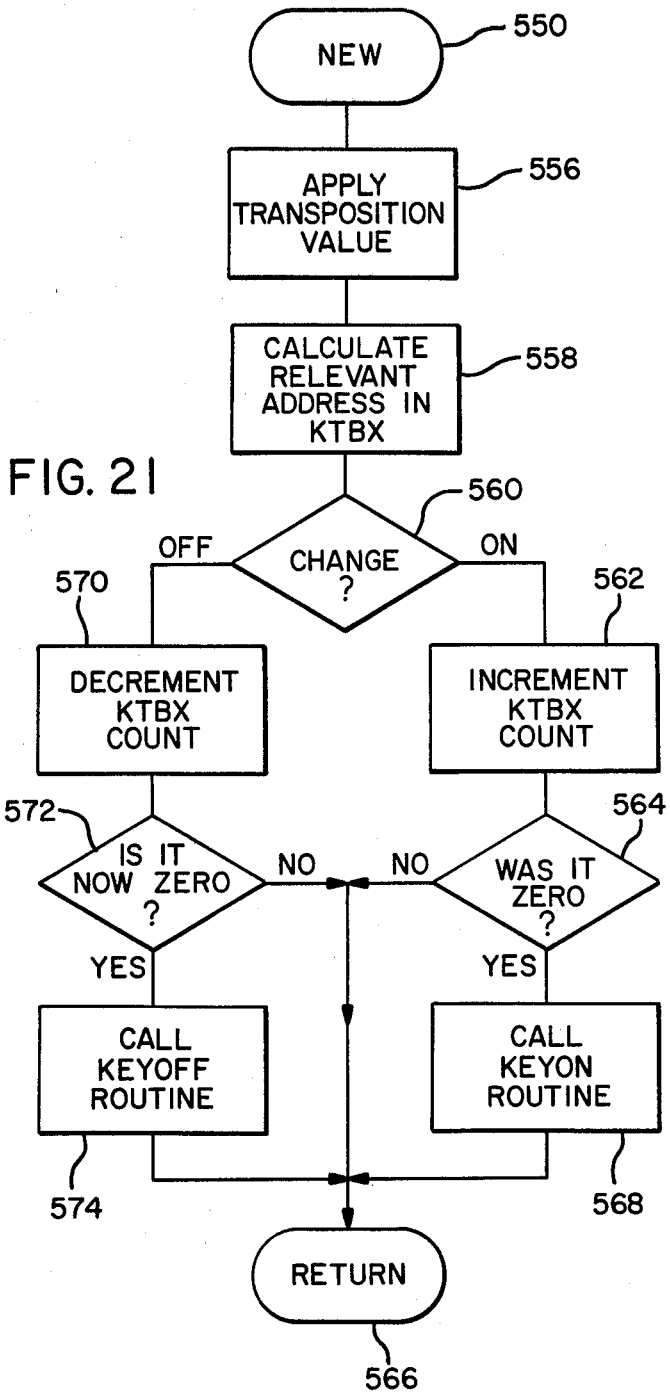
FIG. 21
FIG. 20
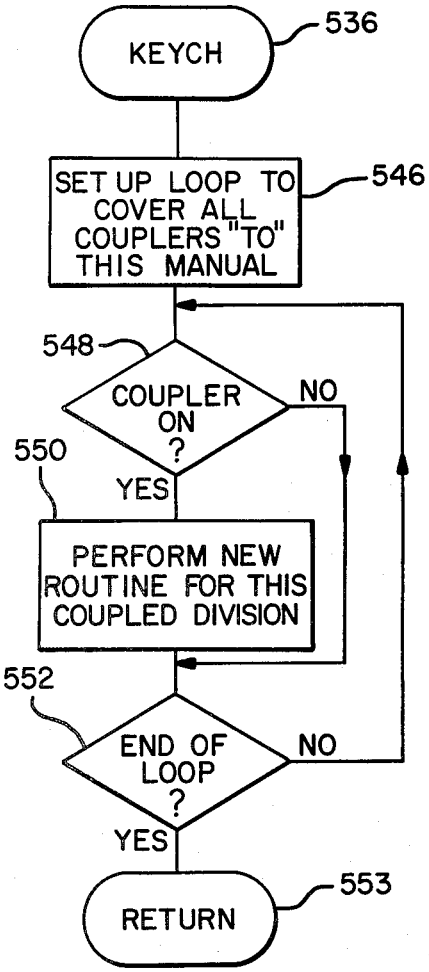

ELECTRONIC ORGAN CIRCUIT

BACKGROUND OF THE INVENTION

The present invention relates to electronic organ circuitry and particularly to electronic organ circuitry for producing pipe-organ-like tones in response to actuation of keyboard keys and organ stop settings without requiring typically complex keyboard wiring or an excessive number of component parts.

An advantageous circuit configuration employed in prior art electronic organs includes a multiplicity of keyer circuits or simply keyers, one of which is illustrated in FIG. 1. Each keyer gates an audio signal from a sine wave oscillator and shapes this signal for providing an organ sound waveform. In a typical organ there will be a keyer for every note or pitch, and for every organ voice wherein keyers of a particular rank (sometimes also called a keyer) have similar circuitry and distort the sine wave input in a particular manner. Thus, a given rank of keyers may be employed in simulating a flute sound while other ranks may supply a reed sound, a diapason sound, etc.

The keying signal or operative keyer input may be derived from one or more of a plurality of keyboard keys, as illustrated in FIG. 1, which are respectively enabled by different stops. By way of example, a keyer at a given pitch and voice may be keyed from different sources such as the swell division or great division of the organ, and/or at several different footages such as eight foot, four foot, etc. The gating voltages supplied in response to operation of different stops may also vary so as to cause the keyer to pass somewhat different waveshapes producing somewhat different sounds, depending on the stop actuated. In addition, when more than one stop is actuated, the oscillator signal passed by the keyer will be proportionately larger, and possibly different in waveshape, giving a more realistic output as would be produced in a pipe organ by more than one rank of pipes.

The stop enabling input to a keyer is applied via a "diode slide" or simply a "slide" which includes, for example, diodes 46 and 54 in FIG. 1. A large number of slides may be connected at the input of a given keyer, particularly in the case of a theater organ wherein unification is very extensive. Since the number of keyers in an organ of any size may be quite large, it will be appreciated the number of slides in such organ can reach astronomical proportions. In addition, of course, each slide must be wired to separate keys and separate stops on the organ resulting in a very cumbersome wiring problem and presenting limits to theoretically possible design flexibility. Certainly, the alteration of the organ stop circuitry on such an organ can be very difficult or nearly impossible.

SUMMARY OF THE INVENTION

In accordance with the present invention in a particular embodiment thereof, an electronic organ, provided with a plurality of keyboard keys, a plurality of stops, plural oscillator circuits, and keyer circuits operative in response to selected keys, further includes means controlled by the keyboard keys for supplying serial information for actuation of the keyers, and plural register means receiving the serial information and providing the same in parallel to the keyers. The outputs of different register means are suitably applied to a given keyer, e.g. to achieve different tonal effects, wherein the register means are operative to provide their outputs to the given keyer at different times for different periods of time on a cyclic basis. The register means are respectively responsive, in effect, to different organ stops such that the keyer may produce differing sounds in response to the actuation of different stops, or may produce an output of greater amplitude as plural stops are actuated. Extensive wiring and conventional slide circuitry is thereby substantially eliminated, greatly reducing the complexity of the organ and increasing its design flexibility.

In a preferred embodiment of the present invention, the register means are provided serial input information from a processor responsive bit-wise to keys of the organ keyboard and responsive in organization to the stops of the organ. The stop arrangement of the organ may be easily altered by reprogramming the processor without requiring massive rewiring.

It is accordingly an object of the present invention to provide an improved electronic organ circuit of economical construction and optimized design flexibility.

It is another object of the present invention to provide an improved electronic organ circuit for producing pipe-organ-like sounds via a multiplicity of keyers wherein the wiring and number of component parts associated with the keyers are significantly reduced.

It is another object of the present invention to provide an improved electronic organ circuit wherein the selection of tones produced in response to actuation of various stops can be easily altered.

It is another object of the present invention to provide an improved electronic organ circuit comprising a plurality of keyers which are selectively operated by processor organization.

It is another object of the present invention to provide an electronic organ circuit of improved reliability.

The subject matter which I regard as my invention is particularly pointed out and distinctly claimed in the concluding portion of this specification. The invention, however, both as to organization and method of operation, together with further advantages and objects thereof, may best be understood by reference to the following description taken in connection with the accompanying drawings wherein like reference characters refer to like elements.

DRAWINGS

Figure 14:
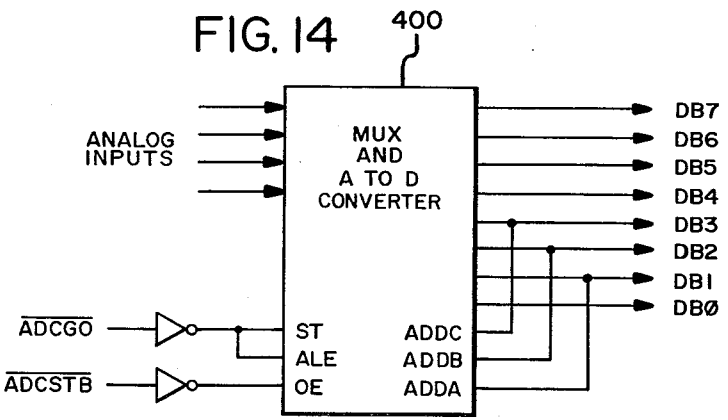
Figure 13:
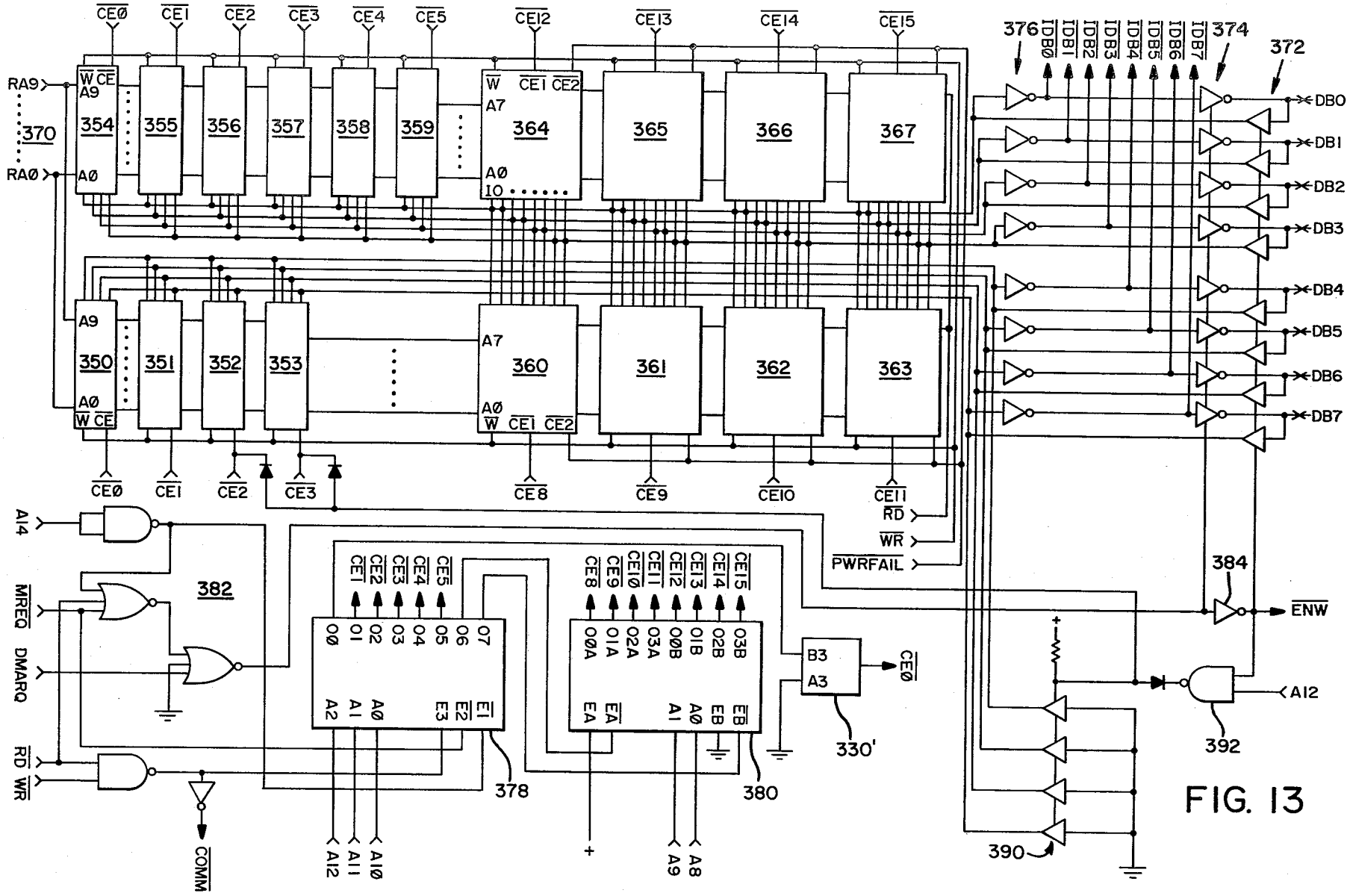

FIG. 13 further illustrates a memory system utilized with the processor;

FIG. 14 is a block diagram of a multiplexer and analog-to-digital converter circuit employed in the present system; and FIGS. 15 through 35 are flow charts describing software for operating the processor system according to the present invention.

DETAILED DESCRIPTION

Referring again to FIG. 1, a prior art keyer circuit or keyer is illustrated at 10. The keyer 10 gates an audio signal from sine wave oscillator 12 into an amplifier 14 for driving further amplifiers and ultimately the loud speaker or sound transducing system of the organ. In the version specifically illustrated, the keyer comprises reversely poled diodes 16 and 18 having their anodes connected together at junction 20, wherein the cathode of diode 16 is coupled via resistor 22 to the output of oscillator 12, and wherein a coupling capacitor 24 connects the cathode of diode 18 to amplifier 14. Resistor 26 returns the cathode of diode 16 to ground, resistor 28 returns the cathode of diode 18 to ground, and the junction 20 is returned to ground through resistor 30. The voltage levels of the circuit are normally such that substantially no conduction takes place through the reversely poles diodes and consequently the signal from oscillator 12 does not reach amplifier 14. However, a positive going keying signal may be delivered through resistor 32 to junction 20 causing both diodes 16 and 18 to conduct whereby a coupling path for the oscillator signal is established. In the circuit as illustrated, the keying signal may be derived from one or more of a plurality of keyboard keys 34, 36 and 38 which comprise switches having one contact connected to a positive voltage and the remaining contact coupled via resistor 40, 42 or 44 in series with positively poled diode 46, 48 or 50 and resistor 32 to junction 20. An "attack" capacitor 52 shunts the cathodes of diodes 46, 48 and 50 to ground, while further gating diodes 54, 56 and 58 have their anodes connected respectively to the anodes of diodes 46, 48 and 50. Voltages responsive to organ "stop" settings are normally applied to diode terminals 60, 62 and 64 such that only one or a selected number of the keys 34, 36 and 38 will be effective in introducing a positive voltage at junction 20 and thereby operating keyer 10. A diode gate such as comprised by diodes 46 and 54 is called a "diode slide" or simply a "slide". It is understood that while three keys are shown connected to this particular keyer, this illustration is by way of example only and frequently a larger number of key inputs will be connected to an individual keyer especially if "unification" is very extensive. By way of example, a signal at a given pitch from oscillator 12 may be keyed from different sources such as the swell division or great division of the organ, and at several different pitches such as 8 foot, 4 foot, etc. A keyer with attendant input circuitry is provided at every pitch for every voice in the organ, although a plurality of keyers may feed a given amplifier 14 as indicated by dashed line 66, and a given oscillator 12 may supply input to a number of keyers as indicated by dashed line 68.

The gating voltages selectively supplied at terminals 60, 62 and 64 in response to actuation of different stops may vary so as to supply different keying signals to junction 20 and cause the keyer to pass a somewhat different waveshape producing a somewhat different sound. Keyer operation is desirably nonlinear, dependent upon the component values employed and dependent upon the keying input applied. In addition, when more than one stop input is present, the oscillator signal passed by keyer 10 can be proportionately larger, giving a more realistic output as would be produced in a pipe organ by more than one rank of pipes.

In some keyers, a capacitor is substituted as component 16 whereby the oscillator signal is half wave rectified by diode 18. Such keyer would provide a different "voice" from the keyer first described and is suitably selected by different stops. In other instances, component 16 is a more complex pulse forming circuit as known to those skilled in the art. In any case, one of the functions of the keyer circuit is to shape or distort the sine wave signal normally derived from oscillator 12 into a desired waveshape characteristic of a musical note. A rank of keyers of similar circuit configuration is employed to shape signals characteristic of a particular organ voice. Another rank of keyers is used to generate a different voice, and so on.

As hereinabove indicated, keyers and attendant input circuitry will be provided for substantially every note and every voice in the organ. Since each keyer receives a plurality of different inputs via a plurality of different diode gates or "slides", it can be seen the wiring and number of component parts in such an organ system can be quite extensive. Keyboard keys are each coupled to a large number of different keyer slides in the organ circuit, and also the organ stop wiring is complex for selectively enabling the large number of slides. Although various schemes of multiplexing can be employed to reduce the number of wires coming from keyboards into the diode slide system, the diode slide system itself nevertheless requires a massive amount of wiring to interconnect the keyboards and a large number of slides. In a theater type organ, where the unification of a single keyer is very extensive, the number of diode slides is astronomical. Not only are the components expensive and the wiring expensive and cumbersome, but also design flexibility tends to become limited.

In accordance with a principal embodiment of the present invention, keying information is provided in serial form for coupling to the organ keyers via shift register circuity without employing conventional slides and attendant wiring. Considering FIG. 2, a series of pulses representing the desired states of a multiplicity of keyers is coupled via lead 70 to a first shift and store register 72, the serial output of which is in turn connected to another shift and store register 74, and so on through a series of registers having parallel outputs sufficient to drive a multiplicity of keyers. In the particular example illustrated, the registers 72, 74 etc., were 4094 CMOS parts comprising serial shift and store registers as hereinafter more fully described. Register 72 supplies eight parallel outputs indicated at 76 for driving eight keyers 81–88. Register 74 supplies eight parallel outputs indicated at 90 for driving eight keyers 91–98, and so on until an input is provided, for example, for each one of a rank of keyers in the typical organ.

Serial input information for the keyers is delivered to the series shift register circuit and when the information fills the entire series circuit, a strobe pulse is supplied to the registers 72, 74, etc. such that the keyers simultaneously receive their desired input. According to the present system all inputs to the keyers can be updated within twenty to thirty milliseconds and there is no perceptible hesitation between actuation of keyboard keys and the speaking of a stop. The integrating "attack" capacitor of each keyer smooths the input between strobes.

The shift registers 72, 74, etc., are suitably positioned proximate the various keyers operated thereby. The wiring is substantially reduced while diode slides are substantially eliminated. It will be appreciated that while two shift registers are shown in the series circuit by way of illustration, a much larger number than two is ordinarily required.

It will be noted that separate stop information is not specifically provided to the keyers, but rather the serial input inherently incorporates stop information, at least for one stop. As will hereinafter be fully described, the serial information is provided by processor means programmed to supply keyer actuating values to plural shift register chains in accordance with the keyboard keys and in accordance with the stops of the organ that are operated at a given time. The processor can adjust the data provided to the serial shift registers in order to operate multiple keyers with the actuation of a given key on a keyboard and no additional hardward is required.

Variation of the output amplitude of the keyers is accomplished in accordance with the present invention by varying the duty cycle or pulse width of the output signals provided at 76 and 90, as hereinafter more fully described. The "attack" capacitors of the various keyers integrate the pulse width of the signal applied and the result is a desired change in the amplitude of the oscillator signal coupled through the keyer, and possibly a different kind of sound. In the particular instance of the shift and store registers utilized, a tri-state enable input to each register is varied in time for varying the duty cycle or the length of each pulse output produced. Thus, an enable input 100 for register 72 is used for simultaneously varying the duty cycle (or pulse width) of the eight outputs 76, and enable input 102 of register 74 simultaneously varies the duty cycle (or pulse width) of the eight outputs 90. In the circuit shown in FIG. 2, the enable inputs 100 and 102 are connected to a common bus 104 driven by a pulse width modulator 106. Pulse width modulator 106 varies the speaking amplitude of each of the keyers receiving inputs from registers 72 and 74 as well as from other registers in the same serial circuit having the same enable bus 104.

In accordance with a feature of the present invention, additional chains of shift and store registers are connected in parallel with the first chain. In the specific embodiment, these additional chains respectively comprise registers 108 and 110 receiving serial input 112 and having a duty factor control bus 114 driven from pulse width modulator 116, registers 118 and 120 receiving serial input 122 and controlled by duty factor control bus 124 driven from pulse width modulator 126, and registers 128 and 130 receiving a serial input 132 and controlled by duty factor control bus 134 driven from pulse width modulator 136. This system enables a single keyer to be keyed at more than one selectable level, or at a combination of levels, for example when the keyer is unified at more than one pitch and appropriate stops are actuated.

Independent data is clocked into the various chains of registers according to differing sets of keying information, e.g. for different stops, and corresponding outputs of registers in the different chains are connected together for operating the same keyer. Thus, first output lead 76*a* of register 72 operates keyer 81 while corresponding outputs 77*a*, 78*a* and 79*a* from registers 108, 118 and 128 are connected in parallel therewith and also operate keyer 81.

The pulse width modulators which enable the respective chains of keyers provide their pulse width modulated outputs on a cyclic and nonoverlapping basis such that only one register chain is enabled at a time. Correspondingly a given keyer such as keyer 81 is enabled from only one register at a time. The pulse width modulators each continue to provide a selectively variable duty cycle, but are timed by a four phase clock as hereinafter more fully described. Each of the four pulse width modulator outputs has a maximum duty cycle of twenty-five percent with this duty cycle being variable downwardly from twenty-five percent to effect a variation in the level of keyer operation as it is energized during a given phase. As a consequence of keyer operation from the separately controlled registers, a given keyer is operable at different controllable levels, or at a combination of different levels. Although four shift register chains are illustrated according to the embodiment of FIG. 2, it will be seen that one long chain may be substituted therefor if desired since the end of one chain may provide the input for the next. Thus, considering a very simplified version, the output of register 74 could be applied at lead 112 to the input of register 108, the output of register 110 could be applied to the input of register 118, and so on. Each group continues to be controlled in duty cycle by a separate pulse width modulator, e.g. for representing a different stop.

Figure 2:
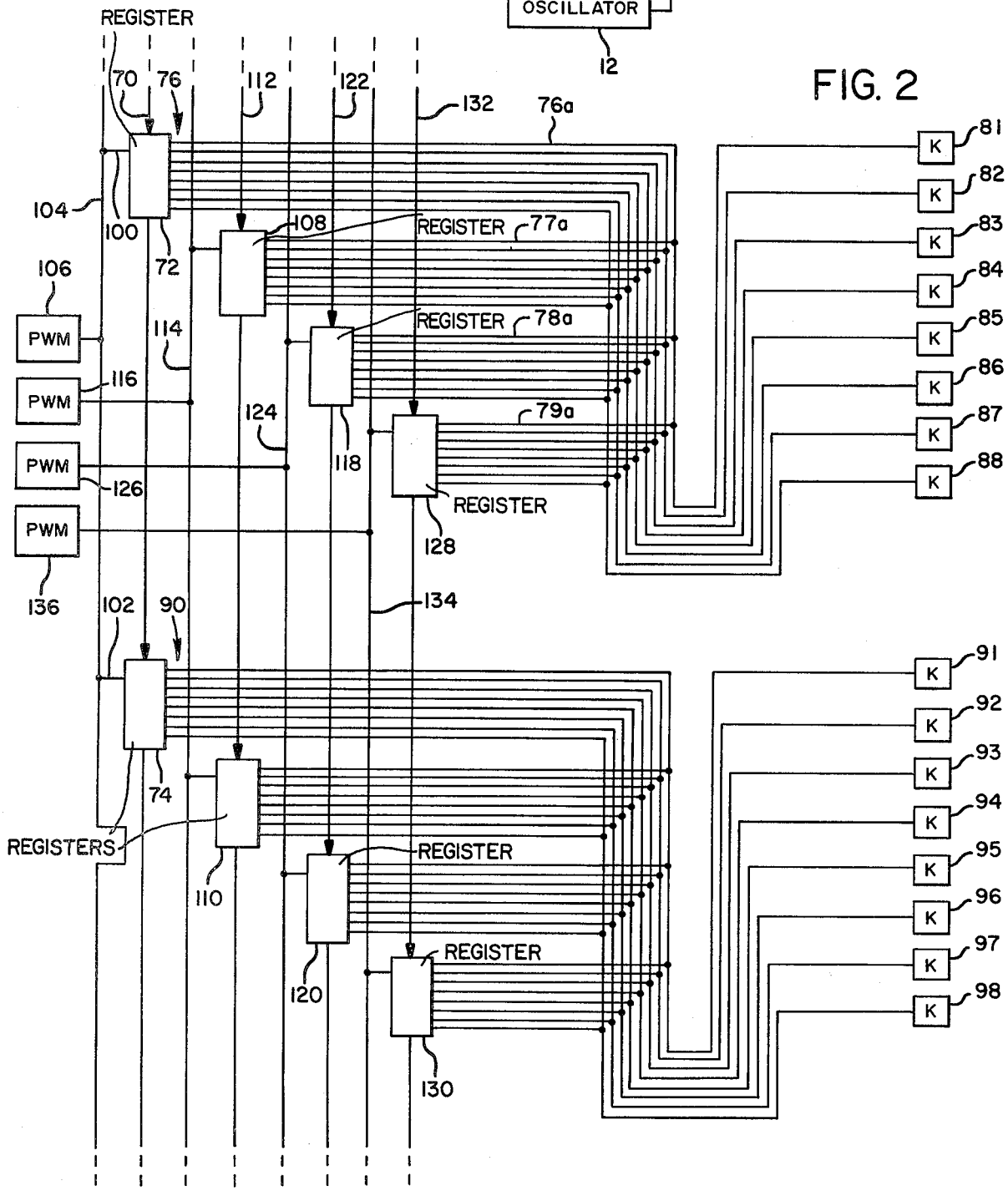
FIG. 2 is a block diagram of circuitry in accordance with the present invention for operating a multiplicity of keyer circuits.
Figures 3, 4:
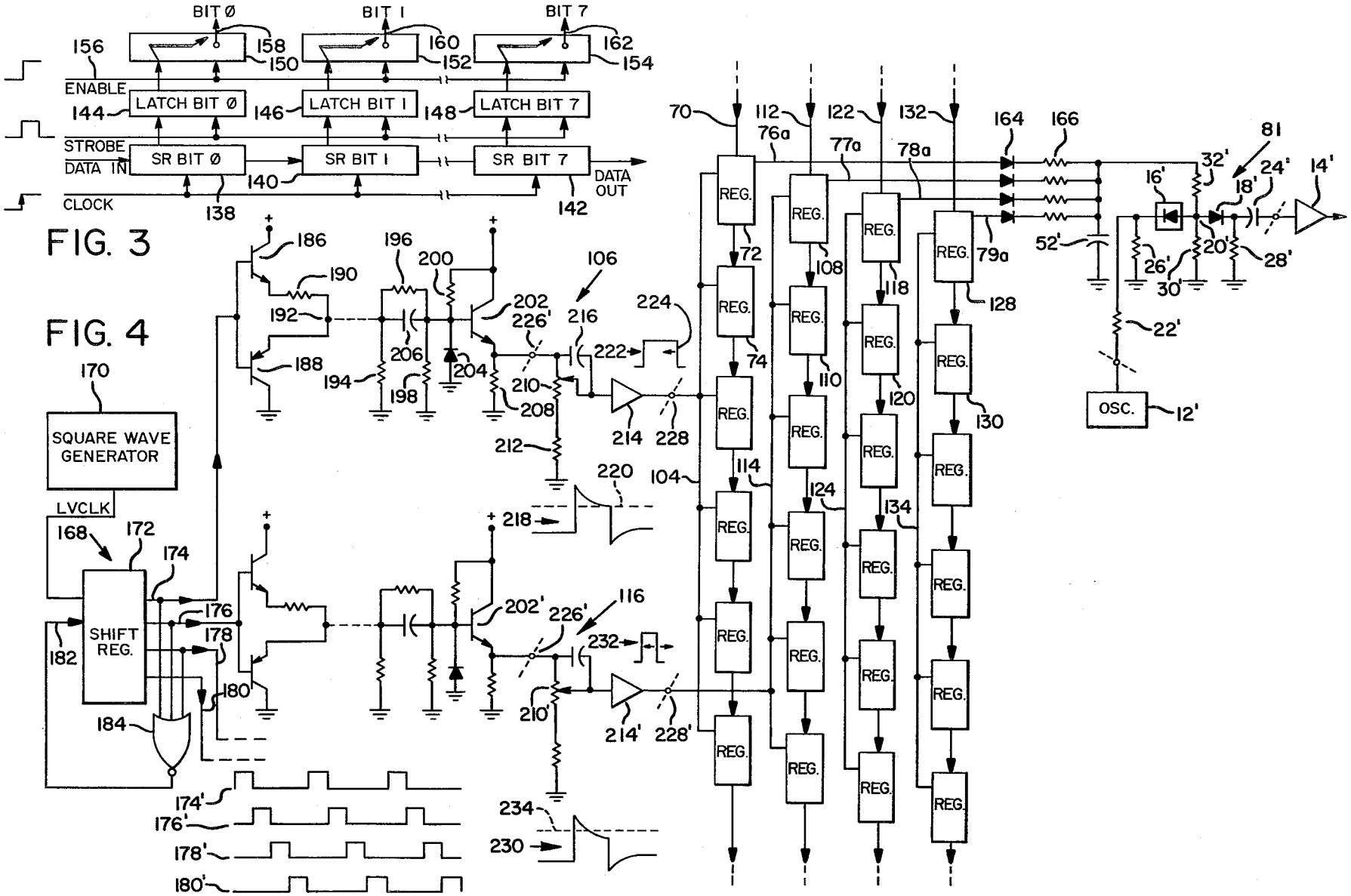
FIG. 3 is a block diagram of a shift and store register as employed in FIG. 2 circuitry.
FIG. 4 is a schematic and block diagram of circuitry in accordance with the present invention for operating a multiplicity of keyer circuits and illustrating pulse width modulation circuits thereof in some detail.

FIG. 3 illustrates one of the registers of FIG. 2 in simplified block fashion. The device principally comprises a shift register having successive stages 138, 140 and 142, it being understood the actual registers preferably have eight stages rather than three. The data-in is provided to stage 138 and the data-out is received from stage 142 for application to the next register in the series chain, while a clock signal is provided to each shift register stage in the usual manner for transferring information bits from one stage to the next. Corresponding latch stages 144, 146 and 148 receive information from the shift register stages when the entire shift register chain is "full" and a strobe pulse is applied to the latch stages for enabling the shift register stage inputs thereto. The latch stages will hold given information between strobe pulses. The latch outputs are in turn supplied to tri-state gates 150, 152 and 154, respectively, which are functionally illustrated as switches. The variable pulse width or variable duty cycle signal is applied as an enabling signal on lead 156 to the tri-state gates for closing the "switches" and providing outputs on leads 158, 160 and 162. The outputs are capable of three states, i.e. low state, high state and floating, it being understood the outputs 158, 160 and 162 will be in the floating or high impedance state in the absence of enabling signal on lead 156 for closing the "switches".

Referring to FIG. 4, the keyer circuitry and pulse width modulation circuitry is illustrated in greater detail. Again, four shift register chains are exemplified by registers 72, 74, registers 108, 110, registers 118, 120 and registers 128, 130, with further registers following in each chain as illustrated for providing drive inputs to a number of keyers in the organ circuit. A particular keyer 81 is illustrated, with it being understood the remaining shift register outputs drive similar keyers. Respective outputs *76a, 77a, 78a* and *79a* from registers 72, 108, 118 and 128 are coupled through diodes 164, and resistors 166 to the junction between attack capacitor 52' and coupling resistor 32' of keyer 81 wherein remaining components are identified by reference numerals corresponding to those of FIG. 1. The diodes 164 ordinarily comprise part of the respective registers.

Figure 1:
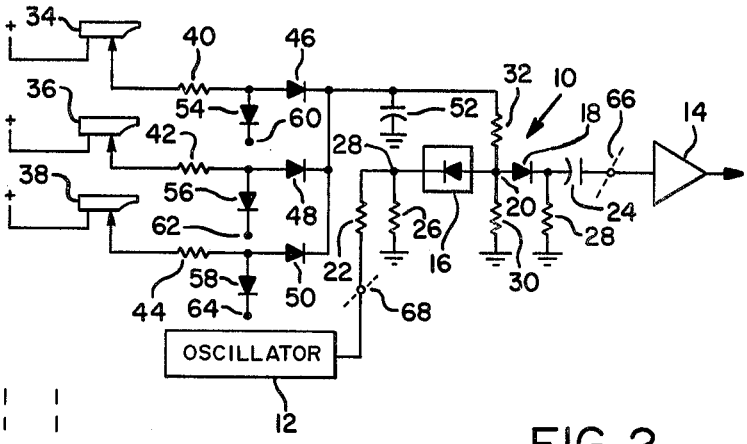
FIG. 1 PRIOR ART
FIG. 1 is a schematic diagram of a known keyer circuit.

Since a given keyer such as keyer 81 may in many instances be provided an input only one-fourth of the time or less, even when such keyer is selected by the organ circuitry to provide a tonal output, resistor 32' is suitably approximately one-fourth the value of corresponding resistor 32 in FIG. 1 and the circuit of FIG. 4 is otherwise altered as necessary to operate at one-fourth the input current as supplied in the prior art circuit of FIG. 1.

Pulse width modulation circuits 106 and 116 correspond to similarly identified blocks in FIG. 2 and the circuitry of the remaining pulse width modulators 126 and 136 is substantially identical. Each of the pulse width modulators is triggered in succession from a four phase clock 168 receiving regular input stepping pulses identified as LVCLK from square wave generator 170. (In the actual system LVCLK is conveniently derived from the processor circuitry.) The four phase clock comprises a shift register 172 delivering four outputs 174, 176, 178 and 180 wherein the first three of the outputs from the first three stages of the shift register are coupled to shift register data input 182 via NOR gate 184. Signal LVCLK steps data along the register. It is seen that should any of the first three outputs of shift register 172 be up, then input 182 will be down, and a "one" input will not be provided to shift register 172 until the up state present has been shifted to the last output 180. At such time, input 182 will receive a "one" from gate 184. A "one" will then be shifted along the register in a cyclic manner. The waveforms present at output leads 174, 176, 178 and 180 are respectively indicated at 174', 176', 178' and 180'.

Pulse width modulation circuit 106 will now be described, and it will be understood pulse width modulation circuit 116 and the remaining circuits are substantially identical. Output 174 of register 172 is coupled as an input to a driver circuit comprising NPN transistor 186 and PNP transistor 188 adapted to provide a rectangular waveform substantially between ground and a positive voltage. Shift register output 174 is applied to the transistor base terminals, while the collector of transistor 186 is connected to a positive supply and the collector of transistor 188 is grounded. The emitter of transistor 188 is connected to output terminal 192, with the emitter of transistor 186 being coupled to the same output terminal via resistor 190.

Terminal 192 is shunted by a resistor 194 designed to prevent ringing in the line that may couple terminal 192 to the remainder of the circuit. Resistors 200 and 198 form a voltage divider from the positive voltage source to ground adapted for normally biasing the base of transistor 202 at a voltage slightly below half of the logic supply voltage employed with CMOS gate 214. Capacitor 206 couples terminal 192 to the midpoint of the voltage divider. Resistor 196 shunting capacitor 206 is employed to adjust the quiescent level of the output waveform, again at a little bit less than half the logic supply voltage.

When a positive going pulse of the output at 174 is presented to the driver 186, 188, capacitor 206 initially couples the high positive voltage level at terminal 192 to the base of transistor 202, as illustrated by waveform 218. However, the capacitor 206 then charges over the duration of the input pulse, the waveform falling to the quiescent level 220, just below half of the logic supply voltage, at the end of the input pulse. The voltage at the base of NPN transistor 202 then drops rapidly forming a negative spike which is clamped by diode 204.

Substantially the same waveform as illustrated at 218 is developed across resistor 208 disposed between the emitter of transistor 202 and ground, the collector of transistor 202 being connected to a positive voltage. This waveform is supplied across a voltage divider comprising potentiometer 210 and resistor 212 coupled between the emitter of transistor 202 and ground, while the movable tap of potentiometer 210 drives high impedance CMOS gate 214 which provides the duty cycle drive for bus 104. The output of the gate 214 is up when its input exceeds half the logic supply voltage, and otherwise the output of the gate is down. A speed up capacitor 216 is coupled between the emitter of transistor 202 and the input of gate 214 for insuring the rapid turn on thereof.

It will be seen that for the setting of potentiometer 210 as illustrated (with the movable tap at the upper end), gate 214 will provide an output illustrated at 222 for substantially the duration of a positive pulse input signal 174'. Therefore, the registers 72, 74 etc., will be enabled for their maximum 25% proportion of the overall cycle of shift register 172.

A somewhat different situation is illustrated for the case of pulse width modulator 116 wherein the movable arm potentiometer 210' is positioned approximately midway therealong resulting in an output waveform for gate 214' illustrated at 232 which is somewhat less than half the maximum duration of output waveform 224. The waveform at the base or emitter of transistor 202' is illustrated at 230, while level 234 is illustrative of the position of the movable arm of potentiometer 210'. Moving the potentiometer arm of potentiometer 210' downwardly diminishes the final amplitude of waveform 230 at the input of gate 214' which is somewhat the equivalent of moving threshold level 234 upwardly on the waveform. The waveform will in effect reach the threshold represented by half the supply voltage sooner, such that gate 214' will be turned off and the output pulse 232 concluded.

Since the descending slope of either exponential waveform 218 or 230 is greater at first and then flattens out, greater resolution for the potentiometer 210 or 210' is provided in adjusting output pulses 222 or 232 in the narrower width range, that is for lower keyer amplitudes. Consequently, the adjustment 210 or 210' is log responsive or db responsive and more smoothly adjustable for sound differences as will be detected by the human ear.

The circuitry to the left of points 226 and 226', and equivalent points in the remaining two pulse width modulators, may be common to the entire organ. However, the circuitry to the right of the same points including the adjustments provided by potentiometers 210 and 210' is duplicated in the circuit according to the number of different stops and levels which it is desired to control. Although the outputs from gates 214 and 214' are illustrated in FIG. 4 as each controlling a series of six shift register circuits receiving serial keying information, it will be understood a greater or lesser number of keyers along the serial chains may be controlled by a common pulse width modulator according to the number of shift register outputs required for a given stop. For example, for a 96 note rank of keyer circuits, there will be twelve shift registers, at eight notes per shift register, which will be associated with one pulse width modulation level and controlled by a common gate such as gate 214 or 214'.

The potentiometers 210, 210', and corresponding potentiometers in remaining pulse width modulation circuits are thus used to set the pulse width applied by a register of register chain to a series of keyers and therefore control the tonal response produced by those keyers. The potentiometers are set so that the corresponding register or register chain will cause its keyers to produce a given stop sound, assuming, of course, a keyboard key for keyer is also depressed.

An example of a data sequence corresponding to a number of different stops is hereinafter more fully explained in reference to Table I.

It will be seen that a multiplicity of keyers can be controlled at a plurality of levels to provide differing audio effects without requiring a massive number of slides or a massive quantity of wiring between the organ manuals and keyers. Serial shift and store registers are employed to distribute the keying information to the keyers, and physically these registers can be disposed along ranks of keyers. Only four wires extend along a given series of shift and store registers, namely the data in and out leads, the clock lead, the strobe lead and the tri-state enable lead. The complexity of actual wiring of the instrument is thus greatly reduced and the reliability of serviceability are enhanced. Moreover, the arrangement of sounds and stop controls is more easily altered without requiring a cumbersome rewiring job. Only the serial data provided to the shift register chains need to be altered in most cases. In the described embodiment, the serial stream of data for operating the keyers is generated by way of processor circuitry which is in turn responsive to the keyboard input information. The data represents the actuation of keyboard keys but is modified and directed along the stream of data to selected keyers in accordance with organ stops that are also actuated. Thus different key actuation pulses for actuating the same keyer at different levels are directed along different shift register chains or groups having respective output connected to the same keyer.

Figure 5:
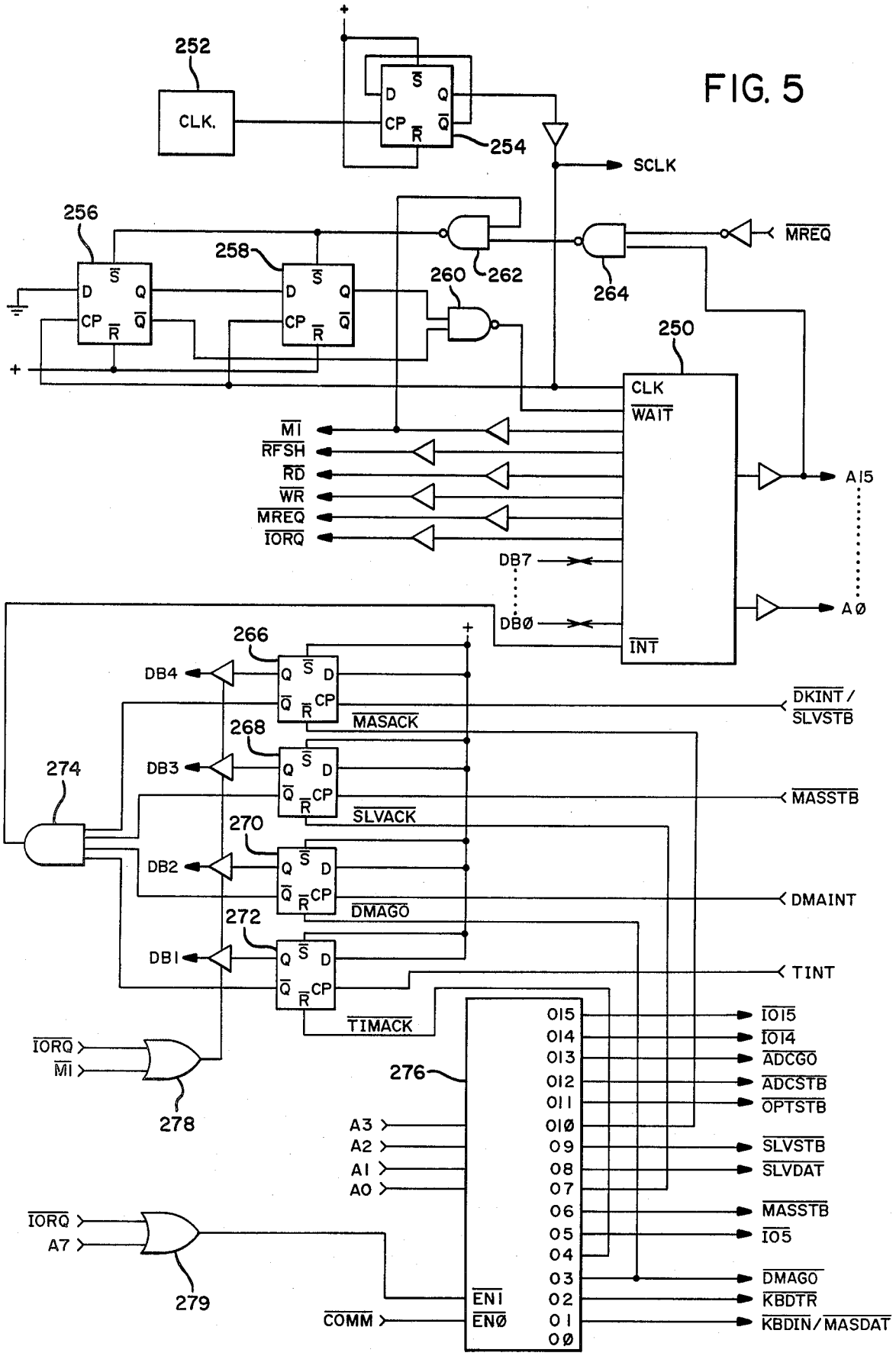
FIG. 5 is a block diagram of processor circuitry employed to provide serial information for the aforementioned keyers and particularly illustrating microprocessor input and output connections, input/output decoding, and interrupt circuitry.

The processor circuitry for providing the serialized keying information is described with reference to the drawings starting with FIG. 5. The processor circuitry is employed to "process" information from keys, stops, pistons, etc., and distribute pulse information to the various keyers by way of the hereinbefore described serial shift and store registers.

The processor circuitry principally includes a microprocessor 250 which in the present embodiment comprised a type Z80 manufactured by Mostek Inc. The microprocessor is coupled to data bus leads DBØ through DB7, address bus leads AØ through A15, and outputs as follows:

| | |
|---|---|
| $\overline{M1}$ | Machine Cycle One |
| $\overline{RFSH}$ | Refresh |
| $\overline{RD}$ | Memory Read |
| $\overline{MREQ}$ | Memory Request |
| $\overline{IORQ}$ | Input/Output Request |

In addition, the microprocessor receives a clock input (CLK), a wait input ($\overline{WAIT}$) and an interrupt input ($\overline{INT}$). Additional connections to the microprocessor are well-known to those skilled in the art.

A four MHz system clock is provided by an eight MHz crystal oscillator 252, the output of which is divided by two, by "D" flip-flop 254, and coupled to supply stream clock (SCLK) to the clock input of microprocessor 250 as well as to other elements of the circuitry.

At the four MHz rate, the microprocessor does not allow enough access time for the program memory ROM and CMOS RAM as hereinafter more fully described. The function of the WAIT logic including flip-flops 256 and 258 is to cause the microprocessor to add one extra clock cycle, called a wait state, to each program memory ROM or CMOS RAM memory reference operation. A ROM operation is signaled by the presence of $\overline{M1}$ from the microprocessor, while a CMOS RAM operation is indicated by a high level on address bit A15 during a memory reference operation. (CMOS RAM is always addressed as if it were the top 32K of memory, even though A15 does not actually affect the enabling of the CMOS memories.) NAND gate 262 providing the $\overline{S}$ inputs for flip-flops 256 and 258 receives input $\overline{M1}$ and the output from NAND gate 264, the latter receiving A15 and memory request ($\overline{MREQ}$ inverted). Either $\overline{M1}$ or the coincidence of A15 and MREQ will cause the flip-flop $\overline{S}$ inputs to go up and the system clock will trigger flip-flops 256 and 258 successively. The indicated outputs of flip-flops 256 and 258 are connected to the $\overline{WAIT}$ input of microprocessors 250 via NAND gate 260. Consequently, the NAND gate 260 will be enabled at the beginning of the second clock cycle of the ROM or CMOS RAM operation for one clock cycle, causing the $\overline{WAIT}$ input of the microprocessor to go low whereby the microprocessor will enter the WAIT mode.

In the processor system, the microprocessor 250 can be interrupted by:

a. The end of a direct memory access (DMA) cycle, as indicated by assertion of Direct Memory Access Interrupt (DMAINT).

b. A timing output known as Timer Interrupt (TINT) from Direct Memory Access (DMA) used for debounce and other time-related functions.

c. The Master Interrupt Strobe ($\overline{MASSTB}$) from a slave processor if the processor system being described is a master.

d. The Slave Interrupt Strobe ($\overline{SLVSTB}$) from a master processor in the event the processor under consideration is a slave.

The last two interrupts are utilized in a relatively complex organ employing two processor systems. For the most part, a one processor configuration will be described in this specification.

The interrupt signals will set an associated "D" latch 266, 268, 270 or 272, the $\overline{Q}$ outputs of which are coupled to the $\overline{INT}$ input of microprocessor 250 via AND gate 274 for causing the $\overline{INT}$ input of the microprocessor to go low. The latches 266, 268, 270 and 272 are then reset by the microprocessor 250 via I/O decoder 276, as hereinafter more fully described, after an interrupt has been serviced. The outputs of latches 266, 268, 270 and 272 are also enabled onto bits one through four of the data bus under control of OR gate 278 upon the coincidence of $\overline{IORQ}$ and $\overline{M1}$ which occurs during an interrupt acknowledge cycle. This provides a vector that the microprocessor 250 uses to determine which signal caused the interrupt.

I/O decoder 276 translates four address inputs A0, A1, A2 and A3 from the address bus to sixteen outputs 0Ø to 015. Those employed are listed as follows:

| | |
|---|---|
| $\overline{MASACK}$ | Master Acknowledge Interrupt |
| $\overline{SLVACK}$ | Slave Acknowledge Interrupt |
| $\overline{DMAGO}$ | DMA Acknowledge |
| $\overline{TIMACK}$ | Time Acknowledge |
| $\overline{MASSTB}$ | Master Interrupt Strobe (if processor under consideration is a slave) |
| $\overline{MASDAT}$ | Data From Master Input Enable (if processor under consideration is a slave) |
| $\overline{SLVSTB}$ | Slave Interrupt Strobe (if processor under consideration is a master) |
| $\overline{SLVDAT}$ | Data to Slave Enable (if processor under consideration is a master) |
| $\overline{KBDIN}$ | Keyboard Data Input |
| $\overline{KBDTR}$ | Input Strobe to Input Data Chain |
| $\overline{OPTSTB}$ | Option Select Enable |
| $\overline{ADCGO}$ | A/D Converter Start |
| $\overline{ADCSTB}$ | A/D Converter Output Enable |

The first four outputs mentioned are used to reset the interrupt latches. The next four are used for intercommunication in multiple processor systems wherein both a master processor and slave processor are employed. The outputs indicated from the I/O decoder are coupled to control the opposite processor. The next two signals are used to control the input port, while the following signal enables the option select byte onto the data bus. The last two signals control an analog-to-digital converter. The console input port, the option select circuit and the A/D converter are hereinafter more fully described.

The decoder 276, which suitably comprises a type MC8311P device, receives the ORed input of $\overline{IORQ}$ and A7 via gate 279 at the $\overline{EN1}$ input at terminal 10 and receives input/output enable ($\overline{COMM}$ from FIG. 13) at the $\overline{EN0}$ input terminal 18. One of the decoder outputs will be enabled when there is an I/O request with A7 low and $\overline{COMM}$ low, but the decoder circuit does not operate during the interrupt acknowledge as indicated via gate 278. All I/O decoder outputs are active low.

Figure 6:
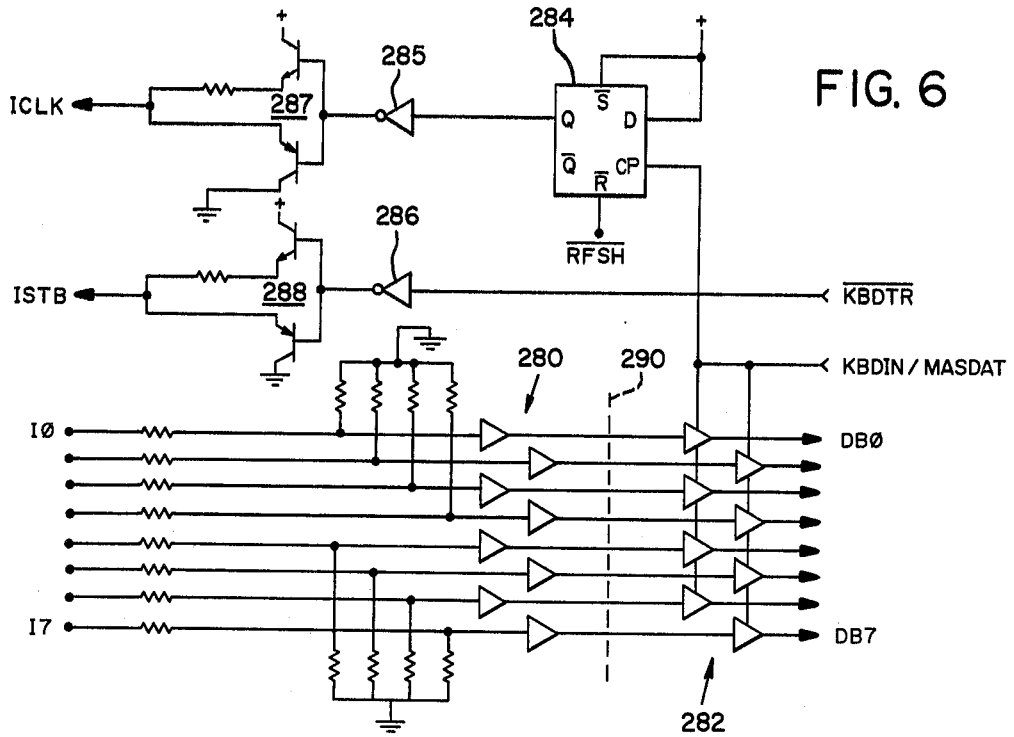
FIG. 6 is a schematic diagram of an input port for the processor system of FIG. 5.
Figure 7:
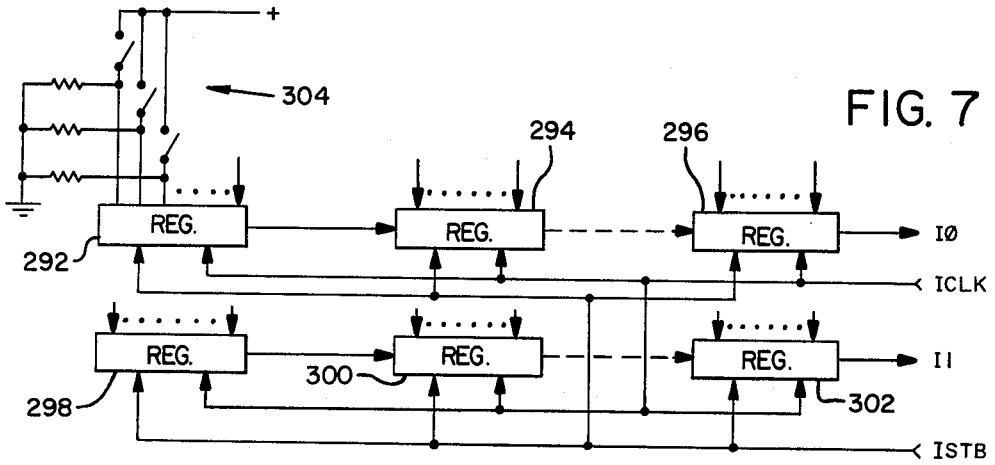
FIG. 7 is a block diagram of a pair of input shift register chains for the processor system.

FIG. 6 illustrates a dual purpose input port. When the processor system is used with a direct organ console input, i.e. from the organ keys and stops, the input signals are first translated to TTL level by buffers 280, and then gated onto the data bus by buffers 282 during a console read operation. The console input shift register chain (FIG. 7) is clocked at the end of each console read by the rising edge of KBDIN which sets "D" flip-flop 284. The output of flip-flop 284 is applied to transistor driver 287, via buffer 285 for translation to CMOS level, for providing the input clock (ICLK) as connected to the said shift register chain. The input clock (ICLK) is reset at the end of the next microprocessor refresh cycle by $\overline{RFSH}$ applied to flip-flop 284. This arrangement "stretches" the clock duty cycle to provide a wider pulse than would be obtained using the relatively narrow KBDIN. The transfer enable pulse for the input chain is $\overline{KBDTR}$, also buffered by a transistor driver 288, to provide ISTB, after translation to CMOS level by buffer 286. When the processor system is used as a slave in multiple processor organ, the buffers 280 are not employed and the input from the master processor system is routed to the data bus inputs of the slave at a connector indicated by dashed line 290 and gated onto the data bus by KBDIN, renamed MASDAT to indicate its new function. A pair of input data chains are illustrated in FIG. 7. A first such chain comprising shift register devices 292, 294 and 296 serially connected as shown provides the input for the IØ terminal of the console or master input port. A second series of registers, 298, 300 and 302 suitably drives the I1 input, it being understood that up to eight such input chains may be connected to the inputs IØ through I7 in FIG. 6.

The registers of FIG. 7 are suitably type 4021 parallel input, serial output CMOS devices receiving their parallel inputs from various organ keys and/or stops 304 which comprise switches disposed between the registers and a source of positive voltage. The status of the switches is periodically strobed into the registers by means of ISTB under the control of $\overline{KBDTR}$, while ICLK shifts information along the registers and into the input port of FIG. 6. It will of course be understood that each register chain will include a multiplicity of register devices whereby the register chains will provide a total under of inputs for all the organ input switch devices.

Figure 8:
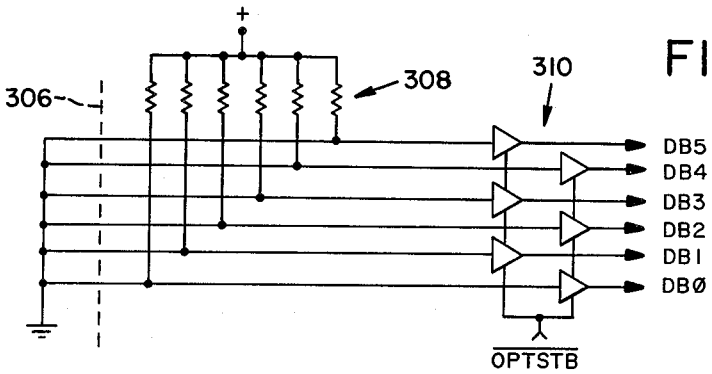
FIG. 8 is a schematic diagram of an option select circuit.

Several operating options are suitably available for the processor system in order to implement slightly different stop lists or specifications without changing the program memory ROM. The function of the option select circuit of FIG. 8 is to inform the processor which configuration exists for a particular organ. The selection is accomplished by cutting buses indicated along dashed line 306 and inserting resistors 308 to form a six bit binary code which the microprocessor can read by applying the $\overline{OPTSTB}$ output from the I/O decoder to buffers 310, whereupon the code is gated onto data bus conductors Ø to 5. If no buses are cut, the code will be 000000. Each bus that is cut and a resistor connected in its place will cause its associated bit to go to 1.

Figure 9:
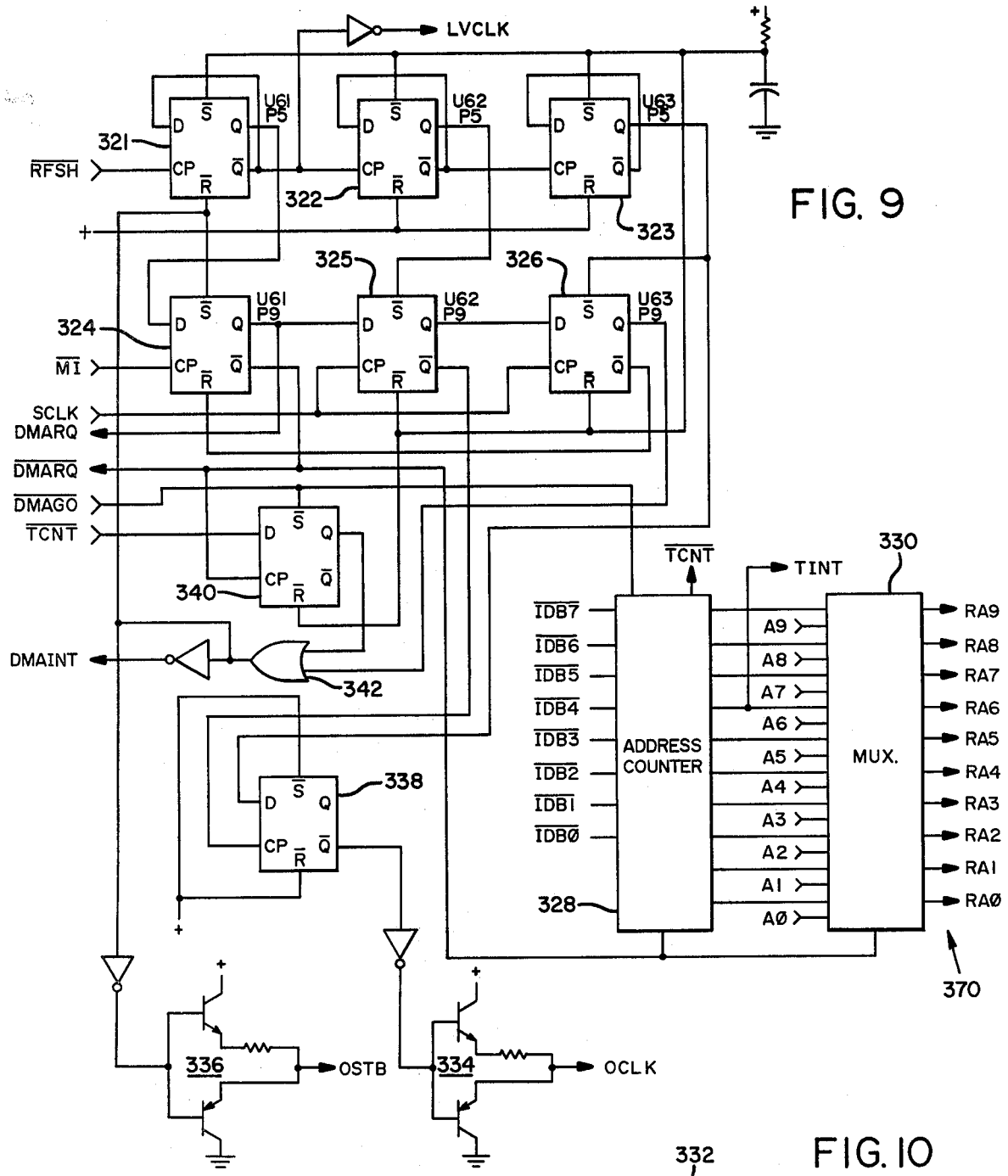
FIG. 9 is a block diagram of direct memory access output circuitry for the aforementioned processor system.
Figure 10:
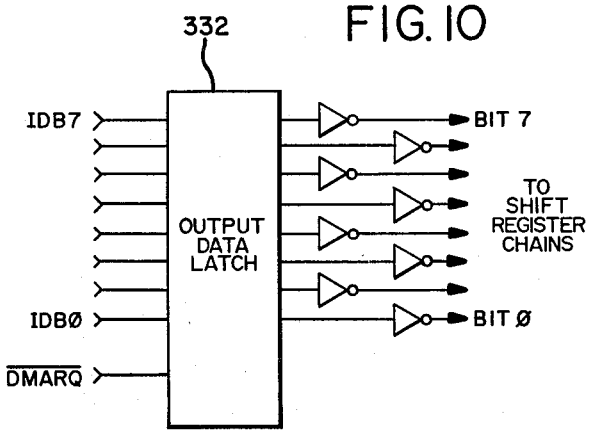
FIG. 10 is a block diagram of an output data latch circuit.

Direct memory access output circuitry is illustrated in FIG. 9. The function of this circuitry is to output data from one 1,024 word block of RAM to the output shift register chains which operate the keyers as hereinbefore described. The functions is performed without involving the microprocessor, except for initialization. The direct memory access circuitry reads the RAM block during microprocessor refresh cycles which occur after each OPCODE FETCH and which are ordinarily employed for the purpose of refreshing dynamic RAM's. Inasmuch as dynamic RAM memory is not a part of the present system, the DMA cycles are substituted. The DMA circuitry includes control counters illustrated at the upper part of FIG. 9 and comprising flip-flops 321–326, address counter 328, multiplexer 330, output data latch 332 (FIG. 10), output clock driver 334 and output strobe driver 336. The outputs of latch 332 as well as the output clock and output strobe are applied to the shift register chains as illustrated in FIGS. 2, 3 and 4.

The group of three upper flip-flops 321–323 in FIG. 9 is connected as a divide-by-eight counter, while the lower three flip-flops, 324–326, generate the Direct Memory Access Required (DMARQ) signal. The microprocessor refresh cycle occurs after each OPCODE FETCH and the control counter comprising flip-flops 321–323 divides the microprocessor refresh (RFSH) output by eight so that one byte is read on each eighth refresh cycle. Because of tight timing, the refresh cycles being only 500 nanoseconds long, the RFSH output itself is not used to control the actual read operation. The RAM read cycle must commence at the end of the OPCODE FETCH, and end at the beginning of the next processor operation. The byte is read, loaded into the output data latch, translated to CMOS level, and output to the shift register chains. Then, after sufficient settling time, OCLK is output to clock the data into the register chain. The address counter 328 provides the location of the data within the 1K block of DMA RAM and the output of this counter (ten bits) is placed on the RAM address bus by multiplexer 330 during the DMA read. The counter 328 is decremented after each read, and, upon reaching zero, stops the control counter 321–323 and interrupts the microprocessor. The microprocessor then outputs the higher order eight bits of the length of the DMA RAM (less than 1K) which is loaded into counter 328. This load operation resets the interrupt, and starts the DMA on a new cycle.

Figure 11:
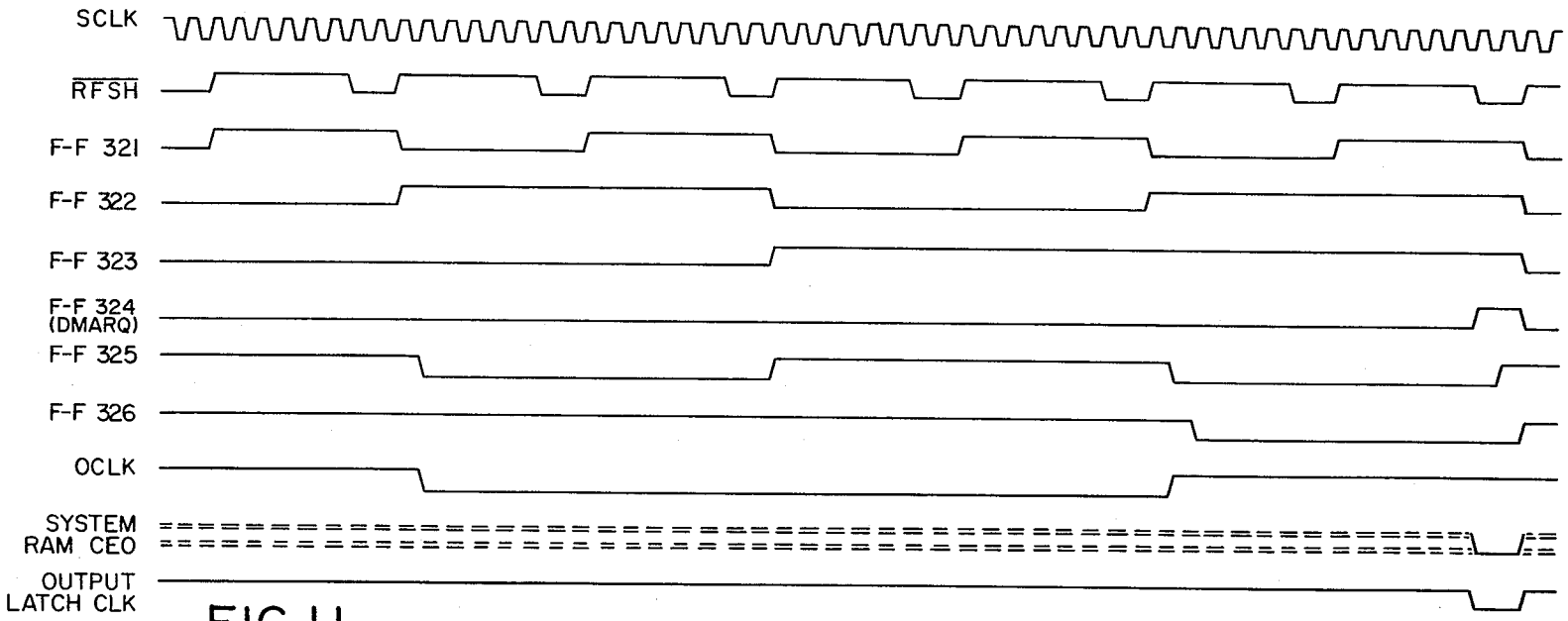
FIG. 11 is a timing diagram illustrating the relationship of various signals for a direct memory access read as performed by the circuit of FIG. 9.

The operation of the direct memory access output circuitry is partially illustrated by the timing diagram of FIG. 11 showing the relationship of various signals for a typical DMA read. The operation is not perfectly synchronous because of the asynchronous nature of RFSH. For clarity, however, it is assumed in this timing diagram that the processor is executing eight cycle instructions only. In the timing diagram, the "Q" outputs are illustrated for flip-flops 321–326 in relation to SCLK, $\overline{\text{RFSH}}$, OCKL, etc. DMARQ is the Q output of flip-flop 324. As noted previously, flip-flops 321, 322 and 323 divide down RFSH by eight, with the Q output signal of flip-flop 323 being connected to the $\overline{\text{S}}$ input of flip-flop 326 as well as to the D input of flip-flop 338 for controlling OCLK.

Flip-flops 324, 325 and 326 cooperate to provide DMARQ every eight microprocessor refresh cycles. Note the $\overline{\text{Q}}$ output of flip-flop 326 normally causes the flip-flop 324 to be reset, but when the $\overline{\text{Q}}$ output of flip-flop 326 goes high every eight refresh cycles, flip-flop 324 can be set upon the occurrence of $\overline{\text{M1}}$ after the D input of flip-flop 324 is supplied from the Q output of flip-flop 321. When DMARQ is produced, flip-flops 325 and 326 are successively triggered by SCLK, changing the state of flip-flop 326 and resetting flip-flop 324 to conclude DMARQ. The timing of OCLK allows plenty of settling time for data to the shift register chain before the same is shifted. OCLK is generated after the D input is provided flip-flop 338 from flip-flop 323, and flip-flop 338 is triggered from the $\overline{\text{Q}}$ output of flip-flop 325. The setting input for flip-flop 325 is provided from the Q output of flip-flop 322 and the $\overline{\text{Q}}$ output of flip-flop 325 is caused to go low when the Q output of flip-flop 322 goes low unless flip-flop 325 has already been operated via flip-flop 324. The high-going $\overline{\text{Q}}$ output of flip-flop 325 triggers flip-flop 338 when flip-flop 325 is triggered from SCLK. The setting input for flip-flop 326 is provided from the Q output of flip-flop 323. When the setting input is concluded the Q output of flip-flop 326 is caused to go low and its $\overline{\text{Q}}$ output is caused to go high by SCLK after the Q output of flip-flop 325 goes low. As previously mentioned, flip-flop 324 can then generate DMARQ as the $\overline{\text{Q}}$ output of flip-flop 326 goes high every eight refresh cycles. The generation of DMARQ causes the RAM to be read (see FIG. 13) as addressed via multiplexer 330, latches the data into latch 332 (see FIG. 10), and clocks address counter 328 on its trailing edge.

When the address counter 328 has decremented to one, Terminal Count (TCNT) goes low immediately after the next DMARQ. The last byte of data is read by the following DMARQ, the trailing edge of which resets the end-cycle flip-flop 340. The last byte is clocked out after six more RFSH pulses, and when the Q output of flip-flop 326 goes low, the Direct Memory Access Interrupt (DMAINT) at the output of OR gate 342 as inverted goes high, stopping the control counter by resetting flip-flop 321 and interrupting the microprocessor as hereinbefore described. The microprocessor responds by placing the upper eight bits (in ones complement form) of the DMA RAM length on the data bus, and asserting DMAGO from the I/O decoder in FIG. 5. DMAGO loads the address counter 328 from the data bus, sets the end-cycle flip-flop 340 and resets the interrupt. The data output by the last DMA cycle is strobed into the latches of the output register chain by generating OSTB via transistor driver 336 in response to DMAINT. The DMA circuitry then begins a new cycle.

One bit output of the address counter is used by the microprocessor as a timing interrupt (TINT). During normal DMA operation, this input will interrupt the microprocessor every few milliseconds, providing a time base used by the microprocessor for debouncing toe studs, and other time-related functions.

Figure 12:
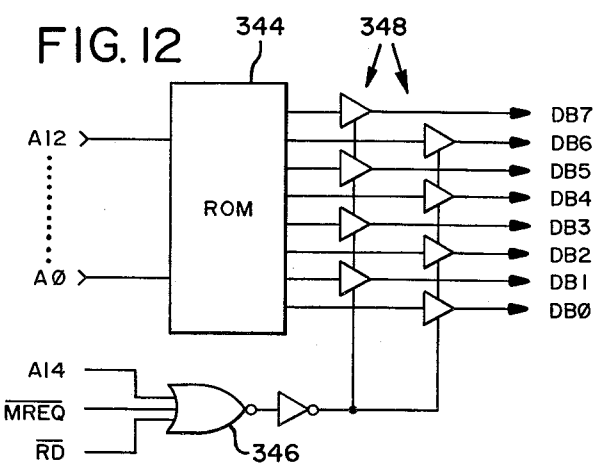
FIG. 12 is a block diagram of a read only memory or program memory employed with the processor system.

The microprocessor system suitably employs a program memory as illustrated in FIG. 12. Normally, one 8K×8 MOS ROM 344 is used although additional ROM memory may be employed if so desired. No address decoding is necessary, other than NOR gate 346 for operating buffers 348 from the ROM to the data bus. The program memory is selected by system address bit A14 being low during a memory reference operation. A coincidence of A14 with memory request ($\overline{\text{MREQ}}$) and memory read ($\overline{\text{RD}}$) enables buffers 348 to gate the ROM onto the data bus. The ROM suitably occupies the address space from 0 to 8,191 (hex 1FFF).

Referring to FIG. 13 further illustrating memory of the processor system, ten positions of random access memory are provided, sutiably using type 2114 1K×4 MOS RAM's numbered 350 through 359. Up to 4K×8 plus 2K×4 can be implemented. The lowest 1K, units 350, 354, is always used as the DMA RAM, but portions of this 1K block not used for DMA can still be used by the processor. In addition, a block of CMOS RAM is provided comprising units 360 through 367 having a maximum configuration of 2K×4. Data stored in the CMOS RAM will be retained by a backup battery (not shown) when the organ is turned off. Combination action data is suitably stored here.

RAM address bus 370 is connected to the RAM units in matrix fashion as shown and is driven from multiplexer 330 (FIG. 9). However, only the lower order eight bits of the RAM address bus leads are connected to the CMOS RAM units 360–367.

Data is gated into the random access memory by buffers 372 from the data bus, and data is gated from random access memory to the data bus by inverts 374. In addition, inverters 376 are interposed between the memory data leads and inverters 374 to provide isolated data bus (IDB0–IDB7), e.g. for use by DMA. The isolated data bus contains the ones complement of the microprocessor data bus, except during RAM reads including DMA reads when it contains complemented RAM data. It will be noted the input and output data connections of the smaller capacity CMOS RAM are coupled to data bus leads zero through four. $\overline{WR}$ (Memory Write) is connected to the write inputs of the various memory blocks, while $\overline{RD}$ (Memory Read) is connected to the read inputs of the CMOS RAM. Further connected to the CMOS RAM is $\overline{PWRFAIL}$ (CMOS Standby Control) comprising the reset signal also applied to the microprocessor from the power supply, by means not shown, for providing power-on reset.

The RAMs are selected by a decode circuit comprising a one-of-eight decoder 378 suitably a type P3205/8205, a dual two-to-four decoder 380 suitably a type 74155N, and gating circuitry 382. Address lines A10, A11 and A12 drive decoder 378 to select the eight outputs 0Ø through 07. Outputs 01 through 05 provide memory select outputs $\overline{CE1}$ through $\overline{CE5}$ connected to memory devices 351–359 as illustrated. The 0Ø output of decoder 378 is supplied as an input to selector means 330′, forming a part of multiplexer 330 in FIG. 9, such that other than during a direct memory access, decoder output 0Ø becomes $\overline{CEO}$ and selects memory block 350, 354. During direct memory access, $\overline{CEO}$ selects memory block 350, 354 regardless of decoder output. Outputs 06 and 07 of decoder 378 select the A and B parts of two-to-four decoder 380 which accordingly translates the address A8 and A9 inputs to the sets of outputs 0ØA through 03A and 0ØB through 03B. Accordingly, outputs $\overline{CE8}$ through $\overline{CE15}$ will select memory blocks 360 through 367. Memory units are thus selected in accordance with address bits A8 through A12, with bits A8 and A9 being used for this purpose only in the case of the CMOS RAM.

Read buffers 374 and write buffers 372 are controlled from gating circuitry 382 such that a read is accomplished in response to $\overline{MREQ}$ (Memory Request) and $\overline{RD}$ (Memory Read) in the absence of A14 which selects the program memory (FIG. 12). The read buffers 374 are also selected in response to DMARQ. The output of gating circuitry 382 is further applied via inverter 384 for generating Memory Write Enable ($\overline{ENW}$) for application to write buffers 372.

When only a four digit value is read out from memory, for example when RAM 358 or 359 is read out, it is desired the remaining output leads indicate zeros. Thus, RAM's 358 and 359 are suitably used for count tables and need only the four lower order bits. Accordingly, buffers 390 are connected in driving relation to the higher order inverters 376. The buffers 390 are active only when A12 is applied via gate 392 and memory is not being written into.

Analog voltages from crescendo and expression shoes are converted to eight bit digital codes by the circuit of FIG. 14 wherein multiplexer and analog-to-digital converter device 400 comprises an eight channel CMOS analog-to-digital converter, suitably a type ADC0809, of which only four input channels are used. The processor controls the A to D converter with two signals from the I/O decoder 276. A/D converter start signal ($\overline{ADCGO}$) enables three bits (DB1, DB2, and DB3) from the data bus into the converter to select one of the input channels, and starts the conversion cycle. The A/D Converter Output Enable signal ($\overline{ADCSTB}$) gates the converted byte onto the data bus.

Table I indicates data sequences as provided to a number of shift register chains in a typical organ according to the present invention. Each shift register chain receives an input from a different bit numbered output of output data latch 332 in FIG. 10. As will be noted, there are eight such data outputs, suitably designated bit Ø through bit 7, with the typical data sequence of these bit outputs for bits zero through six being indicated in Table I. The last or bit 7 output for the last shift register chain is suitably a number of one bit or plural bit indications for controlling such functions as transposers, tremulants, mutes, expression, and general pistons, and will not be set forth in detail since it is not primarily illustrative of the present invention.

Referring to Table I, outputs corresponding to several basic stops are set forth, it being understood other stops may be achieved from combinations of the stops given. Considering the Swell Flute outputs in the bit Ø and bit 1 positions, it will be noted that four levels are given, namely levels L1, L2, L3 and L4. These levels may correspond to different footages. According to the present invention, these outputs are ultimately provided as inputs to the same rank of keyers, with the keyer level settings being accomplished according to the duty factor adjustments described in connection with the circuit of FIG. 4. As an example, consider keyer 81 in FIG. 4 as the Swell Flute keyer for a given note, say note 25. The outputs at 76*a*, 77*a*, 78*a* and 79*a* are the bits in the data sequence appropriate to indicate whether levels 1, 2, 3 and 4 are respectively on or off at a given time when the shift registers are read out.

In Table I, the note designations given are note numbers corresponding to note sequences 001–0012, 01–012 and 1–85. Thus, in the case of Swell Flute level 2, notes 09 through 84 will actually comprise a total of 88 bits as indicated in the right-hand column. The total number of bits for the bit Ø shift register chain is 296, that is there must be at least 296 stages in the shift register chain driven from the bit Ø output of data latch 332 in FIG. 10. Corresponding numbers of bits for each chain are indicated by the totals in the right-hand column for each chain. While the various chains are not exactly the same length, they are similar in length. It will be seen the note sequences are reversely ordered for consecutive stops. This is because it is convenient to extend the shift register chains back and forth across a panel for connecting to respective keyers. E.G., the bit Ø shift register chain runs from the keyer for note 13 to the keyer for note 84, then backwards from the keyer for note 68 to the keyer for note 09, etc.

TABLE I

| Output Data Sequence | Level | Notes | Bits |
|---|---|---|---|
| Bit Ø | | | |
| Swell Flute | L1 | 13–84 | 72 |
| Swell Principal | L1 | 68–09 | 72 |
| Swell Flute | L2 | 09–84 | 88 |
| Swell Principal | L2 | 76–13 | 64 |
| | | | 296 |

TABLE I-continued

| Output Data Sequence | Level | Notes | Bits |
|---|---|---|---|
| Bit 1 | | | |
| Swell Flute | L3 | 01-52 | 64 |
| Swell Principal | L3 | 84-21 | 64 |
| Swell Flute | L4 | 21-84 | 64 |
| Swell Principal | L4 | 84-37 | 48 |
| | | | 240 |
| Bit 2 | | | |
| Great Flute | L1 | 001-0012 | 12 |
| Great Flute | L1 | 01-12 | 24 |
| Great Principal | L1 | 68-09 | 72 |
| Great Flute | L2 | 01-68 | 80 |
| Great Principal | L2 | 84-37 | 48 |
| | | | 236 |
| Bit 3 | | | |
| Great Flute | L3 | 09-76 | 80 |
| Great Principal | L3 | 68-09 | 72 |
| Great Flute | L4 | 01-84 | 96 |
| Great Principal | L4 | 84-09 | 88 |
| | | | 336 |
| Bit 4 | | | |
| Pedal Pulse | L1 | 01-02 | 32 |
| Great Chiff | L1 | 29-84 | 56 |
| Swell Chiff | L1 | 84-29 | 56 |
| Great Chiff | L2 | 29-84 | 56 |
| Swell Chiff | L2 | 84-29 | 56 |
| Great Chiff | L3 | 29-84 | 56 |
| Swell Chiff | L3 | 84-29 | 56 |
| Diapason Extension | L3 | 12-09 | 12 |
| (Optional) | | | 380 |
| Bit 5 | | | |
| Swell Pulse | L1 | 09-68 | 72 |
| Great Harp | L1 | 84-13 | 72 |
| Great Chiff | L4 | 29-84 | 56 |
| Swell Trompette | L1 | 52-01 | 64 |
| Great Flute Celeste | L1 | 13-60 | 48 |
| Swell Celeste | L1 | 60-13 | 48 |
| Flute Extension | L1 | 12-09 | 12 |
| (Optional) | | | 372 |
| Bit 6 | | | |
| Great Krummhorn | L1 | 01-52 | 64 |
| Swell Trompette | L2 | 68-09 | 72 |
| Great Krummhorn | L2 | 09-68 | 72 |
| Swell Trompette | L3 | 76-13 | 64 |
| Great Harpsichord | L1 | 09-68 | 72 |
| | | | 344 |

Figure 15:
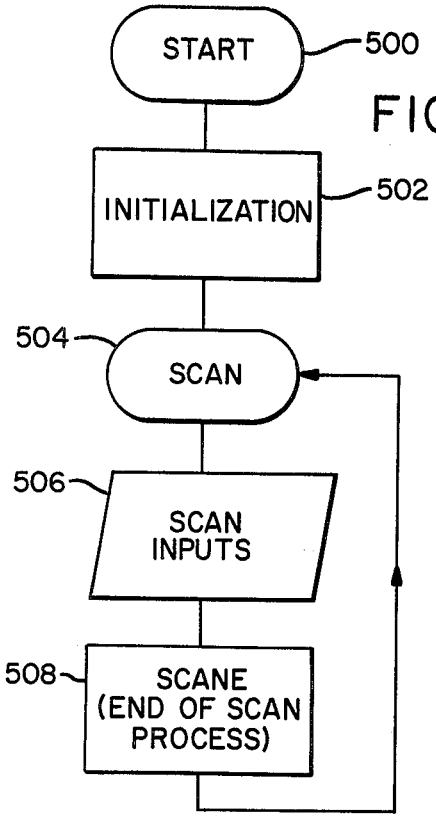
Figure 16:
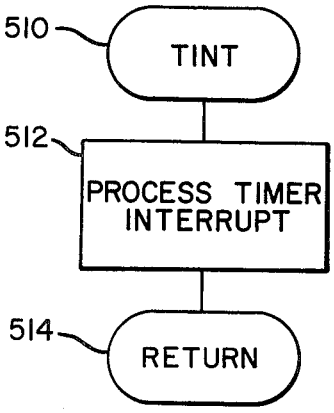
Figure 17:
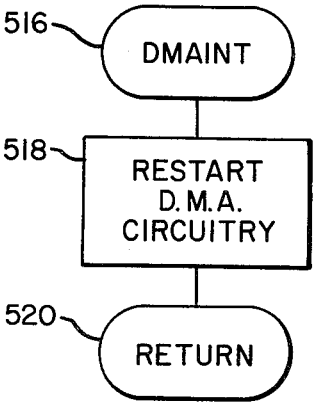

FIGS. 15-35 illustrate the system software in flow-diagram fashion, it being understood the illustrated program is stored in machine language form in the read only memory or program memory of FIG. 12. FIG. 15 illustrates an overview of the system software. After start and initialization procedures represented by blocks 500 and 502 respectively, the SCAN routine indicated at 504 is entered. Pursuant to this routine, all inputs are scanned, as indicated by block 506 in FIG. 15, including keyboard changes and stop changes. After the complete scan of system inputs, various concluding processes are completed according to the end of scan or SCANE routine 508. Return is then made to the SCAN routine and the sequence is repeated indefinitely as long as the instrument is powered. Concurrently, the interrupt processes are carried out as illustrated for example in FIGS. 16 and 17. Timer interrupt or TINT, indicated at 510, is employed as noted in block 512 to interrupt the processor for a time out procedure used in turning off the instrument when no keyboard inputs have been received for an extended period of time, and for interrupting the processor to allow for debounce of toe studs and the like. To this end, every ¼ (quarter) second, the routine sets a flag (QSECF) which is examined in block 686 of FIG. 34 and, if set, cleared in block 688 of FIG. 34.

When the system is first started a direct memory access or DMA will initially occur for providing information to the output register chains illustrated in FIGS. 2, 3 and 4. As soon as DMA has supplied a complete output, DMAINT is asserted as indicated at 516 in FIG. 17 and initiates an interrupt for restarting the DMA circuitry per block 518. The DMA circuitry is repetitively restarted for another cycle of operation and each time a new cycle of DMA output is supplied. After either the timer interrupt or the DMA interrupt, return is made to the principal program at 514 and 520 respectively.

Figure 18:
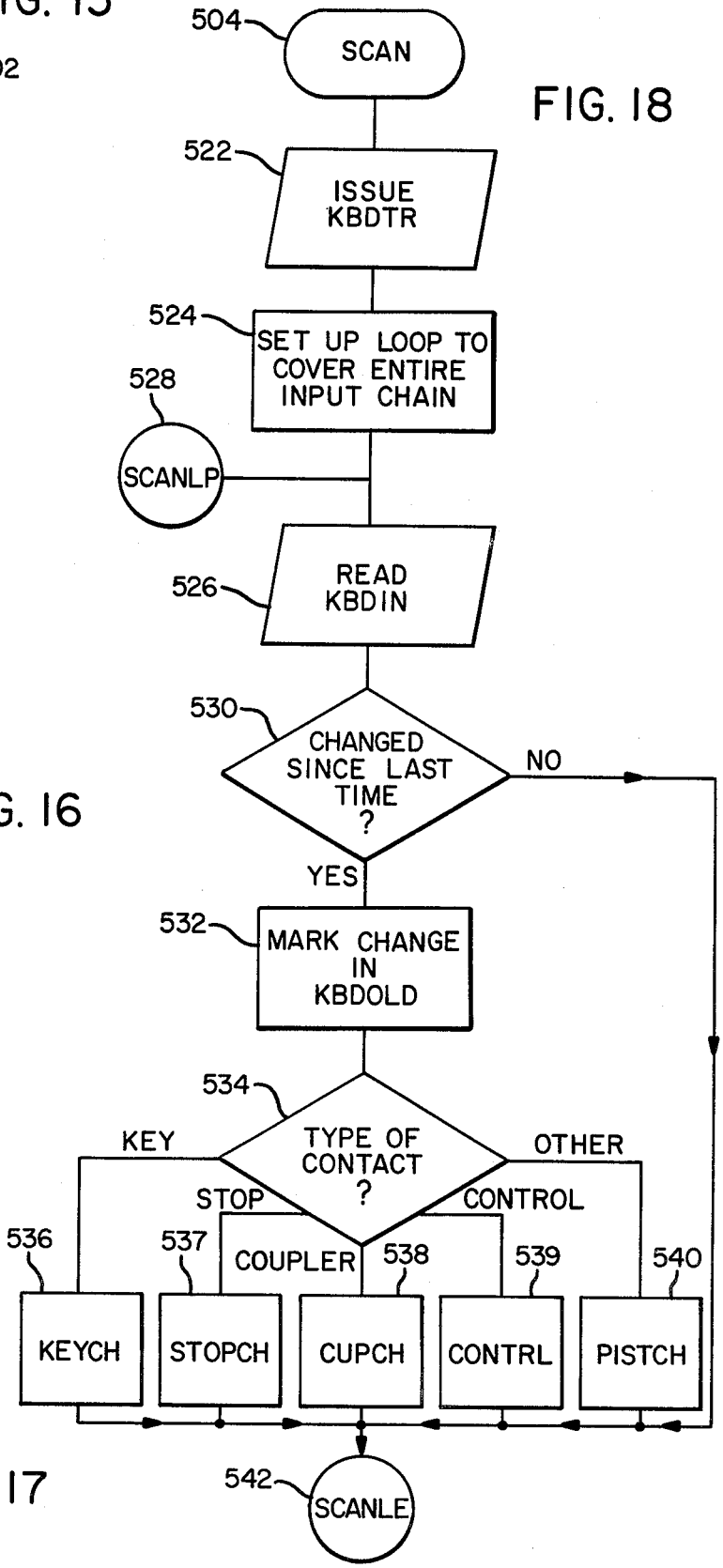

The scan routine 504, illustrated in greater detail in FIG. 18, initially asserts KBDTR in block 522 for initializing the input serial chain. The status of the input switches is strobed into the registers illustrated in FIG. 7. A loop is set up in the software as noted in block 524 to sequence through every element in the input chain. For each position in the loop the present state is read with KBDIN at 526 in FIG. 18 in the manner further illustrated in FIG. 6. For each position in the chain, we read the current state and then, as indicated in decision block 530, we note for each of the contacts whether a change has occurred since the last scanning cycle. A table of states is maintained in the RAM memory which is designated KBDOLD and if a change has occurred, the change is entered into KBDOLD at 532 to update the status. Therefore a future change or lack of change can be determined in decision block 530. In decision block 534 the determination is made as to the type of contact that has changed, whether it is a key, a stop, a coupler, a general on-off control such as a tremulant or the like, or whether some other type of contact change has occurred as in the case of a piston. In accordance with a type of contact change, one of the routines indicated at 536 through 540 is called as will be hereinafter illustrated in greater detail. The appropriate action is then performed such as a key change, stop change, coupler change or the like.

At scan loop end, SCANLE illustrated at 542, decision block 544 in FIG. 19 is entered and it is determined whether the loop is complete, i.e. the determination is made whether we have looked at all the inputs in the chain. If not, return is made to scan loop, SCANLP, 528 in FIG. 18. If the loop is complete, we continue on to the SCANE routine 508.

The key change routine, KEYCH, is further illustrated, in FIG. 20. We set up a loop for key change to cover all couplers that work "to" this manual, as indicated at 546. In the case of a swell to great coupler, "this manual" is considered the great manual. In block 548 a check is made as to whether a particular coupler is on. If the coupler is on, we perform the NEW routine for the coupled division, as indicated in block 550, but if the coupler is not on the NEW routine is skipped. The coupled division will be the swell division in the case of the swell to great coupler. In decision block 552, a determination is made whether the end of a loop has been reached or if other couplers are to be checked. If the end of the loop has not been reached, the program once more enters decision block 548, and if the end of loop has been reached, return 553 is made to FIG. 18.

Referring to FIG. 21, illustrating the NEW routine in greater detail, a transposition value is first applied at 556 assuming the instrument incorporates a transposer which will change the note played by one or more semitones. Then in block 558 the relevant address for the note is calculated according to a portion of RAM memory designated KTBX, the latter comprising an area of memory containing a map of effective key down positions not only for keys which are actually depressed, but for other notes that are "played" because of coupler action. In decision block 560, the determination is made whether the input provided is an "on" input. If it is, the KTBX count at the relevant address is incremented as indicated in block 562. In decision block 564, the determination is made as to whether the information previously stored at the address was a zero and if the determination is yes, the KEYON routine 568 is called. If the previously stored value was not a zero, then return is made at 566 to FIG. 20.

Returning to decision block 560, if the input is to the "off" position, the KTBX count at the relevant address is decremented, and in decision block 572 the determination is made whether the count is now zero. If it is, KEYOFF routine 574 is called. Otherwise, return is made at 566.

Figure 22:
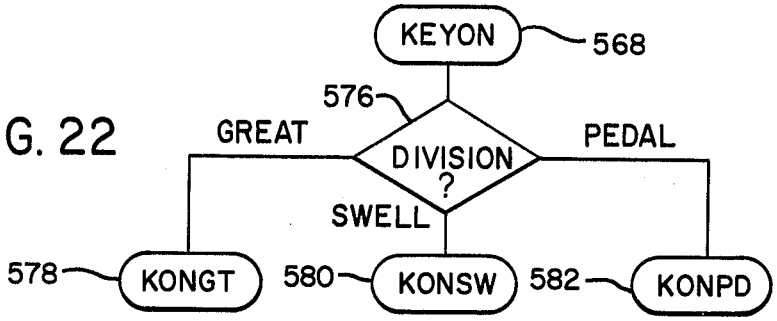
Figure 23:
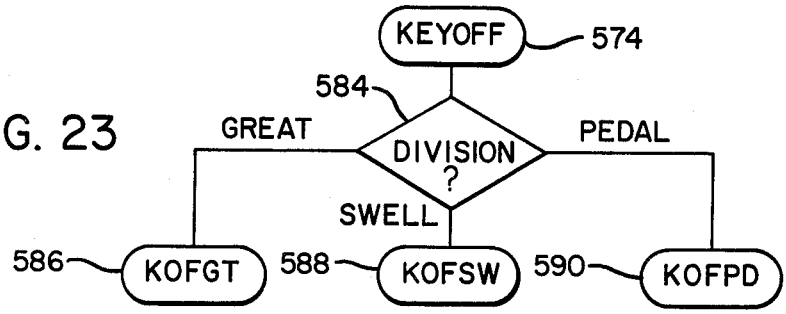

The KEYON and KEYOFF routines are divided into divisions, i.e. great, swell and pedal divisions as indicated in FIGS. 22 and 23. In decision block 576 in FIG. 22, query is made as to whether the KEYON indication is for the great, swell or pedal divisions, and accordingly one of the respective routines KONGT, KONSW or KONPD is called as indicated at 578, 580 and 582. Similarly, referring to FIG. 23, a determination is made in decision block 584, whether the KEYOFF indication is for the great, swell or pedal division, and accordingly routine KOFGT, KOFSW, or KOFPD is called is indicated at 586, 588 and 590 respectively.

Figure 24:
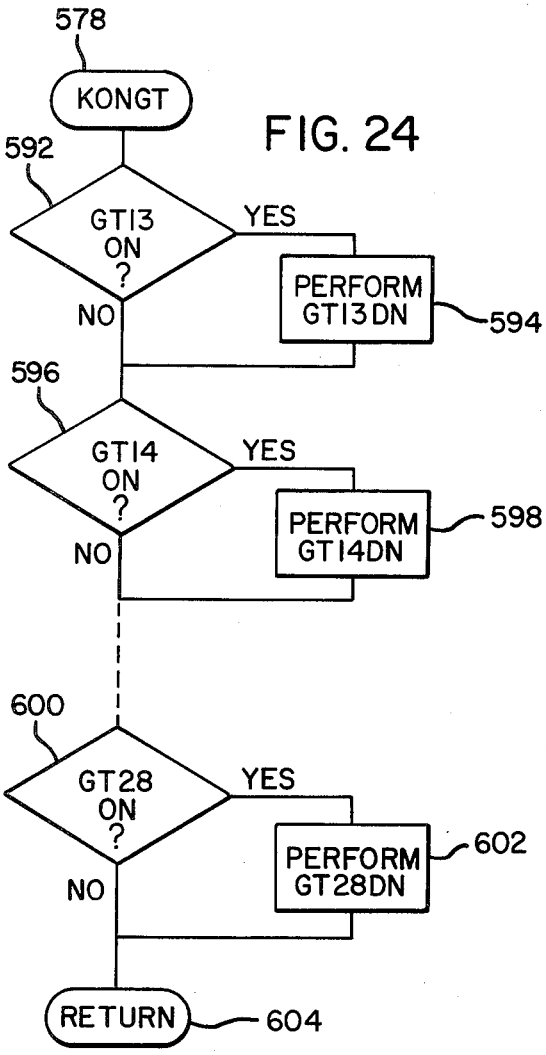
Figure 30:
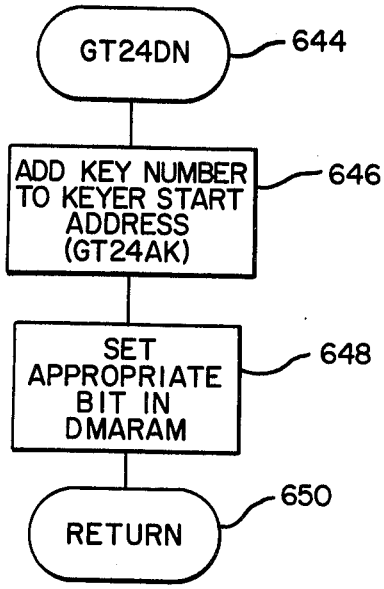
Figure 32:
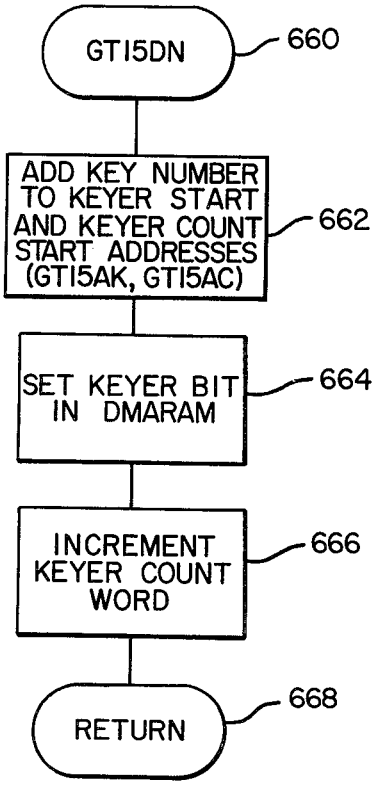

The routine KONGT for a KEYON in the great division is illustrated in FIG. 24, and it is understood this routine is also typical of KONSW and KONPD. In decision block 592 it is determined whether a particular stop for this division, in this case the stop designated GT13, is actuated or not. If it is, the routine branches to block 594 for performing GT13DN, which comprises an individual "keyer on" routine. If stop GT13 is not on, the program proceeds to block 596 and the next stop, GT 14 is queried. If the latter stop is on, the routine GT14DN is performed at 598. Thus, it will be seen a different keyer, actuated by a different bit in the output shift register chains, will be turned on if stop GT14 is on rather than stop GT13. The program proceeds through the stops for this division of the organ until the last stop GT28 is queried in decision block 600, and if the stop is on, the routine GT28DN is performed at 602. Return is finally made at 604 to FIG. 21. Typical individual "keyer on" routines are illustrated in FIGS. 30 and 32 for routines GT24DN and GT15DN respectively and will be discussed in connection therewith.

Figure 25:
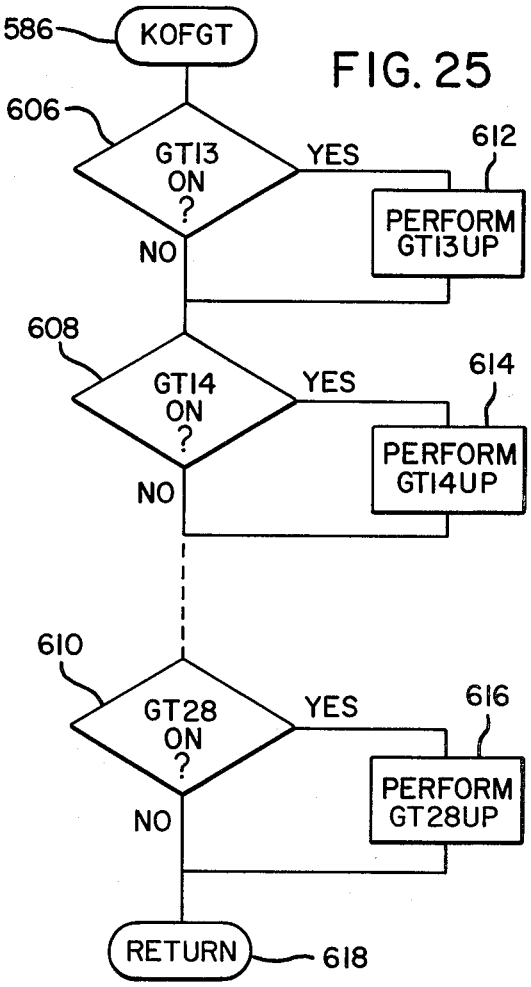
Figure 31:
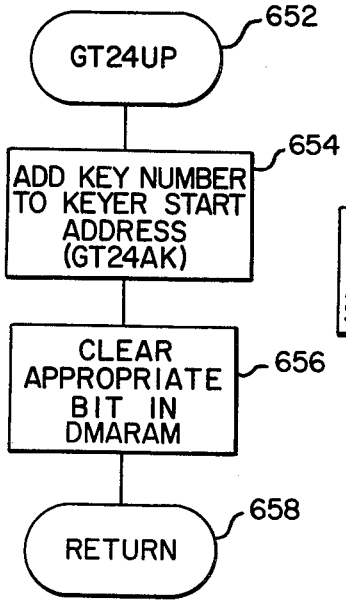
Figure 33:
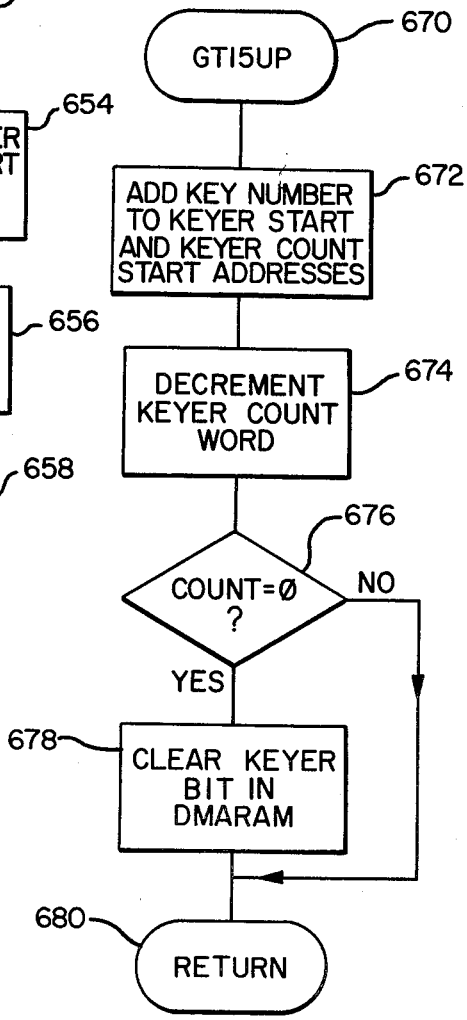

The routine KOFGT for a key off in the great division is illustrated in FIG. 25, and it is understood this routine is also typical of KOFSW and KOFPD. This routine is quite similar to KONGT in FIG. 24, with stops GT13, GT14 . . . GT28 being queried at 606, 608 and 610, with branch being made to "keyer off" routines GT13UP, GT14UP . . . GT28UP at 612, 614, and 616 if the particular stops are actuated. Return is made to FIG. 21 at 618. Typical individual "keyer off" routines GT24UP and GT15UP are illustrated in FIGS. 31 and 33 and will be discussed in connection therewith.

Figure 26:
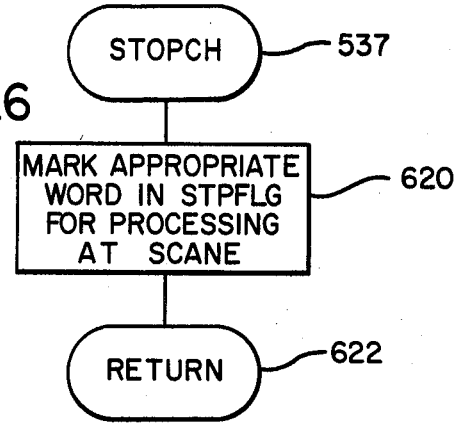

Considering the stop change routine 537 (see FIG. 18) further reference is made to FIG. 26. At this time, the stop change is marked in an area of random access memory called STPFLG, and the stop change is subsequently processed at SCANE. Return is then made at 622 to FIG. 18.

Figure 27:
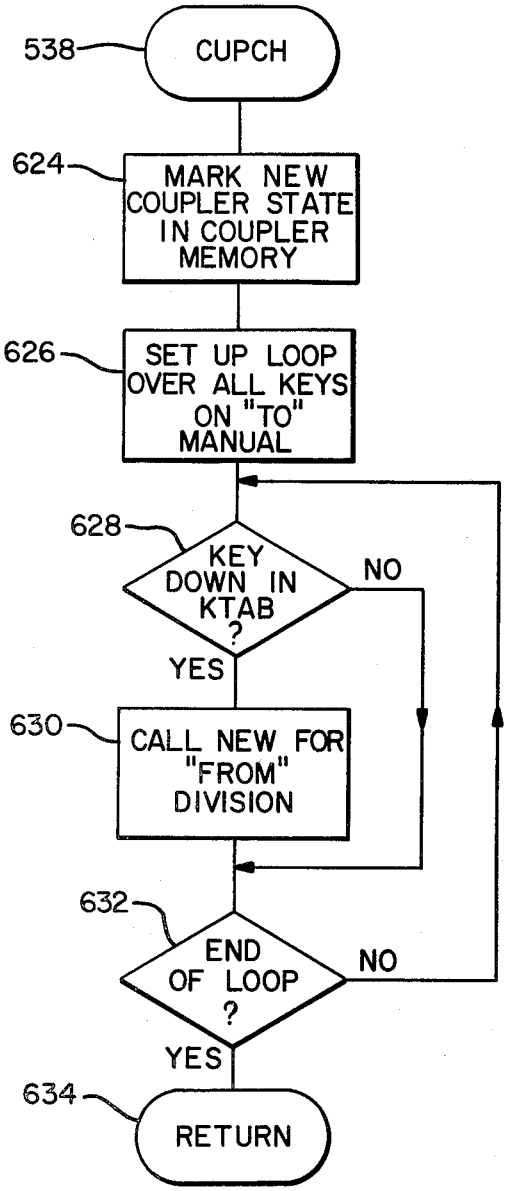

The coupler change routine 538 is further illustrated in FIG. 27. At 624, the new coupler state is marked in random access memory, and if it turns out there are no keys down at this time, then this will be the only action taken. In block 626 a loop is set up over all the keys on the "to" manual, noting that if the coupler is a swell to great coupler, then the "to" manual is the great manual. In decision block 628, the query is made whether a particular key is indicated as down in the KTAB area of random access memory. If the answer is yes, the NEW routine for the "from" division is called in block 630. (See FIG. 21 for the NEW routine.) If the key is not indicated as down, block 630 is skipped and decision block 632 is entered for determining whether it is the end of the loop. If yes, return is made at 634 to FIG. 18, and if no, the program loops to decision block 628.

Figure 28:
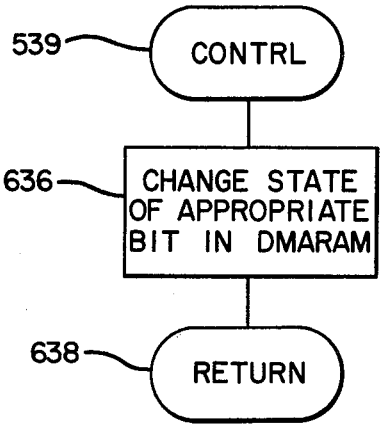
Figure 29:
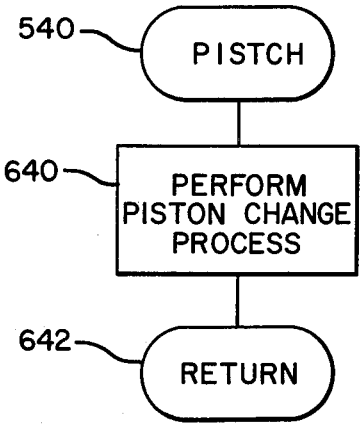

Referring to the control routine 539, further reference is made to FIG. 28. The control routine enables individual bits in the DMA RAM memory as indicated at 636 in accordance with a particular control signal. Thus, in the case of tremulants and the like, a change is made in the state of an appropriate bit in DMA RAM. Thereafter, return is made at 638 to FIG. 18. In accordance with the piston change routine in FIG. 29, the appropriate piston change processes are performed as indicated by block 640 and return is made at 642 to FIG. 18.

Referring to FIGS. 30, 31, 32 and 33, two classes of "keyer on" routines and 37 keyer off" routines are illustrated. FIGS. 30 and 31 are illustrative of the operation for "unique" keyers, while FIGS. 32 and 33 are illustrative of "unified" keyers. It is understood this terminology is for the present only a software distinction as will hereinafter more fully appear. Furthermore, during this part of the discussion, a keyer will be considered as an individual output from an individual register in an individual chain of registers, although, of course an actual physical keyer may receive and consolidate outputs from more than one register chain as hereinbefore described. There are four available keyer levels in the hardware of the system, also as hereinbefore described, but in some instances a greater number of levels may be programmed for obtaining five stops or more from one keyer chain. Therefore, in such instance, two stops may have to be assigned the same level and a given register bit position may be set for two different stops. For purposes of the present discussion, this will be considered the case of a "unified" keyer.

In the case of the unique keyer or non-unified keyer wherein a bit corresponds to one stop, a typical "keyer on" routine is designated GT24DN at 644 in FIG. 30. In block 646, the key number is added to the keyer start address for a rank of keyers or keyer slide. The appropriate bit is then set in DMA RAM according to block 648 and return 650 is made to FIG. 24. Essentially the same procedure takes place in the "keyer off" routine designated GT24UP at 652 in FIG. 31. Again, the key number is added to the keyer start address in block 654 but the DMA RAM bit is cleared according to block 656 after which return 658 is made to FIG. 25.

The situation in FIG. 32 for the unified keyer is slightly more complicated wherein a bit may be set for more than one stop. Referring first to a typical routine GT15DN at 660 in FIG. 32, a count table is kept in memory to keep track of how many times a particular bit has been turned on. Again, in block 662 we add the key number to the keyer start address and set the keyer bit in DMA RAM as indicated in block 664. We also increment a count word that is associated with that particular bit as mentioned in block 666. (As will be noted in block 662, the key number has also been added to a keyer count start address for locating the address of the keyer count.) Return is made at 668 to FIG. 24. A keyer off routine GT15UP indicated at 670 in FIG. 33 also adds the key number to the keyer start and keyer count start addresses in block 672 and decrements the keyer count word in memory in block 674. In block 676, the decision is made whether the count of the keyer count word is now zero, and only if the answer is yes is the keyer bit in DMA RAM cleared in block 678. If the determination is no, then return is made at 680 to FIG. 25. It is seen that if the particular keyer bit in DMA RAM has been set by two different stops, the keyer bit will not return to zero for turning off the keyer should only one key or stop be raised.

Figure 34:
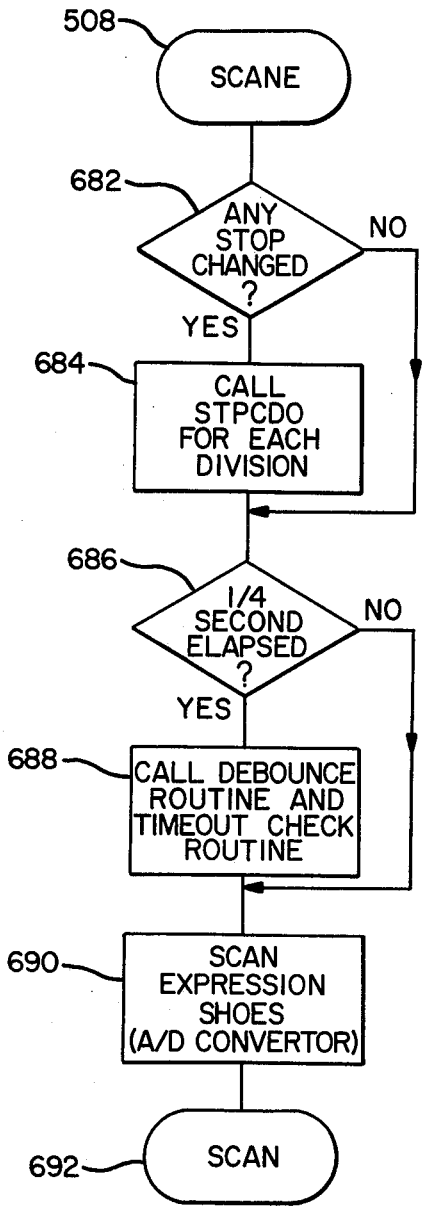

In FIG. 34 the end of scan process or SCANE is indicated at 508. A determination is made in decision block 682 whether there are any stop changes according to STPFLG mentioned in connection with the stop change routine of FIG. 26. If there has been a stop change, we call the "stop change do" routine STPCDO for each division, in block 684, this routine being further illustrated in FIG. 35. If there are no stop changes, block 684 is skipped. After an elapsed time indicated in decision block 686 debounce and time out check routines are called as noted in block 688, and either before the lapse of one-fourth second according to block 686 or after the routines of block 688, expression shoe information and the like from the A to D converter is scanned as noted in block 690. (See FIG. 14.) Then return to the routine SCAN in FIG. 18 is made at 692.

Figure 35:
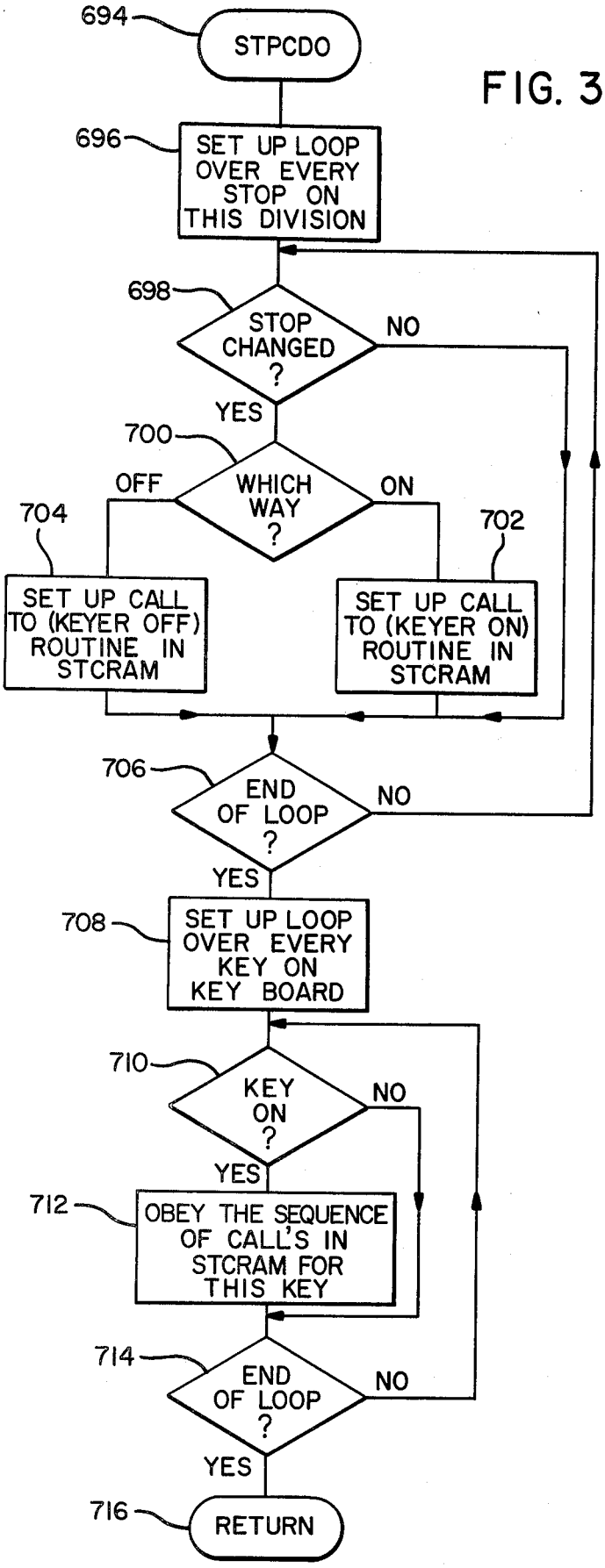

Referring to FIG. 35 for the STPCDO routine at 694, it should be noted there is possibly more than one stop change at a time for a particular division. In block 696 a loop is set up over every stop on the division under consideration. If a stop has changed according to decision block 698, then decision block 700 queries whether the stop change is on or off. If a particular stop has turned on, we set up a call instruction in block 702 to an area of random access memory labeled "stop change ram" or STCRAM. A call is made to the appropriate keyer on routine. If the stop change is off, then we set up a call in block 704 to the appropriate keyer off routine in STCRAM. This action is performed for every stop that has changed according to decision block 706 which causes a return back to decision block 698 if the end of the loop has not been reached. Having brought about one or more calls to the keyer on or off routines in STCRAM, we set up a loop in block 708 for every key on the keyboard of the particular division under consideration. If the key is on according to decision block 710, then we obey the sequence of calls in STCRAM for this key as noted in block 712. The appropriate keyer on or keyer off routines are called as indicated in FIGS. 30–33. Of course, if a key is not on according to decision block 710, then block 712 is skipped. As indicated by end of loop decision block 714, the routine is repeated for every key on the division keyboard. When the end of the loop is reached, return is made at 716 to FIG. 34.

The system software is illustrated in greater detail in the program listing appended to this specification. The program was prepared on a GenRad/Futuredata AMDS 2300-Z80 development system. In the listening, "ET" is the COMMAND FILE used to edit, assemble, link and execute. "MIC.MAC.S" is a MACRO LIBRARY file containing all the macros used in the program. The program proper is split into three separate assembled files: (1) "T810.SYS.S", mostly "system" (overall control), (2) "T810.SUB.S", mostly subroutines, and (3) "T810.DAT.S", mostly data tables.

Major RAM tables are as follows:

| | |
|---|---|
| DMARAM | The image of the 4094 shift register/latches (72,74, etc.) that is transmitted by the DMA circuitry. |
| KBDOLD | The image of the input data chains, updated by the SCAN routine and used by SCAN to detect changes. |
| KTAB | Stores current state of keyboards. Updated by KEYCH and used by NEW. Each manual uses a different bit position to store the information. |
| KTBX | Stores current state of divisional keys, after coupling and transposition. Each key entry takes one word which contains the count of the number of times the key is activated. For instance, if the Swell to Great coupler is on, and the same keys depressed on Swell and Great keyboards, then the count for the Great key will be 1 and for the Swell, 2. |
| CPTOxx | For example, couplers to Great (CPTOGT). Initilized by CPINIT to contain the following information:<br>1. Bit mask used in KTAB for this manual<br>2. Number of couplers to this manual<br>3. Current state (on/off) of first coupler<br>4. Transposer value for this coupler (+12 = superoctave)<br>5. Division coupled by this coupler.<br>Three to Five (3–5) repeated for remaining couplers. |
| SWTAB | Contains the state of each stop tablet/drawknob. Bit Ø is the physical state, bit 1 if forced on by the Crescendo shoe, bit 2 if forced on by Tutti (full organ) piston. |
| | The major ROM tables are as follows: |
| SWTAB | Contains two words for each tablet, the first being used to indicate the type (Stop/Coupler, etc.), the second containing the number within that group. |
| PISTAB | Contains the equivalent information for pistons. |
| xxSTPC | EG., GTSTPC. Contains information used by STPCDO for each stop:<br>1. Address of key up routine<br>2. Address of key down routine<br>3. Address of mute off routine<br>4. Address of mute on routine<br>5. Address of airsound control address |

The mute and airsound control are not essential to the operation of this instrument and therefore are not described in detail elsewhere in this discussion.

Each stop is assigned a four character name: XXYY, where XX is the division (SW for Swell, GT for Great, and PD for Pedal) and YY is the stop number from 00 to 99, e.g. GT24 or PD00. For each keyer level, one or two RAM areas are defined: (1) The image in DMA RAM of the keyer 4094 shift registers (e.g. SWFL2K for Swell Flute Level 2 keyer), and (2) possibly a usage count table in a four bit RAM, (e.g. SWFL2C).

The Macro STPDEF is used to define four pieces of information for each stop:

| | |
|---|---|
| 1. xxyyB | The bit position used for this keyer in DMA RAM |
| 2. xxyyAK | The address of the keyer for this stop (including any displacement to allow |

-continued

| | |
|---|---|
| | for starting keying at a note other than the first note of the keyer rank for higher pitched stops). |
| 3. xxyyAC | Address of count table, or zero if none. |
| 4. xxyyD | Direction +1 = forwards.<br>−1 = backwards.<br>Due to mechanical constraints, some keyers are implemented so that increasing addresses in DMA RAM effect increasing pitch (forwards) and some effect decreasing pitch, as mentioned. |

For "straight" stops (with no breakbacks or other complications) the Macro call, STDKEY xxyy generates the necessary code for the keyer down and up routines (xxyyDN and xxyyUP).

The listing is as follows:

```
ET

JE
T9,16,30,60
L 1:T810.^1.S
^K

SU
W 1:T810.^1.B
JM
E 1:T810.^1.S,1:T810.^1.B
JA
OETM^L
1:T810.^1.S
0:MIC.MAC.S
1:T810.^1.R
JL
DOLS^L
1:T810.SYS.R
1:T810.SUB.R
1:T810.DAT.R

1:T810.O
#ORG X'0100'
SVEC,SPROM,MSUBR,SUBR,CPROM
#ORG X'4000'
DMARAM,RAM8,CPRAM,STAK,RAM4
#ORG X'D800'
CMDS
#END START

JD
D
ZS=100
D100
S 3E 00 D3 AC 0 0 0 0 0 0
D104
BS0
E100
BC
L1:T810.O
DO
D400
X
D800
X
DC00
X
D1000
X
D1400
X
D1800
X
D1C00
X
D2000
X

ET

D2400
X
D2800
X
D2C00
X
D100
U 4000,FF
U 4800,FF
U 5000,FF
U 5800,FF
ZS=8000
MCM
D10A
BS0
E$
BC0
MCIM
E$
```

```
 PRINT     ALL                    V00.00-001
 SPC                GENERAL MACROS

CLA         MACRO                              clear accumulator
            XOR      A
            ENDM

TST         MACRO    ARG                       test 8-bit word
           IF       '&ARG'<>'A'
            LD       A,&ARG
           ENDIF
            OR       A
            ENDM

ADDHL       MACRO    VAL                       add 8 bits to HL
           IF       '&VAL'<>'A'
            LD       A,&VAL
           ENDIF
            ADD      A,L
            LD       L,A
            JR       NC,*+2+1
            INC      H
            ENDM

ADDDE       MACRO    VAL                       add 8 bits to DE
           IF       '&VAL'<>'A'
            LD       A,&VAL
           ENDIF
            ADD      A,E
            LD       E,A
            JR       NC,*+2+1
            INC      D
            ENDM


 SPC                Special Macros for Micasko

DUMKEY      MACRO    MAN,FR,TO
I           DEFL     &FR
           IF       '&TO'=''
M           DEFL     1
           ELSE
M           DEFL     &TO-&FR+1
           ENDIF
            DO       &M
N           SUBSTR   4,2,'&I'
&MAN&N!DN   RET
&MAN&N!UP   RET
I           DEFL     &I+1
            ENDDO
            ENDM
```

```
STDKEY     MACRO    STP                          code for standard keyers
   IF  &STP!D<0
DIFF       DEFL     'SBC'
   ELSE
DIFF       DEFL     'ADD'
   ENDIF
&STP!DN    LD       HL,&STP!AK
   IF  &STP!D<0
           OR       A
   ENDIF
           &DIFF    HL,DE
           SET      &STP!B,(HL)
          IF       &STP!AC=0
           RET
          ELSE
           LD       HL,&STP!AC
           &DIFF    HL,DE
           INC      (HL)
           RET
          ENDIF

          IF &STP!AC=0
&STP!UP    LD       HL,&STP!AK
     IF &STP!D<0
           OR       A
     ENDIF
           &DIFF    HL,DE
           RES      &STP!B,(HL)
           RET
          ELSE
&STP!UP    LD       HL,&STP!AC
     IF &STP!D<0
           OR       A
    ENDIF
           &DIFF    HL,DE
           DEC      (HL)
           RET      NZ
           LD       HL,&STP!AK
           &DIFF    HL,DE
           RES      &STP!B,(HL)



           RET
          ENDIF
           ENDM

KDOWN      MACRO    MAN,STRT,FIN                 call stop 'on' routine
I          DEFL     &STRT
           DO       &FIN-&STRT+1
           LD       A,(STPFLG+&I)
           RRA
N          SUBSTR   4,2,'&I'
           CALL     C,&MAN&N!DN
I          DEFL     &I+1
           ENDDO
           ENDM
KUP        MACRO    MAN,STRT,FIN                 call stop 'off' routine
I          DEFL     &STRT
           DO       &FIN-&STRT+1
           LD       A,(STPFLG+&I)
           RRA
```

```
N          SUBSTR  4,2,'&I'
           CALL    C,&MAN&N!UP
I          DEFL    &I+1
           ENDDO
           ENDM

STPDEF     MACRO   NAM,B,AK,AC,D          define a stop
&NAM!B     EQU     &B
&NAM!AK    EQU     &AK
&NAM!AC    EQU     &AC
&NAM!D     EQU     &D
           ENDM

STPDUP     MACRO   A,B,D
&A!B       EQU     &B!B
&A!AK      EQU     &B!AK+&B!D*&D
   IF &B!AC=0
&A!AC      EQU     0
   ELSE
&A!AC      EQU     &B!AC+&B!D*&D
   ENDIF
&A!D       EQU     &B!D
           ENDM

MIXDNR     MACRO   STP                   mixture rank 'on' routine
   IF &STP!D<0
DIFF       DEFL    'SBC'
           OR      A
   ELSE
DIFF       DEFL    'ADD'
   ENDIF
           LD      HL,&STP!AK
           &DIFF   HL,DE
           SET     &STP!B,(HL)
          IF       &STP!AC<>0
           LD      HL,&STP!AC
           &DIFF   HL,DE
           INC     (HL)



          ENDIF
           ENDM

MIXUPR     MACRO   STP                   mixture 'off' routine
   IF &STP!D<0
DIFF       DEFL    'SBC'
           OR      A
   ELSE
DIFF       DEFL    'ADD'
   ENDIF
          IF       &STP!AC<>0
           LD      HL,&STP!AC
           &DIFF   HL,DE
           DEC     (HL)
           JR      NZ,L&INDX
          ENDIF
           LD      HL,&STP!AK
           &DIFF   HL,DE
           RES     &STP!B,(HL)
L&INDX    EQU      *
           ENDM
```

```
MX85DN      MACRO    STP,S85,NOTE
            CP       &NOTE
            JR       C,L&INDX
            LD       HL,&S85!AK
            SET      &S85!B,(HL)
   IF &S85!AC<>0
            LD       HL,&S85!AC
            INC      (HL)
   ENDIF
            JR       E&INDX
L&INDX      MIXDNR   &STP
E&INDX      EQU      $
            ENDM

MX85UP      MACRO    STP,S85,NOTE
            CP       &NOTE
            JR       C,L&INDX
   IF &S85!AC<>0
            LD       HL,&S85!AC
            DEC      (HL)
            JR       NZ,E&INDX
   ENDIF
            LD       HL,&S85!AK
            RES      &S85!B,(HL)
            JR       E&INDX
L&INDX      MIXUPR   &STP
E&INDX      EQU      $
            ENDM

TOPBK2      MACRO                                  restore DE after top octave
            LD       A,E
            ADD      A,C
            LD       E,A
            ENDM


IFLESS      MACRO    NUM                           execute code if A<num
FILAB       DEFG     'FI&INDX'
            CP       &NUM
            JR       NC,&FILAB
            ENDM

FI          MACRO                                  end of if code
&FILAB      EQU      $
            ENDM

MUON        MACRO    NAME
            LD       HL,&NAME!MK
            SET      LMPBIT,(HL)
           IF &NAME!MC<>0
            LD       HL,&NAME!MC
            INC      (HL)
           ENDIF
            RET
```

```
MUOFF    MACRO    NAME
        IF &NAME!MC=0
         LD       HL,&NAME!MK
         RES      LMPBIT,(HL)
         RET
        ELSE
         LD       HL,&NAME!MC
         DEC      (HL)
         RET      NZ
         LD       HL,&NAME!MK
         SET      LMPBIT,(HL)
         RET
        ENDIF
         ENDM

         END


*****************************************************************
*                                                               *
*                    D E F I N I T I O N S                      *
*                                                               *
*****************************************************************


B0       EQU     X'01'
B1       EQU     X'02'
B2       EQU     X'04'
B3       EQU     X'08'
B4       EQU     X'10'
B5       EQU     X'20'
B6       EQU     X'40'
B7       EQU     X'80'

LMPMSK   EQU     B7

* I/O ports

KBDIN    EQU     X'01'       RD read and shift console data
KBDTR    EQU     X'02'       WR transfer data to input s/r's
DMAGO    EQU     X'03'       WR load DMA counter, reset iff
TIMACK   EQU     X'04'       WR clear timer iff
MASDAT   EQU     X'05'       RD read data from master
MASSTB   EQU     X'06'       WR interrupt master
MASACK   EQU     X'0A'       WR clear irpt from master
SLVDAT   EQU     X'08'       WR send data to slave
SLVSTB   EQU     X'09'       WR interrupt slave
SLVACK   EQU     X'07'       WR clear irpt from slave
OPTSW    EQU     X'0B'       RD read option switches
```

```
*****************************************************************
*                                                               *
*              8 1 0 T    D E F I N I T I O N S                 *
*                                                               *
*****************************************************************


STKSIZ  EQU     400             stack size

NODIV   EQU     4
NOVEC   EQU     15              # OF IRPT VECTORS
NOSHOE  EQU     3               # of shoes


*****************************************************************
*                                                               *
*       I N I T I A L L Y   C L E A R   A R E A                 *
*                                                               *
*****************************************************************


        RSEG    RAM8

TRANSP  DS      1               current xpose value
TROLD   DS      1
TRNEW   DS      1
EXPVAL  EQU     *
EX1VAL  DS      1
EX2VAL  DS      1
CRVAL   DS      1
NXTEXP  DS      1
CRMEM   DS      2               cresc mem addr
ORCVAL  DS      1
ORCSTF  DS      1
COMTAB  DS      2               current comb mem addr
TUTSW   DS      1               tutti piston state
SETF    DS      1               settable flag
MSETF   DS      1               memory settable flag
MEMN    DS      1               current mem #
MKEY    DS      1               memory enable bits
STPCHF  DS      1               stops changed flag
QSECF   DS      1               quarter second flag
QSECT   DS      1                  ''      ''   timer
SETLKS  DS      1               setting locks flag
LKDIGS  DS      9               lock temp area
MINS    DS      2               minute timer
MUTED   DS      1               muted flag
PISTTX  DS      2               piston function table addr
TIMER   DS      1               30 minute timer
PSCNT   DS      1               power switch counter
CHIMF   DS      1
CHIMNO  DS      1
HDPHFL  DS      1               HEADPHONE FLAG

        RSEG    STAK
        DS      STKSIZ
STACK   EQU     *
```

```
*****************************************************************
*                                                               *
*                          G L O B A L S                        *
*                                                               *
*****************************************************************

        GLBL    NOMC,MCADDR,NSTP,STOPCH,STPFLG,AIRDO
        GLBL    CPINIT,RAMSIZE,PWRDO,KBDOLDE
        GLBL    CPTOPD,CPTOGT,CPTOSW
        GLBL    PISTCH,KBDLEN,KEYCH,DEBPST
        GLBL    GTSTPC,PDSTPC,SWSTPC
        GLBL    STPCDO,DEBDO,TILTON,EXPCK
        GLBL    TILTLEN,CKPIS,TILTOF,PWRTIM
        GLBL    NODEB,CRMEM1,CRMEM2,ORCLMP
        GLBL    RAMSTRT,DMAEND4,QSECK
        GLBL    EXP1DO,EXP2DO,CRESC

        GLBL    NXTEXP,NOSHOE,EXPVAL,EXPDTB,CRORCH
        GLBL    TUTSW,MSETF,MKEY,HDPHFL
        GLBL    TROLD,TRNEW,COMTAB,TRANSP,STPCHF
        GLBL    MEMN,SETF,CRMEM,MUTED,CRVAL
        GLBL    SETLKS,MINS,TIMER,PISTTX
        GLBL    NODIV,LKDIGS
        GLBL    EX1VAL,EX2VAL,TOPBK1,PSCNT
        GLBL    ZSPACE

*****************************************************************
*                                                               *
*   V E C T O R S   -   I N I T I A L I Z A T I O N             *
*                                                               *
*****************************************************************

        GLBL    START

        RSEG    SVEC

        DC      H(TIMINT)
START   EQU     *
        LD      SP,STACK
        DI
        LD      A,H(START)
        LD      I,A
        IM2
        OUT     (SLVACK),A
        LD      HL,RAMSTRT
        LD      DE,RAMSTRT+1
        LD      BC,RAMSIZE-1
        LD      (HL),0
        LDIR
        OUT     (MASACK),A
        OUT     (SLVACK),A
        CALL    PWRDO
        CALL    DMAINT
```

```
        LD      HL,CRMEM1
        LD      (CRMEM),HL
        LD      HL,CRMEM2
        LD      DE,ORCMEM
        LD      B,TILTLEN
CRCIN   LD      A,(DE)
        INC     DE
        RRD
        LD      A,(DE)
        INC     DE
        RRD
        INC     HL
        DJNZ    CRCIN
        LD      A,1
        LD      (QSECT),A
        CALL    CPINIT
        JP      SCAN

EXPDTB  JP      EXP1DO
        JP      EXP2DO
        JP      CRESC


*****************************************************************
*                                                               *
*                    I N T E R R U P T S                        *
*                                                               *
*****************************************************************


* DMA completion interrupt

DMAINT  PUSH    AF
        LD      A,DMAEND4-1     reset
        CPL
        OUT     (DMAGO),A           ctr and irpt flip-flop
        JR      TIMI1

*  timer interrupt

TIMINT  PUSH    AF
        OUT     (TIMACK),A      reset irpt flip-flop
        LD      A,(QSECT)       decr
        DEC     A                   timer
        LD      (QSECT),A
        JR      NZ,TIMI1
        LD      A,QSECK         reset
        LD      (QSECT),A           timer
        LD      (QSECF),A       flag a 1/4 second
TIMI1   POP     AF
        EI
        RETI

DUMINT  OUT     (MASACK),A
        OUT     (SLVACK),A
        EI
        RETI
```

```
ZSPACE  EQU     256-(*-START+NOVEC*2)
   IF ZSPACE<0
        Vectors overwrite code - initialisation routine too big
   ENDIF
        ORG     START+256-2*NOVEC

        DC      B(TIMINT)
        DC      B(DMAINT)
        DC      B(DMAINT)
        DC      B(DUMINT)
        DC      B(DUMINT)
        DC      B(DUMINT)
        DC      B(DUMINT)
        DC      B(DUMINT)
        DC      B(DUMINT)
        DC      B(DUMINT)
        DC      B(DUMINT)
        DC      B(DUMINT)
        DC      B(DUMINT)
        DC      B(DUMINT)
        DC      B(TIMINT)

*****************************************************************
*                                                               *
*               MAIN  INPUT  SCAN  ROUTINE                      *
*                                                               *
*****************************************************************


        RSEG    SPROM

SCAN    OUT     (KBDTR),A       strobe inputs into latches
        LD      B,KBDLEN        length of stream
        LD      HL,KBDOLDE      start at end of table
SCANLP  IN      A,(KBDIN)       get data
        AND     X'F'
        DEC     HL              go backwards in table
        CP      (HL)            same as before?
        JR      NZ,SCANCG       jump if different
SCANLE  DJNZ    SCANLP          loop back to process next input
        JP      SCANE           end of scan - do the other things

*   a change detected

SCANCG  LD      E,A             new word
        XOR     (HL)            get different bits
        LD      D,A                                     in D
        LD      (HL),E          store new word in table
        PUSH    HL

*  process chain 0

        RRC     E               shift data into bit 7
        RRC     D               carry set if this bit changed
        JR      NC,SCANB1                 not changed - skip
```

```
* swell keyboard

        LD      A,B             calculate
        SUB     KBDLEN-63         the key #
        JR      C,SCANA0        not a key
        CP      61
        JR      NC,SCA0         OPTION SWITCH
        LD      HL,CPTOSW       relevant coupler table
        CALL    KEYCH           process key change
        JR      SCANB1          go on to next bit

* OPTION SWITCH
SCA0    BIT     7,E
        JR      Z,SCANB1
        PUSH    BC
        LD      C,A
        LD      A,63
        SUB     C
        LD      HL,CHIMF
        BIT     0,(HL)
        JR      NZ,OPTCK1
        LD      (CHIMNO),A
        JR      OPTCK2
OPTCK1  PUSH    AF
        LD      A,(CHIMNO)
        ADD     A,CHMSTP
        LD      B,A
        LD      C,0
        CALL    STOPCH
        POP     AF
        LD      (CHIMNO),A
        ADD     A,CHMSTP
        LD      B,A
        LD      C,-1
        CALL    STOPCH
OPTCK2  POP     BC
        JR      SCANB1

*  process pistons on swell piston rail

SCANA0  EQU     *
        LD      A,B
        SUB     KBDLEN-63-16
        JR      C,SCANB1        not a piston
        ADD     A,24+24         starting piston #
        CALL    PISTCH

* process chain 1

SCANB1  RRC     E
        RRC     D
        JR      NC,SCANB2

* great keyboard

        LD      A,B
        SUB     KBDLEN-63       get key #
```

```
        JR      C,SCANA1        not a key
        CP      61
        JR      NC,SCA1         OPTION SWITCH
        LD      HL,CPTOGT
        CALL    KEYCH
        JR      SCANB2

* OPTION SWITCH
SCA1    CP      61              MUTE DEFEAT
        JR      NZ,SCANB2
        PUSH    BC
        LD      C,1
        BIT     7,E
        JR      NZ,*+4
        LD      C,-1
        LD      B,NOMC
        LD      HL,MCADDR
SCA1A   LD      A,(HL)
        ADD     A,C
        LD      (HL),A
        INC     HL
        DJNZ    SCA1A
        POP     BC
        JR      SCANB2

* great pistons

SCANA1  EQU     *
        LD      A,B
        SUB     KBDLEN-63-24
        JR      C,SCANB2        not a piston
        ADD     A,24            starting piston #
        CALL    PISTCH

* chain 2

SCANB2  RRC     E
        RRC     D
        JR      NC,SCANB3

* pedal klavier

        LD      A,B
        SUB     KBDLEN-31       get key #
        JR      C,SCANA2        not a key
        LD      HL,CPTOPD
        CALL    KEYCH
        JR      SCANB3

* toe studs etc

SCANA2  EQU     *
        LD      A,B
        SUB     KBDLEN-31-24
        JR      C,SCANA2B       not a toe stud
        CP      NODEB
        JR      NC,SCANA2A
```

```
        CALL    DEBPST          debounce it
        JR      SCANB3
SCANA2A CALL    PISTCH          don't bother debouncing
        JR      SCANB3
SCANA2B EQU     *

* chain 3 - tilt tabs

SCANB3  RRC     E
        RRC     D
        JR      NC,SCANB4
        TST     (MUTED)
        JR      NZ,SCANB4
        LD      A,B
        SUB     24
        CP      TILTLEN+1
        JR      NC,SCANB4
        PUSH    BC
        LD      B,A
        LD      A,E
        AND     B7
        LD      C,A
        CALL    CKPIS
        BIT     7,E
        JR      NZ,SCANA3
        CALL    TILTOF
        JR      SCAN3E
SCANA3  CALL    TILTON
SCAN3E  POP     BC

* chains 4,5,6,7 unused

SCANB4  EQU     *

* restore HL and continue scan

        POP     HL
        JP      SCANLE

*****************************************************************
*                                                               *
*               END  OF  SCAN  PROCESSING                       *
*                                                               *
*****************************************************************

SCANE   CALL    EXPCK           check shoes for changes
        CALL    AIRDO           DO AIR SOUND
        TST     (STPCHF)        stop changes?
        JR      Z,SCANE1                        no.
        LD      IX,SWSTPC       do swell
        CALL    STPCDO                  stop changes
        LD      IX,GTSTPC
        CALL    STPCDO          and great
        LD      IX,PDSTPC
        CALL    STPCDO          and pedal
        CLA
        LD      (STPCHF),A      clear change flag
```

```
SCANE1  TST     (QSECF)         a 1/4 second gone by already?
        JR      Z,SCANE2        no.
        CALL    PWRTIM          check power timeout
        CALL    DEBDO           check debouncing
        CLA
        LD      (QSECF),A       clear the flag for next time

SCANE2  EQU     *
        JP      SCAN

        GLBL    CHMSTP,CARDO

CARDO   LD      A,C
        LD      (CHIMF),A
        LD      A,(CHIMNO)
        ADD     A,CHMSTP
        LD      B,A
        JP      STOPCH


*****************************************************************
*                                                               *
*            HANDLE  TOP  OCTAVE  BREAKBACK                     *
*                                                               *
*****************************************************************

* top octave breakback

TOPBK1  LD      C,0             amount key # changed by
        LD      A,E             key #
        CP      49              top octave?
        RET     C               no.
        LD      C,12            say an octave
        SUB     C               take it away
        LD      E,A             new key #
        RET


*****************************************************************
*                                                               *
*             M I S C E L L A N E O U S                         *
*                                                               *
*****************************************************************


*       orchestral crescendo
        GLBL    GENCAN,ORCSTF,CRORCO,ORCVAL,ORCMEM
        RSEG    SPROM

CRORCH  EQU     *
        BIT     7,E
        RET     Z
        TST     (ORCSTF)
        RET     NZ
```

```
        TST     (SETF)
        JR      Z,CRORCO
        LD      A,(MKEY)
        AND     3
        CP      3
        JR      NZ,CRORCO
        CLA
        LD      (CRVAL),A
        CALL    CRESC
        CALL    GENCAN
        LD      A,-1
        LD      (ORCSTF),A
        LD      A,1
        LD      (ORCVAL),A
        RET
CRORCO  LD      HL,ORCLMP
        LD      A,(HL)
        XOR     LMPMSK
        LD      (HL),A
        LD      HL,CRMEM1
        JR      Z,CRORC1
        LD      HL,CRMEM2
CRORC1  LD      (CRMEM),HL
        JP      CRESC


        END


PRINT ON            V00.00-002

*****************************************************************
*                                                               *
*   XX    XX    X     XXXX     XXXX      XXXX     X  X     XXX  *
*   X X X X     X    X        X     X    X        X X     X   X *
*   X  X  X     X    X        XXXXXX     XXXX     XX      X   X *
*   X     X     X    X        X     X         X   X X     X   X *
*   X     X     X     XXXX    X     X     XXXX     X  X     XXX  *
*                                                               *
*****************************************************************
*                                                               *
*       XXXXXX          XXX            XXXXXX                   *
*     XX      XX      XX XX          XX      XX                 *
*     XX      XX     XX  XX         XX        XX                *
*       XXXXXX          XX         XX        XX  XXXXXXXX       *
*     XX      XX        XX         XX        XX     XX          *
*    XX        XX       XX         XX        XX     XX          *
*     XX       XX        XX         XX      XX       XX          *
*      XXXXXXXXX      XXXXXXXXXX       XXXXXX         XX         *
*                                                               *
*****************************************************************
*                                                               *
*                  S U B R O U T I N E S                        *
*                                                               *
*****************************************************************
```

```
*****************************************************************
*                                                               *
*                    D E F I N I T I O N S                      *
*                                                               *
*****************************************************************


        RSEG    SUBR

B0      EQU     X'01'
B1      EQU     X'02'
B2      EQU     X'04'
B3      EQU     X'08'
B4      EQU     X'10'
B5      EQU     X'20'
B6      EQU     X'40'
B7      EQU     X'80'

* I/O ports

KBDIN   EQU     X'01'       RD read and shift console data
KBDTR   EQU     X'02'       WR transfer data to input s/r's
DMAGO   EQU     X'03'       WR load DMA counter, reset iff
TIMACK  EQU     X'04'       WR clear timer iff
MASDAT  EQU     X'05'       RD read data from master
MASSTB  EQU     X'06'       WR interrupt master
MASACK  EQU     X'07'       WR clear irpt from master
SLVDAT  EQU     X'08'       WR send data to slave
SLVSTB  EQU     X'09'       WR interrupt slave
SLVACK  EQU     X'0A'       WR clear irpt from slave
OPTSW   EQU     X'0B'       RD read option switches
ADCIN   EQU     X'0C'       RD
ADCADR  EQU     X'0D'       WR

*  misc constants

TIMEOUTC EQU    120             60 minute timeout
HYVAL   EQU     8               shoe hysteresis value
LMPBIT  EQU     7               LAMP OUTPUT CHAIN #
LMPMSK  EQU     B7              LAMP BIT MASK

        GLBL    KTBX,NOCOUP,TROLD,TRNEW
        GLBL    ORCVAL,ORCSTF,CRORCO,GENCAN,ORCMEM
        GLBL    CARDO,HDPHFL,HDSTRT
        GLBL    NOTRM,TRMFLG,TRMADR,FTFULL,FTFFLG
        GLBL    NXTEXP,NOSHOE,EXPVAL,EXPDTB,CRORCH
        GLBL    KEYON,KEYOFF,CPTAB,LMPADR
        GLBL    PISTAB,TUTSW,MSETF
        GLBL    PTAB,SWTAB,STCRAM,MKEY
        GLBL    DEBTAB,NODEB,DEBTABE,MEMTB,MEMLMP
        GLBL    PFLAG,NOGENP,PBITS,NOPGRP
        GLBL    CRDADR,CRDTAB,ORCLMP
        GLBL    CRMEM2,TUTLMP,CRMEM1,COMTAB
        GLBL    KTAB,CPFROM,NODIV,XPLGT,CPSTRT
        GLBL    CPRAM,CPLEN,TRANSP,SWDISP,SWSTAT
        GLBL    CTLT,CTLIT,STPCHF,STPFLG,LKDIGS
```

```
        GLBL    LOCKS,MEMN,MUTEON,SETF,PSCNT
        GLBL    TILTLEN,CRMEM,SWSTATE,MUTED,CRSTRT
        GLBL    CRVAL,PWRADR,SETLKS,MINB,TIMER
        GLBL    PISTTX,MUTEOF,PWRLGT,PWRLMP

        GLBL    CPINIT,UNLOCK,STOPCH
        GLBL    PWRDO,PISTCH,KEYCH,DEBPST
        GLBL    STPCDD,DEBDO,TILTON,EXPCK,CRESC
        GLBL    EXPDSP,CKPIS,TILTOF,PWRTIM


;*****************************************************************
;                                                                 *
;               KEY  CHANGE  PROCESSING                           *
;                                                                 *
;*****************************************************************

        RSEG    MSUBR

; on entry:
;       HL points to coupler 'to' table
;       A = key #
;       bit 7 of E is 1 for make, 0 for break

KEYCH   PUSH    AF              save
        PUSH    BC                   the
        PUSH    DE                        registers
        LD      D,(HL)          bit mask for 'to' manual
        INC     HL              advance to nex
        LD      C,A             key #
        BIT     7,E
        JR      Z,KEYCH0
        TST     (MUTED)         check for power on mute
        JR      NZ,KEYCH9       muted - ignore change
        LD      A,TIMEOUTC
        LD      (TIMER),A
KEYCH0  PUSH    HL
        LD      HL,KTAB
        ADDHL   C
        LD      A,D
        BIT     7,E
        JR      NZ,KEYCH1
        CPL
        AND     (HL)
        JR      KEYCH2
KEYCH1  OR      (HL)
KEYCH2  LD      (HL),A
        POP     HL
        LD      B,(HL)          # OF COUPS
        INC     HL
KEYCH3  LD      A,(HL)
        INC     HL
        TST     A
        JR      NZ,KEYCH4
        INC     HL
        JR      KEYCH5
```

```
KEYCH4   CALL    NEW
KEYCH5   INC     HL              skip manual #
         DJNZ    KEYCH3          repeat for other couplers
KEYCH9   POP     DE              restore
         POP     BC              the
         POP     AF              registers and
         RET                                     return

* check for change on pseudo manual

* on entry
*        C = key #
*        HL -> TRANSP VAL OF COUPLER
*        HL INCREMENTED; BC,DE PRESERVED

NEW      LD      A,(TRANSP)
         ADD     A,(HL)
         INC     HL
         ADD     A,C             TRANSPOSED KEY #
NEW1     JP      P,NEW2
         ADD     A,12
         JR      NEW1
NEW2     PUSH    BC
         LD      C,A
         LD      B,(HL)          'FROM' MANUAL
         LD      A,B
         ADD     A,A
         PUSH    HL
         LD      HL,KTLKP
         ADDHL   A
         LD      A,C
         LD      C,(HL)
NEW3     CP      C
         JR      C,NEW4
         SUB     12
         JR      NEW3
NEW4     INC     HL
         LD      C,A
         ADD     A,(HL)
         LD      HL,KTBX
         ADDHL   A
         BIT     7,E
         JR      NZ,NEW8
         DEC     (HL)
         JR      Z,NEW5
         JP      P,NEW7
         INC     (HL)
         JR      NEW7
NEW5     PUSH    DE
         LD      A,C
         LD      C,B
         CALL    KEYOFF
NEW6     POP     DE
NEW7     POP     HL
         POP     BC
         RET
```

```
NEW8     LD      A,(HL)
         INC     (HL)
         TST     A
         JR      NZ,NEW7
         PUSH    DE
         LD      A,C
         LD      C,B
         CALL    KEYON
         JR      NEW6
KTLKP    DC      61,0
         DC      61,61
         DC      32,61+61

*****************************************************************
*                                                               *
*              COUPLER  CHANGE  PROCESSOR                       *
*                                                               *
*****************************************************************

         RSEG    MSUBR

* on entry
*        B = COUPLER # *4
*        C =-1 for on, 0 for off

CUPCH    LD      HL,CPTAB
         ADDHL   B               point to coupler entry
         LD      A,(HL)          -1 for 'OFF' coupler
         XOR     C               get actual state
         INC     HL
         LD      E,(HL)          pickup
         INC     HL               addr
         LD      D,(HL)            of 'to'
         INC     HL                 coupler
         LD      (DE),A              and set flag
         LD      B,(HL)          BIT MASK
         EX      DE,HL
         LD      E,A             ON/OFF
         INC     HL
         LD      D,B
CUPCH0   PUSH    HL
         LD      HL,KTAB
         LD      B,61
         LD      C,0
CUPCH1   LD      A,(HL)
         AND     D
         JR      Z,CUPCH2
         EX      (SP),HL
         CALL    NEW
         DEC     HL
         EX      (SP),HL
CUPCH2   INC     HL
         INC     C
         DJNZ    CUPCH1
         POP     HL
         RET
```

```
* initialize coupler tables

CPINIT  LD      HL,CPSTRT
        LD      DE,CPRAM
        LD      BC,CPLEN
        LDIR
        RET

*****************************************************************
*                                                               *
*                    T R A N S P O S E R                        *
*                                                               *
*****************************************************************

        RSEG    MSUBR

* transposer piston entry

TRANP   BIT     7,E                     make or break?
        RET     Z                       break - ignore

* entry from general cancel

XPOSE   LD      A,(TRANSP)              old value
        LD      (TROLD),A
        ADD     A,XPLGT                 old lamp #
        CALL    LMPOFF                  turn it off
        LD      A,C                     new value
        LD      (TRANSP),A              save it away
        LD      (TRNEW),A
        ADD     A,XPLGT                 new lamp #
        CALL    LMPON                   turn it on

        LD      B,NOCOUP
        LD      HL,CPTAB
XP1     INC     HL
        LD      E,(HL)
        INC     HL
        LD      D,(HL)
        INC     HL
        LD      C,(HL)
        INC     HL
        TST     (DE)
        JR      Z,XP2
        PUSH    HL
        PUSH    BC
        EX      DE,HL
        INC     HL
        LD      D,C
        LD      E,0
        LD      A,(TROLD)
        LD      (TRANSP),A
        CALL    CUPCHO
        LD      E,-1
        LD      A,(TRNEW)
        LD      (TRANSP),A
```

```
        CALL    CUPCHO
        POP     BC
        POP     HL
XP2     DJNZ    XP1
        RET

*****************************************************************
*                                                               *
*              LAMP  HANDLING  ROUTINES                         *
*                                                               *
*****************************************************************

        RSEG    MSUBR

* turn lamp A on

LMPON   PUSH    AF
        PUSH    HL
        LD      HL,LMPADR       lamp memory addr
        ADDHL   A               correct lamp #
        SET     LMPBIT,(HL)     set the bit
        POP     HL
        POP     AF
        RET


*

LMPOFF  PUSH    AF
        PUSH    HL
        LD      HL,LMPADR       start of lamp memory
        ADDHL   A               this lamp addr
        RES     LMPBIT,(HL)     turned off
        POP     HL
        POP     AF
        RET

*****************************************************************
*                                                               *
*            TILT  TAB  ACTION  ROUTINES                        *
*                                                               *
*****************************************************************

        RSEG    MSUBR

* on entry
*       B = tab# + 1
* NOTE  HL and AF destroyed

* tilt tab 'on' routine

TILTON  TST     (HDPHFL)
        JR      Z,TN1
        LD      A,B
        CP      HDSTRT+1
        JR      C,TN1
```

```
        CP      HDSTRT+1+4
        RET     C
TN1     PUSH    BC
        LD      C,-1            'on' flag
        LD      A,B
        ADD     A,SWDISP-1      get lamp #
        CALL    LMPON           turn it on
        LD      HL,SWSTAT-1     find the addr
        ADDHL   B                of the state
        LD      A,(HL)          pick it up
        SET     0,(HL)          set 'switch on' bit
        AND     X'F'            was it on before?
        CALL    Z,SWITDO        if not - do the action
        POP     BC
        RET

* tilt tab 'off' routine

TILTOF  TST     (HDPHFL)
        JR      Z,TF1
        LD      A,B
        CP      HDSTRT+1
        JR      C,TF1
        CP      HDSTRT+1+4
        RET     C
TF1     PUSH    BC
        LD      C,0             'off' flag
        LD      A,B             this is
        ADD     A,SWDISP-1        much
        CALL    LMPOFF              the
        LD      HL,SWSTAT-1             same
        ADDHL   B                         as above
        LD      A,(HL)          old state
        RES     0,(HL)          set 'switch on' off
        AND     X'F'            old state
        CP      B0              just the switch (not cresc or tut)?
        CALL    Z,SWITDO        yes - turn the action off
        POP     BC
        RET

*****************************************************************
*                                                               *
*        E X P R E S S I O N     S H O E S                      *
*                                                               *
*****************************************************************


        RSEG    MSUBR

EXPCK   TST     (MUTED)
        RET     NZ
        IN      A,(ADCIN)
        LD      B,A
        LD      A,(NXTEXP)
        OUT     (ADCADR),A
        NOP
```

```
        OUT     (ADCADR),A
        INC     A
        CP      NOSHOE
        JR      C,*+3
        CLA
        LD      (NXTEXP),A
        LD      C,A
        LD      HL,EXPVAL
        ADDHL   A
        LD      A,B
        CP      (HL)
        JR      C,EXPCK1
        SUB     HYVAL
        RET     C
        CP      (HL)
        RET     C
        RET     Z
EXPCK1  LD      (HL),A
        LD      A,C
        ADD     A,C
        ADD     A,C
        LD      HL,EXPDTB
        ADDHL   A
        JP      (HL)

EXPDSP  CP      (HL)
        INC     HL
        JR      NC,EXPD1
        INC     HL
        JR      EXPDSP
EXPD1   LD      A,(HL)
        LD      B,7
        EX      DE,HL
EXPD4   RRA
        JR      NC,EXPD2
        SET     LMPBIT,(HL)
        JR      EXPD3
EXPD2   RES     LMPBIT,(HL)
EXPD3   INC     HL
        DJNZ    EXPD4
        RET

*****************************************************************
*                                                               *
*                    C R E S C E N D O                          *
*                                                               *
*****************************************************************

        RSEG    MSUBR

* update the switch states according to new cresc position

CRESC   TST     (ORCSTF)
        RET     NZ
        LD      A,(CRVAL)       new position
        RRA
```

```
        RRA
        AND     63
        LD      B,TILTLEN       # of tabs
        LD      C,A             remember the position
        LD      HL,(CRMEM)      pickup the correct memory addr
        ADDHL   B
        EX      DE,HL
        LD      HL,SWSTATE      start at end
CRESC1  DEC     DE              and work
        DEC     HL                backwards
        LD      A,(DE)          position that this stop comes on
        CP       C                compared to current position
        JR      NC,CRESC2       greater so turn off
        LD      A,(HL)          old state
        SET     1,(HL)          set 'cresc on' bit
        AND     X'F'            was
        PUSH    BC                 it
        LD      C,-1                 off?
        CALL    Z,SWITDO           if so turn it on
        POP     BC
        JR      CRESC3
CRESC2  LD      A,(HL)          old state
        RES     1,(HL)          clear 'cresc on' bit
        AND     X'F'            was
        CP      B1                 it
        PUSH    BC                   only on
        LD      C,0                          because of cresc?
        CALL    Z,SWITDO        if so - turn it off
        POP     BC
CRESC3  DJNZ    CRESC1          repeat for all tilt tabs
        LD      A,(CRVAL)
        RRA
        RRA
        AND     63
        LD      DE,CRDADR
        LD      HL,CRDTAB       cresc display values table
        JP      EXPDSP

*****************************************************************
*                                                               *
*                        T U T T I                              *
*                                                               *
*****************************************************************

        RSEG    MSUBR

* tutti 'on' routine

TUTON   LD      HL,(MEMTB)     pickup current combination memory
        ADDHL   TILTLEN         point to end
        EX      DE,HL                     with DE
        LD      B,TILTLEN       # of tabs
        LD      HL,SWSTATE      end of switch state table
        LD      C,-1            'on' flag
TUTON1  DEC     DE              going
        DEC     HL                   backwards
```

```
        LD      A,(DE)          the comb mem word
        RRA                     check bit 0
        JR      NC,TUTON2       not set - ignore this tab
        LD      A,(HL)          old switch state
        SET     2,(HL)          set 'tutti on' bit
        AND     X'F'            was it off?
        CALL    Z,SWITDO        if so - change state
TUTON2  DJNZ    TUTON1          repeat for all tabs
        RET

* tutti 'off' routine

TUTOFF  LD      HL,TUTLMP       turn off the lamp
        RES     LMPBIT,(HL)      in case not called from TUTTI
        LD      C,A             'off' flag for SWITDO
        LD      HL,SWSTATE      start at end of state table
        LD      B,TILTLEN       # of tabs
TUTOF1  DEC     HL              go backwards
        LD      A,(HL)          old state
        RES     2,(HL)          reset 'tutti on' bit
        AND     X'F'            if it was
        CP      B2               only on by tutti
        CALL    Z,SWITDO          then turn it off
        DJNZ    TUTOF1          repeat for all tabs
        RET

* display tutti combination on tabs, (hold TUTTI, press SET)

TUTDSP  CALL    GENCAN          turn 'em all off to start with
        LD      B,TILTLEN       # of tabs
        LD      HL,(MEMTB)     current combination memory
        ADDHL   TILTLEN         start at end
TUTDS1  DEC     HL              go backwards
        PUSH    HL
        BIT     0,(HL)          tutti bit set?
        CALL    NZ,TILTON       if so, pretend someone pressed the tab
        POP     HL
        DJNZ    TUTDS1          repeat for all tabs
        RET

* set tutti combination (hold SET, press TUTTI)

TUTSET  LD      HL,(MEMTB)      current combination memory
        LD      B,TILTLEN       # of tabs
        ADDHL   B
        LD      DE,SWSTATE      current state
TUTST1  DEC     DE              going
        DEC     HL                   backwards
        LD      A,(DE)          current state
        BIT     0,A                       of tab
        JR      NZ,TUTST2       on - skip
        RES     0,(HL)          clear the tutti comb bit
        JR      TUTST3
TUTST2  SET     0,(HL)          set the tutti comb bit
TUTST3  DJNZ    TUTST1          repeat for all tabs
        RET
```

```
*****************************************************************
*                                                               *
*                    DEBOUNCE  TOE  STUDS                       *
*                                                               *
*****************************************************************

        RSEG    MSUBR

* stud contact has changed

DEBPST  PUSH    BC
        LD      C,A             stud #
        LD      HL,DEBTAB       debounce flag table
        ADDHL   A               get right one
        TST     (HL)            if zero
        JR      Z,DEBPS2        then start timing
        BIT     7,E             already timimg
        JR      Z,DEBPS1         so just
        SET     7,(HL)            mark new
        JR      DEBPS3             state
DEBPS1  RES     7,(HL)              in bit 7
        JR      DEBPS3
DEBPS2  LD      A,C             stud #
        CALL    DEBPCH          change state and start timing
DEBPS3  POP     BC
        RET

* change state of stud and start timing

DEBPCH  BIT     7,E
        JR      Z,DEBPC1
        LD      (HL),X'FE'      IF ON, SET THESE
        JR      DEBPC2
DEBPC1  LD      (HL),X'02'      ONLY THIS ONE IF OFF
DEBPC2  CALL    PISTCH          do the appropriate thing
        RET

* debounce timing - every 1/4 second

DEBDO   LD      B,NODEB         # of studs to be debounced
        LD      HL,DEBTABE      start at end of table
DEBLP   DEC     HL              go backwards
        SRA     (HL)            shift once
        JR      NC,DEBLP2       bit 5 not shifted out yet
        LD      A,(HL)          pickup the state
        AND     B7+B0           look at original and current state
        JP      PE,DEBLP1       same - stop timing
        LD      E,A             otherwise
        LD      A,B                we have
        DEC     A                     to change the
        CALL    DEBPCH                     state of the stud
        JR      DEBLP2
DEBLP1  LD      (HL),0          clear the timing word
DEBLP2  DJNZ    DEBLP           repeat for all debounced studs
        RET
```

```
*****************************************************************
*                                                               *
*                        P I S T O N S                          *
*                                                               *
*****************************************************************

        RSEG    MSUBR

* piston change routine
* on entry
*       A = piston #
*       E = make/break

PISTCH  PUSH    HL
        PUSH    BC
        PUSH    DE
        LD      HL,PISTAB       piston function table
        ADD     A,A             piston # x2
        ADDHL   A               point to correct piston
        LD      A,(HL)          pickup type
        INC     HL
        LD      C,(HL)                 and data
        LD      B,E             save make/break flag
        LD      HL,(PISTTX)     pickup piston action table
        ADDHL   A               point to correct action
        LD      E,(HL)          pickup
        INC     HL               addr of action
        LD      D,(HL)            routine
        EX      DE,HL              in HL
        LD      DE,PISTC1       return address
        PUSH    DE                 on stack
        LD      E,B             that's the make/break flag
        LD      A,TIMEOUTC
        LD      (TIMER),A
        JP      (HL)            do the action routine
PISTC1  POP     DE
        POP     BC
        POP     HL
ARET    RET                     dummy piston action routine

* piston action lookup table - normal (unlocked) mode

PISTTT  DC      B(ARET)         0 - dummy
        DC      B(REVERS)       2 - reverser
        DC      B(TUTTI)        4 - tutti
        DC      B(SETPIS)       6 - set piston
        DC      B(MEMDO)        8 - memory piston
        DC      B(PWRSW)       10 - power on/off piston
        DC      B(GENCP)       12 - general cancel
        DC      B(DIVPIS)      14 - divisional/general piston
        DC      B(HDPHDO)      16 - HEADPHONE
        DC      B(TRANP)       18 - transposer
        DC      B(CRORCH)      20 - orchestral crescendo
        DC      B(SETLKP)      22 - set locks pushbutton
        DC      B(ARET)        24 - SPARE
        DC      B(REVER2)      26 - reverse + cancel 2nd
```

```
* HEADPHONE JACK

HDPHDO  BIT     7,E
        JR      NZ,HDPHON
        CLA
        LD      (HDPHFL),A
        RET
HDPHON  CLA                     CLEAR FLAG FOR POWER ON
        LD      (HDPHFL),A
        LD      B,HDSTRT        # OF FIRST MAINOFF TAB
        LD      C,2
HDPH1   INC     B
        CALL    TILTON
        INC     B
        CALL    TILTOF
        DEC     C
        JR      NZ,HDPH1
HDPH4   LD      A,-1
        LD      (HDPHFL),A
        RET


* reverser

REVER2  LD      D,-1
        JR      *+4

REVERS  LD      D,0

REVER1  BIT     7,E             ignore
        RET     Z                     breaks
        LD      A,C             tab # to change
        LD      B,A             add one
        INC     B                      for TILTON/OF
        LD      HL,SWSTAT       pick up
        ADDHL   A                 old
        BIT     0,(HL)             state
        JP      Z,TILTON        off? - then turn on
        CALL    TILTOF          turn off
        TST     D               more than one?
        RET     Z               no.
        INC     B               next un
        JP      TILTOF          turn off 4'

* tutti piston

TUTTI   LD      A,E             store away
        AND     B7                     whether
        LD      (TUTSW),A                   make or break
        RET     Z               otherwise ignore breaks
        TST     (SETF)          are we going
        JP      NZ,TUTSET               to set it?
        LD      HL,TUTLMP
        LD      A,(HL)
        XOR     LMPMSK
        LD      (HL),A
        AND     LMPMSK
```

```
        JP      NZ,TUTON
        JP      TUTOFF

* set piston

SETPIS  LD      A,E
        AND     B7
        LD      (SETF),A        make or break
        RET     Z               ignore breaks
        LD      A,(MSETF)       this memory unlocked?
        LD      (SETF),A        if so set flag
        TST     (TUTSW)         tutti held?
        JP      NZ,TUTDSP
        TST     (ORCSTF)
        RET     Z
* SET ORC CRESC MEM
        LD      A,(ORCVAL)
        LD      C,A
        LD      DE,CRMEM2
        LD      HL,SWSTAT
        LD      B,TILTLEN
ORCST1  BIT     0,(HL)
        JR      NZ,ORCST2       ON
        LD      A,(DE)          OFF
        CP      C
        JR      NC,ORCST4       OK, WON'T COME ON YET
        LD      A,C             SET TO COME ON NEXT TIME
        JR      ORCST3
ORCST2  LD      A,(DE)
        CP      C
        JR      C,ORCST4        OK, WAS ON ANYWAY
        LD      A,C
        DEC     A
ORCST3  LD      (DE),A
ORCST4  INC     HL
        INC     DE
        DJNZ    ORCST1
        LD      A,(ORCVAL)
        LD      DE,CRDADR
        LD      HL,CRDTAB
        CALL    EXPDSP
        LD      A,(ORCVAL)
        INC     A
        LD      (ORCVAL),A
        CP      64
        RET     NZ
        LD      HL,CRMEM2
        LD      DE,ORCMEM
        LD      B,TILTLEN
ORCST5  LD      A,(HL)
        LD      (DE),A
        INC     DE
        RRA
        RRA
        RRA
        RRA
        LD      (DE),A
```

```
        INC     DE
        INC     HL
        DJNZ    ORCST5
        CLA
        LD      (ORCSTF),A
        LD      HL,ORCLMP
        RES     LMPBIT,(HL)
        JP      CRORCO

* a memory piston

MEMDO   BIT     7,E             ignore
        RET     Z                   breaks
        LD      A,C             new memory mask
MEMDO1  LD      (MEMN),A         piston
        AND     B1
        LD      HL,MEMTB        find
        ADDHL   A                address
        LD      E,(HL)            of
        INC     HL                 this
        LD      D,(HL)              combination
        LD      (COMTAB),DE          memory
* is this memory unlocked?
        LD      A,(MEMN)        mem #
        LD      B,A             save it
        LD      A,(MKEY)        the key word
        AND     B               just this bit
        LD      (MSETF),A       store in lock
        CLA
        LD      (SETF),A        clear SETF in case
MEMDSP  LD      A,(MEMN)
        LD      HL,MEMLMP-1
        CALL    MEMDSP1
MEMDSP1 INC     HL
        RES     LMPBIT,(HL)
        RRA
        RET     NC
        SET     LMPBIT,(HL)
        RET

* general cancel piston

GENCP   BIT     7,E             ignore
        RET     Z                  breaks

* do a general cancel

GENCAN  LD      B,TILTLEN       # of tabs
GENC1   CALL    TILTOF          turn them
        DJNZ    GENC1                   all off
        LD      C,0             reset
        TST     (TRANSP)
        CALL    NZ,XPOSE            transposer
        CALL    TUTOFF               and tutti

* turn off all the combination piston lights
```

```
CANLGT  PUSH    BC
        PUSH    HL
        LD      HL,PFLAG+2      current lamp #
        LD      B,NOPGRP        # of divisions + 1
CANL1   LD      A,(HL)          Lamp #
        TST     A               is there one?
        CALL    NZ,LMPOFF       if so - turn it off
        INC     HL              skip
        INC     HL               to
        INC     HL                next
        DJNZ    CANL1              division
        POP     HL
        POP     BC
        RET

* general and divisional pistons

DIVPIS  LD      A,C             group:piston
        RRA
        RRA
        RRA
        RRA
        AND     X'F'
        LD      B,A             group #
        LD      A,C
        AND     X'F'
        LD      C,A             piston #
        LD      A,B
        ADD     A,A
        ADD     A,B             group # x3
        LD      B,A
        LD      HL,PFLAG
        ADDHL   A               HL points to correct PFLAG
        BIT     7,E             make or break
        JR      NZ,DIVP1        make.
* break, mark piston as released
        LD      A,(HL)          last pressed piston #
        CP      C               same?
        RET     NZ              no - ignore
        INC     HL              yes -
        LD      (HL),0                clear flag
        RET
* make
DIVP1   TST     B               general?
        CALL    Z,CANLGT        if so - all piston lamps off
        LD      (HL),C          current piston #
        INC     HL
        LD      (HL),-1         its held down
        INC     HL              turn
        LD      A,(HL)            off the
        TST     A                   old
        CALL    NZ,LMPOFF             lamp
        EX      DE,HL
        LD      HL,PTAB+2       point to PTAB
        ADDHL   B                           lamp entry
        LD      A,(HL)          starting lamp #
        TST     A               any?
```

```
        JR      Z,DIVP2         no - must have been pedal
        ADD     A,C             + piston #
        LD      (DE),A          save for when we extinguish it
        CALL    LMPON           turn it on
DIVP2   DEC     HL
        LD      D,(HL)          # of tabs
        DEC     HL
        LD      E,(HL)          starting tab #
        TST     B               general?
        LD      A,C             if not general
        JR      Z,DIVP3         add # of generals
        ADD     A,NOGENP        to get bit position
DIVP3   ADD     A,A             look up
        LD      HL,PBITS        word offset
        ADDHL   A                  and bit mask
        LD      B,(HL)          offset
        INC     HL
        LD      C,(HL)          bit mask
        LD      HL,(COMTAB)     current memory
DIVP4   DEC     B               add
        JP      M,DIVP5          in
        ADDHL   TILTLEN           the
        JR      DIVP4              offset
DIVP5   ADDHL   E               add starting tab #
        TST     (SETF)          setting?
        JP      NZ,PSET         yep - do that
        JP      PISTAC          no - do the other

* capture a combination on a piston

PSET    LD      B,D             # of tabs within group
        LD      A,E             starting tab #
        LD      DE,SWSTAT       find starting
        ADDDE   A               tab's status
PSET1   LD      A,(DE)          status
        RRA                     check
        LD      A,C                bit 0
        JR      C,PSET2         set
        CPL                     clear the
        AND     (HL)               bit in CMOS
        JR      PSET3
PSET2   OR      (HL)            set the bit
PSET3   LD      (HL),A          store it back in CMOS
        INC     HL
        INC     DE
        DJNZ    PSET1           repeat for all in group
        RET

* change the stop tabs according to piston memory
*       D = # of tabs
*       E = starting tab #
*       C = bit mask
*       HL = starting memory addr in CMOS

PISTAC  LD      B,E             tab #
        INC     B                      +1 for TILT routines
PISTA1  LD      A,(HL)          mem word
```

```
        PUSH    HL              TILT clobbers  HL
        AND     C               the bit in question
        JR      NZ,PISTA2       on.
        CALL    TILTOF          off
        JR      PISTA3
PISTA2  CALL    TILTON          on
PISTA3  POP     HL
        INC     HL              go
        INC     B                on to
        DEC     D                 next
        JR      NZ,PISTA1          one
        RET

* check for pistons held in while changing tabs

CKPIS   TST     (MSETF)         unlocked?
        RET     Z               no - ignore
        PUSH    BC
        LD      HL,PFLAG+1      held flags
        LD      B,NOPGRP        # of groups
CKP1    TST     (HL)            held?
        JR      NZ,CKP2         yes - do the set
        INC     HL              check
        INC     HL               the
        INC     HL                 next
        DJNZ    CKP1                  one
        POP     BC              none held
        RET                     return
CKP2    LD      A,NOPGRP        calculate
        SUB     B               the group #
        POP     BC
        PUSH    DE
        PUSH    BC
        LD      C,A             group #
        DEC     HL
        LD      D,(HL)          piston #
        LD      A,C
        LD      HL,PTAB
        ADD     A,A
        ADD     A,C
        ADDHL   A
        DEC     B               swit #
        LD      A,B
        SUB     (HL)            starting tab #
        JR      C,CKP9          not in range of piston
        INC     HL
        CP      (HL)            # of tabs
        JR      NC,CKP9         out of range
        TST     C               general?
        LD      A,D             group #
        JR      Z,CKP3          if divisional
        ADD     A,NOGENP            add displacement
CKP3    ADD     A,A             look up
        LD      HL,PBITS          offset
        ADDHL   A                   and bit mask
        LD      D,(HL)          offset
        INC     HL
```

```
        LD      E,(HL)          bit mask
        LD      HL,(COMTAB)
CKP4A   DEC     D               calculate
        JP      M,CKP4B            starting addr
        ADDHL   TILTLEN                in CMOS
        JR      CKP4A
CKP4B   ADDHL   B               starting addr of first tab
        POP     BC
        TST     C               on or off?
        LD      A,E
        JR      NZ,CKP5
        CPL
        AND     (HL)            mark off
        JR      CKP6
CKP5    OR      (HL)            mark on
CKP6    LD      (HL),A
        POP     DE
        RET
CKP9    POP     BC              return for no changes
        POP     DE
        RET


*****************************************************************
*                                                               *
*                  TILT  TAB  ACTIONS                           *
*                                                               *
*****************************************************************


        RSEG    MSUBR

* on entry
*       C = on/off
*       B = tab # + 1

SWITDO  PUSH    HL
        PUSH    DE
        PUSH    BC
        DEC     B               tab #
        LD      A,B
        ADD     A,A                x2
        LD      HL,SWTAB
        ADDHL   A               lookup switch function
        LD      A,(HL)          type #
        INC     HL
        LD      B,(HL)          data
        LD      HL,SWITT        lookup
        ADDHL   A                  function routine
        LD      E,(HL)          function
        INC     HL               routine
        LD      D,(HL)            addr
        EX      DE,HL              in HL
        LD      DE,SWITE        fake
        PUSH    DE               a
        JP      (HL)              CALL
```

```
SWITE   POP     BC
        POP     DE
        POP     HL
SDUMMY  RET                     dummy function routine

* function routine addresses

SWITT   DC      B(SDUMMY)       0 - dummy
        DC      B(CUPCH)        2 - coupler
        DC      B(CONTRL)       4 - control (trems)
        DC      B(CNTRLI)       6 - inverted control (mutes)
        DC      B(STOPCH)       8 - stop
        DC      B(FTFDO)        10 - FLUTE TREM FULL
        DC      B(TRMDO)        12 - TREMS
        DC      B(CARDO)        14 - CARILLON

* control and inverted control

CNTRLI  LD      HL,CTLIT        table addr
        LD      A,C             invert
        LD      C,0              the
        TST     A                 on/off
        JR      NZ,CTL1            word
        LD      C,-1                 in
        JR      CTL1                  C

CONTRL  LD      HL,CTLT         table addr
CTL1    LD      A,B             # in table
        ADDHL   A               this entry
        LD      E,(HL)          lo addr
        INC     HL
        LD      D,(HL)          hi addr
        EX      DE,HL
        TST     C               on or off?
        JR      NZ,CTL2
        RES     LMPBIT,(HL)
        RET
CTL2    SET     LMPBIT,(HL)     mark on
        RET

FTFDO   LD      A,C
        AND     B7
        LD      (FTFFLG),A
        JR      Z,FTFDO2
        LD      HL,FTFULL
        SET     LMPBIT,(HL)
        LD      HL,TRMADR
        LD      B,NOTRM
FTFDO1  INC     HL
        INC     HL
        LD      E,(HL)
        INC     HL
        LD      D,(HL)
        INC     HL
        EX      DE,HL
        RES     LMPBIT,(HL)
```

```
        EX      DE,HL
        DJNZ    FTFD01
        RET
FTFD02  LD      HL,FTFULL
        RES     LMPBIT,(HL)
        LD      IX,TRMFLG
        LD      HL,TRMADR
        LD      B,NOTRM
FTFD03  INC     HL
        INC     HL
        LD      E,(HL)
        INC     HL
        LD      D,(HL)
        INC     HL
        TST     (IX+0)
        JR      Z,FTFD04
        EX      DE,HL
        SET     LMPBIT,(HL)
        EX      DE,HL
FTFD04  INC     IX
        DJNZ    FTFD03
        RET

TRMD0   LD      A,C
        AND     B7
        LD      C,A
        LD      HL,TRMFLG
        ADDHL   B
        LD      (HL),C
        LD      HL,TRMADR
        LD      A,B
        ADD     A,A
        ADD     A,A
        ADDHL   A
        LD      B,2
        TST     C
        JR      NZ,TRMD02
TRMD01  LD      E,(HL)
        INC     HL
        LD      D,(HL)
        INC     HL
        EX      DE,HL
        RES     LMPBIT,(HL)
        EX      DE,HL
        DJNZ    TRMD01
        RET
TRMD02  LD      E,(HL)
        INC     HL
        LD      D,(HL)
        INC     HL
        EX      DE,HL
        SET     LMPBIT,(HL)
        EX      DE,HL
        TST     (FTFFLG)
        RET     NZ
        DJNZ    TRMD02
        RET
```

```
*****************************************************************
*                                                               *
*                    S T O P   C H A N G E                      *
*                                                               *
*****************************************************************

* mark new state in state table

        RSEG    MSUBR

STOPCH  LD      A,-1
        LD      (STPCHF),A      one or more has changed
        LD      HL,STPFLG       state addr
        ADDHL   B                     for this on
        TST     C               on or off?
        JR      NZ,STPCH1
        RES     1,(HL)          off
        RET
STPCH1  SET     1,(HL)          on
        RET

* do stop change for all that have changed on this manual
* on entry
*       IX = xxSTPC

        RSEG    SUBR

STPCD0  LD      HL,STCRAM       scratchpad area
        LD      B,(IX-3)        # of stops
        LD      E,(IX-2)        stop state
        LD      D,(IX-1)                table addr
        LD      C,0             # that have changed
STPCD1  LD      A,(DE)          flag
        AND     3               interesting bits only
        JP      PE,STPCD4       old=new - ignore
        XOR     B0              make old different (=new)
        LD      (DE),A          store it
        LD      (HL),X'CD'      CALL instr in scratch
        INC     HL
        JR      NZ,STPCD2       it changed to ON
        EXX
        LD      L,(IX+8)
        LD      H,(IX+9)
        DEC     (HL)
        LD      L,(IX+4)
        LD      H,(IX+5)
        EXX
        LD      A,(IX+0)        OFF
        LD      (HL),A           routine
        LD      A,(IX+1)          addr
        JR      STPCD3
STPCD2  EQU     *
        EXX
        LD      L,(IX+8)
        LD      H,(IX+9)
        INC     (HL)
        LD      L,(IX+6)
```

```
        LD      H,(IX+7)
        EXX
        LD      A,(IX+2)        ON
        LD      (HL),A           routine
        LD      A,(IX+3)          addr
STPCD3  INC     HL
        LD      (HL),A          store
        INC     HL                  it
        INC     C               count the changes
        PUSH    IX
        EXX
        LD      DE,STPCD7
        PUSH    DE
        JP      (HL)
STPCD7  EXX
        POP     IX
STPCD4  EXX
        LD      DE,10
        ADD     IX,DE
        EXX
        INC     DE
        DJNZ    STPCD1          repeat
        TST     C               any changed?
        RET     Z               no - return
        LD      (HL),X'C9'      insert RET
        LD      DE,0            key #
        LD      L,(IX+0)
        LD      H,(IX+1)
        LD      B,(IX+2)
STPCD5  TST     (HL)            key state
        JR      Z,STPCD6        not down
        PUSH    BC              save
        PUSH    HL               regs
        CALL    STCRAM             and
        POP     HL                  update
        POP     BC                    keyers
STPCD6  INC     E               next key #
        INC     HL              next key state
        DJNZ    STPCD5          repeat
        RET


*****************************************************************
*                                                               *
*                          L O C K                              *
*                                                               *
*****************************************************************

        RSEG    MSUBR

* piston functions while locked

PISTTL  DC      B(ARET)         dummy
        DC      B(ARET)         reversers
        DC      B(ARET)         tutti
        DC      B(LKSET)        set piston
```

```
        DC      B(LKMEM)        memory select piston
        DC      B(PWRSW)        power piston
        DC      B(LKGENC)       gen cancel
        DC      B(LKDIVP)       general/divisional
        DC      B(HDPHDO)       HDPHONE
        DC      B(ARET)         transposer
        DC      B(ARET)         orch cresc
        DC      B(SETLKP)       set locks pushbutton
        DC      B(ARET)         tuning
        DC      B(ARET)         reverse 2

* memory change piston

LKMEM   BIT     7,E             ignore
        RET     Z                    breaks
        TST     (SETLKS)        setting locks?
        RET     Z               no - ignore
        LD      A,(MEMN)
        XOR     C               reverse lock setting
        LD      (MEMN),A        store it
        JP      MEMDSP

* general/divisional piston

LKDIVP  BIT     7,E             ignore
        RET     Z                  breaks
        INC     C               don't use zero
        LD      HL,LKDIGS       temporary storage
        LD      A,(HL)          # of digits so far
        CP      8               8 already
        RET     NC                   ignore
        INC     (HL)            up one
        ADDHL   (HL)            find place for this digit
        LD      (HL),C               and put it in
        TST     (SETLKS)        are we setting the combination
        RET     NZ              yes - return
* check the combination so far against all locks
        LD      C,5             2 to the # of mems + 1
        LD      HL,LOCKS
LKDIV1  LD      B,8             max # of digits
        LD      DE,LKDIGS+1     reset DE
LKDIV1A LD      A,(DE)          check
        XOR     (HL)              the same
        AND     X'F'                (only 4 bits)
        JR      NZ,LKDIV2       not
        INC     HL              advance to
        INC     DE                 next
        DJNZ    LKDIV1A              digit
        LD      A,5             calculate
        SUB     C                   key #
        AND     B0+B1           mask out rubbish
        LD      (MKEY),A
        JP      UNLOCK          and unlock
LKDIV2  INC     HL              go
        INC     DE               on
        DJNZ    LKDIV2            to
        DEC     C                  next
```

```
        JR      NZ,LKDIV1           lock
        RET

* clear the temporary combination area

LKCLR   LD      HL,LKDIGS
        LD      B,9
        LD      (HL),0
        INC     HL
        DJNZ    *-3
        RET

* general cancel

LKGENC  TST     (SETLKS)        setting?
        JR      Z,LKCLR         no - just reset the combination
        LD      (MKEY),A        allow all memories
        JP      UNLOCK          and unlock

* set piston

LKSET   TST     (SETLKS)        setting?
        RET     Z               no - ignore
        LD      HL,LKDIGS       temp area
        TST     (HL)            any digits?
        RET     Z                       no - ignore
        INC     HL              advance to digits themselves
        LD      DE,LOCKS        CMOS
        LD      A,(MEMN)        calculate
        ADD     A,A                lock
        ADD     A,A                   address
        ADD     A,A
        ADDDE   A
        LD      BC,8            max digits
        LDIR                    copy it in
        JR      LKCLR           clear temp area

* power on

PWRDO   CLA                     clear
        LD      (MINS),A        minute timer
        LD      (SETLKS),A      'set locks' flag
        LD      (MEMN),A
        CALL    MEMDSP
        LD      A,-1            set
        LD      (MUTED),A          muted
        CALL    GENCAN          general cancel
        LD      HL,PISTTL       set pistons to
        LD      (PISTTX),HL                locked mode
        LD      A,PWRLGT        turn off the
        CALL    LMPOFF                ready lamp
        CALL    MUTEON
        LD      DE,LOCKS+4*8
        LD      HL,MASKEY
        LD      BC,8
        LDIR
```

```
        JP      LKCLR           clear the lock

* 'set locks pushbutton'

SETLKP  CALL    PWRDO           power on
        LD      A,-1              set
        LD      (SETLKS),A          flag
        RET

* 'apply power' to organ

UNLOCK  CLA                     clear
        LD      (SETLKS),A      'set locks' flag
        LD      (MUTED),A       mutes
        LD      A,B0
        CALL    MEMDO1          set memory 1 active
        LD      HL,PISTTT       set pistons in
        LD      (PISTTX),HL        unlocked mode
        TST     (HDPHFL)
        CALL    NZ,HDPHON
        CALL    MUTEOF          turn off mutes
        LD      A,TIMEOUTC
        LD      (TIMER),A
        LD      A,1
        LD      (PSCNT),A
        RET

* power piston

PWRSW   BIT     7,E
        RET     NZ
        LD      A,(PSCNT)
        INC     A
        LD      (PSCNT),A
        CP      2
        RET     C

* turn off the power

PWROFF  CALL    PWRDO
        JR      *

MASKEY  DC      1,2,1,3,1,4,1,5

*****************************************************************
*                                                               *
*              P O W E R     T I M E O U T                    *
*                                                               *
*****************************************************************

        RSEG    MSUBR

* called every 1/4 second

PWRTIM  LD      HL,PWRADR       clock
        LD      A,LMPMSK          the
```

```
        XOR     (HL)            power
        LD      (HL),A           monostable
        TST     (SETLKS)      setting locks?
        JR      NZ,PWRT2      yes- dont timeout, just flash
        TST     (ORCSTF)
        JR      Z,PWRTO
        LD      HL,ORCLMP
        LD      A,(HL)
        XOR     LMPMSK
        LD      (HL),A
PWRTO   LD      HL,MINS          minute timer
        DEC     (HL)          reduce it
        JR      NZ,PWRT1       not zero
        INC     HL
        LD      A,(HL)
        DEC     A
        AND     3
        LD      (HL),A
        JR      NZ,PWRT1
        TST     (MUTED)       muted?
        JR      NZ,PWROFF     halt if so
        LD      HL,TIMER      30 minute timer
        DEC     (HL)            decrement it
        RET     P
        JR      PWROFF
PWRT1   TST     (MUTED)       muted?
        JR      NZ,PWRT2            flash
        TST     (TIMER)       last minute
        JR      NZ,PWRT3      if not - dont flash
PWRT2   LD      HL,PWRLMP           power lamp
        LD      A,LMPMSK      change
        XOR     (HL)             it's
        LD      (HL),A              state
        RET
PWRT3   LD      HL,PWRLMP
        SET     LMPBIT,(HL)
        RET


        RSEG    SUBR
        GLBL    ZEPROM
ZEPROM  EQU     *                       mark end of prom


        END
```

```
PRINT  ALL          V00.00-003

*****************************************************************
*                                                               *
*   XX    XX    X     XXXX     XXXX      XXXX     X  X     XXX  *
*   X X X X     X    X        X    X    X         X X     X   X *
*   X  X  X     X    X        XXXXXX    XXXX     XX      X   X *
*   X     X     X    X        X    X         X   X X     X   X *
*   X     X     X     XXXX    X    X     XXXX     X  X     XXX  *
*                                                               *
*****************************************************************
*                                                               *
*       XXXXXX            XXX            XXXXXX                 *
*     XX       XX       XX XX          XX       XX             *
*     XX       XX      XX  XX         XX         XX            *
*       XXXXXX            XX         XX         XX  XXXXXXXX    *
*     XX       XX          XX         XX         XX     XX      *
*    XX         XX         XX         XX         XX     XX      *
*     XX        XX         XX          XX       XX      XX      *
*      XXXXXXXXX      XXXXXXXXXX        XXXXXX         XX      *
*                                                               *
*****************************************************************

OPBRD   DEFG   'NEW'          OLD/NEW OUTPUT BOARD

*****************************************************************
*                                                               *
*              D E F I N I T I O N S                            *
*                                                               *
*****************************************************************

ZZZ     EQU     0              ====== DUMMY = BEWARE ! ======
YY      EQU     -1             ====== DUMMY = BEWARE ! ======

B0      EQU     X'01'
B1      EQU     X'02'
B2      EQU     X'04'
B3      EQU     X'08'
B4      EQU     X'10'
B5      EQU     X'20'
B6      EQU     X'40'
B7      EQU     X'80'
```

```
LMPBIT  EQU     7

*  lamps

        GLBL    NOCOUP,KTAB,KTBX
        GLBL    HDSTRT,TUTLMP,MEMLMP,ORCLMP,PWRLGT,XPLGT

        RSEG    DMARAM
DMASTRT EQU     *

LMPADR  DS      8+72+32
SWFLNK  DS      8               SW FLUTE NOISE
SWPRNK  DS      8               SW PRIN
GTFLNK  DS      8               GT FLUTE
GTPRNK  DS      8               GT PRIN NK
  IF '&OPBRD'='OLD'
PWRADR  DS      1
OUTPON  DS      1
HCSUS   DS      1
        DS      1
PDDIMK  DS      1               PD DIAP MUTE
PDRDMK  DS      1               PD RD MUTE
PSFLMK  DS      1
PSPRMK  DS      1
EX1ADR  DS      8
SWRDMK  DS      1
SWMTR   DS      1               SW MAIN TREM
        DS      1
SWFTR   DS      1               SW FLUTE TREM
SWFLMK  DS      1
SWPRMK  DS      1
SWMNOF  DS      1
SWANON  DS      1
EX2ADR  DS      8
PDMNOF  DS      1
GTMTR   DS      1
HMK     DS      1
GTFTR   DS      1
GTFLMK  DS      1
GTPRMK  DS      1
GTMNOF  DS      1
GTANON  DS      1
TDEFMK  DS      1
PSMTR   DS      1
MNCHOR  DS      1               MAIN CHORUS
PSFTR   DS      1
FTFULL  DS      1
PSEXWS  DS      1
PSMNOF  DS      1
PSANON  DS      1
 ENDIF
  IF  '&OPBRD'='NEW'
SWFLMK  DS      1
SWPRMK  DS      1
SWRDMK  DS      1
        DS      1
```

```
SWMTR    DS     1
SWANON   DS     1
SWFTR    DS     1
SWMNOF   DS     1
GTFLMK   DS     1
GTPRMK   DS     1
PDMNOF   DS     1
HMK      DS     1
GTMTR    DS     1
GTANON   DS     1
GTFTR    DS     1
GTMNOF   DS     1
OUTPON   DS     1
PWRADR   DS     1
FTFULL   DS     1
MNCHOR   DS     1
HCSUS    DS     1
PDDIMK   DS     1
PDRDMK   DS     1
         DS     1
EX1ADR   DS     8
EX2ADR   DS     8
  ENDIF

CRDADR   EQU    LMPADR
SWDISP   EQU    8                          ZZZ

TUTLGT   EQU    7              tutti
MEMLGT   EQU    96             mem 1
ORCLGT   EQU    93             orch cresc
PWRLGT   EQU    94             power piston
XPLGT    EQU    107            xposer 0

*  addresses of control bits

         GLBL   PWRADR,LMPADR
         GLBL   PWRLMP

PWRLMP   EQU    LMPADR+PWRLGT  power lamp addr
MEMLMP   EQU    LMPADR+MEMLGT
ORCLMP   EQU    LMPADR+ORCLGT
TUTLMP   EQU    LMPADR+TUTLGT

*  misc constants

         GLBL   QSECK,SWDISP,KBDLEN,DMAEND4
         GLBL   RAMSTRT,RAMSIZE

QSECK    EQU    25             # of timer irpts per 1/4 sec
KBDLEN   EQU    96             length of longest chain
DMAEND4  EQU    408/4          DMA length/4
RAMSTRT  EQU    X'4000'
RAMSIZE  EQU    6*1024

         GLBL   KBDOLDE
```

```
        RSEG    RAM4
KTAB    DS      61
KTBX    DS      61+61+32
KBDOLD  DS      KBDLEN          contact image
KBDOLDE EQU     *

*****************************************************************
*                                                               *
*                    C O U P L E R S                            *
*                                                               *
*****************************************************************


        GLBL    CPSTRT,CPTOSW,CPTOGT
        GLBL    CPTOPD,CPTAB,CPLEN

        RSEG    CPROM
CPSTRT  EQU     *

*   this part copied into RAM

*       swell

        DC      B0              bit mask 'to swell'
        DC      3               # of coups to sw
        DC      0,12,0          sw - sw 4'
        DC      -1,0,0          sw - sw 8' off
        DC      0,-12,0         sw - sw 16'

        RSEG    CPRAM           Ram image of above

CPTOSW  DS      2
CPTF0   DS      3
CPTF1   DS      3
CPTF2   DS      3

*       great

        RSEG    CPROM

        DC      B1              to great
        DC      5               5 couplers to gt
        DC      0,12,0          sw - gt 4'
        DC      0,0,0           sw - gt 8'
        DC      0,-12,0         sw - gt 16'
        DC      0,12,1          gt - gt 4'
        DC      -1,0,1          gt - gt 8' off

        RSEG    CPRAM

CPTOGT  DS      2
CPTF3   DS      3
CPTF4   DS      3
```

```
CPTF5   DS      3
CPTF6   DS      3
CPTF7   DS      3

        RSEG    CPROM

*       pedal

        DC      B2              to pedal
        DC      5
        DC      0,12,0          sw - ped 4'
        DC      0,0,0           sw - ped 8'
        DC      0,12,1          gt - ped 4'
        DC      0,0,1           gt - ped 8'
        DC      -1,0,2          ped - ped 8' off

        RSEG    CPRAM

CPTOPD  DS      2
CPTF8   DS      3
CPTF9   DS      3
CPTF10  DS      3
CPTF11  DS      3
CPTF12  DS      3

        RSEG    CPROM
CPLEN   EQU     *-CPSTRT


CPTAB   EQU     *
 DC  0,B(CPTF0),B0              sw - sw 4'
 DC -1,B(CPTF1),B0              sw - sw 8' off
 DC  0,B(CPTF2),B0              sw - sw 16'
 DC  0,B(CPTF3),B1              sw - gt 4'
 DC  0,B(CPTF4),B1              sw - gt 8'
 DC  0,B(CPTF5),B1              sw - gt 16'
 DC  0,B(CPTF6),B1              gt - gt 4'
 DC -1,B(CPTF7),B1              gt - gt 8' off
 DC  0,B(CPTF8),B2              sw - ped 4'
 DC  0,B(CPTF9),B2              sw - ped 8'
 DC  0,B(CPTF10),B2             gt - ped 4'
 DC  0,B(CPTF11),B2             gt - ped 8'
 DC -1,B(CPTF12),B2             ped - ped 8' off
NOCOUP  EQU     13


*****************************************************************
*                                                               *
*                    T I L T     T A B S                        *
*                                                               *
*****************************************************************

        GLBL    STCRAM,SWSTAT,SWSTATE,SWTAB,TILTLEN
        GLBL    STPFLG

TILTLEN EQU     72              # of tilt tabs
```

```
        RSEG    CPROM

SWTAB   EQU     *

        DC      8,31            swell 16' bour
        DC      8,32              "   8' viol
        DC      8,33              "   8' celes
        DC      8,34              "   8' flute
        DC      8,35              "   4' prin
        DC      8,36              "   4' nacht
        DC      8,37              "   2'2/3 naz
        DC      8,38              "   2' flute
        DC      8,39              "   1'3/5 tierce
        DC      8,40              "   1' siffl
        DC      8,41              "   mix
        DC      8,42              "   16' contre tromp
        DC      8,43              "   8' trum
        DC      8,44              "   8' oboe
        DC      8,45            swell 4' clairon

        DC      12,0                  TREM
        DC      2,4*2           SW - SW 16'
        DC      2,4*1           SW - SW 8' OFF
        DC      2,4*0           SW - SW 4'

        DC      0,0                 SPACE
        DC      0,0                   "
        DC      0,0                   "
        DC      0,0                   "
        DC      0,0                   "
        DC      0,0                 SPACE

        DC      4,4             main chor
        DC      10,0            flt trem full
        DC      0,0                   SPACE
HDSTRT  EQU     (*-SWTAB)/2
        DC      6,2             GT main off
        DC      4,2             GT anti on
        DC      6,0             SW MAIN OFF
        DC      4,0             SW ANTI ON

        DC      8,0             pedal 32' bourdon
        DC      8,1               "   16' principal
        DC      8,2               "   16' subbass
        DC      8,3               "   16' gedakt
        DC      8,4               "   8' oct
        DC      8,5               "   8' ged
        DC      8,6               "   4' chor
        DC      8,7               "   4' nacht
        DC      8,8               "   2' flute
        DC      8,9               "   mix V
        DC      8,10              "   16' posaune
        DC      8,11              "   8' trompette
        DC      8,12            pedal 4' clairon

        DC      2,4*11            GT - PED 8'
        DC      2,4*10            GT - PED 4'
```

```
        DC      2,4*9           SW - PED 8'
        DC      2,4*8           SW - PED 4'

        DC      0,0                 SPACE
        DC      0,0                 SPACE

        DC      8,13          great 8' prin
        DC      8,14            "   8' gems
        DC      8,15            "   8' spitz
        DC      8,16            "   8' celes
        DC      8,17            "   4' octv
        DC      8,18            "   4' flute
        DC      8,19            "   2' prin
        DC      8,20            "   2' waldflt
        DC      8,21            "   1'1/3 larigot
        DC      8,22            "   mix
        DC      8,23            "   cymbel
        DC      8,24            "   16' dulzian
        DC      8,25            "   krummhorn
        DC      8,26            "   harpschrd
        DC      8,27            "   harp
        DC      14,0          great carillon
        DC      12,1                TREM

        DC      2,4*6         GT - GT 4'
        DC      2,4*5         SW - GT 16'
        DC      2,4*4         SW - GT 8'
        DC      2,4*3         SW - GT 4'

        RSEG    RAM4

SWSTAT  DS      TILTLEN       switch state table
SWSTATE EQU     *

STPFLG  DS      46

        RSEG    CPRAM

STCRAM  DS      3*18+1        stop change assembly area


*****************************************************************
*                                                               *
*                      P I S T O N S                            *
*                                                               *
*****************************************************************

        GLBL    NOPGRP,NOGENP,PTAB,PFLAG
        GLBL    DEBTAB,DEBTABE,NODEB,PBITS,PISTAB

NOPGRP  EQU     4             # of groups
NOGENP  EQU     8             # of general pistons

NODEB   EQU     6             # of debounced studs

        RSEG    CPRAM
```

```
DEBTAB  DS      NODEB           debounce flag table
DEBTABE EQU     *

        RSEG    CPROM

PTAB    DC      0,72,80         generals
        DC      0,19,88         swell
        DC      51,18,98        great
        DC      32,13,0         pedal

        RSEG    CPRAM

PFLAG   DS      3*4             piston work area

        RSEG    CPROM

PBITS   DC      0,B1            general 1
        DC      0,B2               "    2
        DC      0,B3               "    3
        DC      1,B0               "    4
        DC      1,B1               "    5
        DC      1,B2               "    6
        DC      1,B3               "    7
        DC      2,B0            general 8
        DC      2,B1            divisional 1
        DC      2,B2                "      2
        DC      2,B3                "      3
        DC      3,B0                "      4
        DC      3,B1            divisional 5

PISTAB  EQU     *
*  toe studs - debounced
        DC      2,32            32' BOURDON REV
        DC      20,0            ORCH C
        DC      26,47           SW - PED
        DC      26,45           GT - PED
        DC      4,0             tutti
        DC      2,49            ZIMB
*  toe studs - not debounced
        DC      14,X'33'        pedal 4
        DC      14,X'32'          "   3
        DC      14,X'31'          "   2
        DC      14,X'30'        pedal 1
        DC      0,0
        DC      0,0
        DC      0,0
        DC      0,0
        DC      0,0
        DC      0,0
        DC      14,X'07'        general 8
        DC      14,X'06'           "    7
        DC      14,X'05'           "    6
        DC      14,X'04'           "    5
        DC      14,X'03'           "    4
        DC      14,X'02'           "    3
```

```
        DC      14,X'01'        "     2
        DC      14,X'00'      general 1
*  pistons under great
        DC      0,0
        DC      0,0
        DC      16,0          HDPHONE
        DC      12,0          GEN CAN
        DC      18,4
        DC      18,3
        DC      18,2
        DC      18,1
        DC      18,0
        DC      18,-1
        DC      18,-2
        DC      18,-3
        DC      18,-4
        DC      14,X'24'      GT 5
        DC      14,X'23'         4
        DC      14,X'22'         3
        DC      14,X'21'         2
        DC      14,X'20'      GT 1
        DC      26,45         GT - PED REV
        DC      8,B1          M 2
        DC      8,B0          M 1
        DC      6,0           SET
        DC      10,0          POWER
        DC      22,0          SET COMB LOCK
*  pistons under swell
        DC      4,0           TUTTI
        DC      26,49         ZIMB
        DC      14,X'07'      GEN 8
        DC      14,X'06'          7
        DC      14,X'05'          6
        DC      14,X'04'      GEN 5
        DC      20,0          ORC C
        DC      14,X'14'      SWELL 5
        DC      14,X'13'            4
        DC      14,X'12'            3
        DC      14,X'11'            2
        DC      14,X'10'      SWELL 1
        DC      14,X'03'      GEN 4
        DC      14,X'02'          3
        DC      14,X'01'          2
        DC      14,X'00'      GEN 1

*****************************************************************
*                                                               *
*       C R E S C E N D O     M E M O R I E S                   *
*                                                               *
*****************************************************************


        GLBL    CRMEM1,CRMEM2,EXP1DO,EXP2DO,EX1VAL,EX2VAL
        GLBL    CRDTAB,CRDADR,EXPDSP,ORCMEM

        RSEG    CPROM
```

```
*  normal

CRMEM1  EQU     *

 DC -1,0,-1,6,20,14,-1,23,-1,-1,38,-1,50,-1,60
 DC -1,-1,-1,-1,-1,-1,-1,-1,-1,-1,-1,-1,-1,-1,-1,-1,-1
 DC -1,53,32,1,29,10,41,-1,-1,58,-1,-1,-1
 DC -1,-1,0,-1,-1,-1
 DC 44,0,8,-1,26,17,35,-1,-1,56,-1,-1,-1,-1,-1,-1
 DC -1,-1,-1,0,-1



CRDTAB  DC      60,B6+B2,50,B5+B2,40,B4+B2
        DC      30,B3+B2,20,B2,10,B1,1,B0,0,0

* EXPRESSION CONTROL
EXP1DO  LD      A,(EX1VAL)
        LD      HL,EX1ADR
EXP1DO1 LD      B,8
        CPL
EXP1DO2 RLA
        JR      NC,*+6
        SET     7,(HL)
        JR      *+4
        RES     7,(HL)
        INC     HL
        DJNZ    EXP1DO2
ARET    RET

EXP2DO  LD      A,(EX2VAL)
        LD      HL,EX2ADR
        JR      EXP1DO1

*****************************************************************
*                                                               *
*                    C M O S     M E M O R Y                    *
*                                                               *
*****************************************************************


        GLBL    MEMTB,LOCKS

        RSEG    CPROM

MEMTB   DC      B(MEM1),B(MEM2)


        RSEG    CMOS

MEM1    DS      TILTLEN*4

MEM2    DS      TILTLEN*4
```

```
        ORCMEM  DS      TILTLEN*2

        LOCKS   DS      5*8

                RSEG    CPRAM
        CRMEM2  DS      TILTLEN

*****************************************************************
*                                                               *
*        S T O P    C H A N G E    T A B L E S                 *
*                                                               *
*****************************************************************


        GLBL    PDSTPC,GTSTPC,SWSTPC

        RSEG    CPROM

        DC      13
        DC      B(STPFLG)
PDSTPC  EQU     *
  DC  B(PD00UP),B(PD00DN),B(PDMF),B(PDMN),B(GTFLSTC)
  DC  B(ARET),B(ARET),B(PDPRF),B(PDPRN),B(GTPRSTC)
  DC  B(PD02UP),B(PD02DN),B(PDMF),B(PDMN),B(GTFLSTC)
  DC  B(PD03UP),B(PD03DN),B(PDMF),B(PDMN),B(GTFLSTC)
  DC  B(PD04UP),B(PD04DN),B(PDMF),B(PDMN),B(GTPRSTC+1)
  DC  B(PD05UP),B(PD05DN),B(PDMF),B(PDMN),B(GTFLSTC+1)
  DC  B(PD06UP),B(PD06DN),B(PDMF),B(PDMN),B(GTPRSTC+2)
  DC  B(PD07UP),B(PD07DN),B(PDMF),B(PDMN),B(GTFLSTC+2)
  DC  B(PD08UP),B(PD08DN),B(PDMF),B(PDMN),B(GTFLSTC+2)
  DC  B(PD09UP),B(PD09DN),B(PDMF),B(PDMN),B(DUMSTC)
  DC  B(ARET),B(ARET),B(PDPSF),B(PDPSN),B(DUMSTC)
  DC  B(PD11UP),B(PD11DN),B(PDRF),B(PDRN),B(DUMSTC)
  DC  B(PD12UP),B(PD12DN),B(PDRF),B(PDRN),B(DUMSTC)
        DC      B(KTBX+61+61),32

        DC      18
        DC      B(STPFLG+13)
GTSTPC  EQU     *
  DC  B(GT13UP),B(GT13DN),B(GTMF),B(GTMN),B(GTPRSTC+1)
  DC  B(GT14UP),B(GT14DN),B(GTMF),B(GTMN),B(GTPRSTC+1)
  DC  B(GT15UP),B(GT15DN),B(GTMF),B(GTMN),B(GTFLSTC+1)
  DC  B(GT16UP),B(GT16DN),B(GTMF),B(GTMN),B(GTFLSTC+1)
  DC  B(GT17UP),B(GT17DN),B(GTMF),B(GTMN),B(GTPRSTC+2)
  DC  B(GT18UP),B(GT18DN),B(GTMF),B(GTMN),B(GTFLSTC+2)
  DC  B(GT19UP),B(GT19DN),B(GTMF),B(GTMN),B(GTPRSTC+2)
  DC  B(GT20UP),B(GT20DN),B(GTMF),B(GTMN),B(GTFLSTC+2)
  DC  B(GT21UP),B(GT21DN),B(GTMF),B(GTMN),B(GTPRSTC+2)
  DC  B(GT22UP),B(GT22DN),B(GTMF),B(GTMN),B(DUMSTC)
  DC  B(GT23UP),B(GT23DN),B(GTMF),B(GTMN),B(DUMSTC)
  DC  B(GT24UP),B(GT24DN),B(GTMF),B(GTMN),B(DUMSTC)
  DC  B(GT25UP),B(GT25DN),B(GTMF),B(GTMN),B(DUMSTC)
  DC  B(GT26UP),B(GT26DN),B(HMF),B(HMN),B(DUMSTC)
```

```
  DC   B(GT27UP),B(GT27DN),B(HMF),B(HMN),B(DUMSTC)
  DC   B(GT28UP),B(GT28DN),B(HCSUSF),B(HCSUSN),B(DUMSTC)
  DC   B(GT29UP),B(GT29DN),B(HCSUSF),B(HCSUSN),B(DUMSTC)
  DC   B(GT30UP),B(GT30DN),B(HCSUSF),B(HCSUSN),B(DUMSTC)
         DC      B(KTBX+61),61

         DC      15
         DC      B(STPFLG+13+18)
SWSTPC   EQU     *
  DC   B(SW31UP),B(SW31DN),B(SWMF),B(SWMN),B(SWFLSTC)
  DC   B(SW32UP),B(SW32DN),B(SWMF),B(SWMN),B(SWPRSTC)
  DC   B(SW33UP),B(SW33DN),B(SWMF),B(SWMN),B(SWPRSTC)
  DC   B(SW34UP),B(SW34DN),B(SWMF),B(SWMN),B(SWFLSTC+1)
  DC   B(SW35UP),B(SW35DN),B(SWMF),B(SWMN),B(SWPRSTC+1)
  DC   B(SW36UP),B(SW36DN),B(SWMF),B(SWMN),B(SWFLSTC+2)
  DC   B(SW37UP),B(SW37DN),B(SWMF),B(SWMN),B(SWFLSTC+2)
  DC   B(SW38UP),B(SW38DN),B(SWMF),B(SWMN),B(SWFLSTC+2)
  DC   B(SW39UP),B(SW39DN),B(SWMF),B(SWMN),B(SWFLSTC+2)
  DC   B(SW40UP),B(SW40DN),B(SWMF),B(SWMN),B(SWPRSTC+2)
  DC   B(SW41UP),B(SW41DN),B(SWMF),B(SWMN),B(DUMSTC)
  DC   B(SW42UP),B(SW42DN),B(SWRF),B(SWRN),B(DUMSTC)
  DC   B(SW43UP),B(SW43DN),B(SWRF),B(SWRN),B(DUMSTC)
  DC   B(SW44UP),B(SW44DN),B(SWMF),B(SWMN),B(DUMSTC)
  DC   B(SW45UP),B(SW45DN),B(SWRF),B(SWRN),B(DUMSTC)
         DC      B(KTBX),61


*****************************************************************
*                                                               *
*        M U T E S     T R E M S     E T C                      *
*                                                               *
*****************************************************************


         GLBL    NOTRM,TRMFLG,TRMADR,FTFULL,FTFFLG

NOTRM    EQU     2

         RSEG    CPRAM
FTFFLG   DS      1
TRMFLG   DS      NOTRM

         RSEG    CPROM
TRMADR   DC      B(SWMTR),B(SWFTR)
         DC      B(GTMTR),B(GTFTR)

         GLBL    MUTEON,MUTEOF

         RSEG    CPROM


MUTEOF   LD      A,-1
         LD      (EX1VAL),A
         LD      (EX2VAL),A
         LD      A,B7
```

```
MUTOF1   LD      (OUTPON),A
         LD      (SWMNOF),A
         LD      (GTMNOF),A
         RET

MUTEON   LD      A,0                          ZZZ
         JR      MUTOF1

         GLBL    CTLIT,CTLITN,CTLT

CTLIT    EQU     $
         DC      B(SWMNOF)
         DC      B(GTMNOF)
CTLITN   EQU     ($-CTLIT)/2
CTLT     EQU     $
         DC      B(SWANON)
         DC      B(GTANON)
         DC      B(MNCHOR)

HCSUSN   LD      HL,HCSUSC
         LD      A,(HL)
         INC     (HL)
         TST     A
         RET     NZ
         LD      HL,HCSUS
         SET     LMPBIT,(HL)
         JP      HMN
HCSUSF   LD      HL,HCSUSC
         DEC     (HL)
         RET     NZ
         LD      HL,HCSUS
         RES     LMPBIT,(HL)
         JP      HMF

         RSEG    RAM4
GTPRSTC  DS      3
GTFLSTC  DS      3
SWPRSTC  DS      3
SWFLSTC  DS      3
DUMSTC   DS      1

         GLBL    MCADDR,NOMC
         RSEG    CPRAM
PDMNX    DS      1
GTKCNT   DS      4
SWKCNT   DS      4
MCADDR   EQU     $
GTKC     DS      1
SWKC     DS      1
PDKC     DS      1
SWSC     DS      1
GTSC     DS      1
SWRC     DS      1
PDSC     DS      1
PDRC     DS      1
HMC      DS      1
```

```
HCSUSC  DS      1
NOMC    EQU     *-MCADDR

        RSEG    CPROM

        GLBL    AIRDO

AIRDO   LD      IX,GTKCNT
        LD      IY,GTPRSTC
        LD      HL,GTPRNK+7
        CALL    AIRSUB
        LD      IX,GTKCNT
        LD      IY,GTFLSTC
        LD      HL,GTFLNK+7
        CALL    AIRSUB
        LD      IX,SWKCNT
        LD      IY,SWPRSTC
        LD      HL,SWPRNK+7
        CALL    AIRSUB
        LD      IX,SWKCNT
        LD      IY,SWFLSTC
        LD      HL,SWFLNK+7
        JP      AIRSUB

PDPRN   LD      HL,PDDIMK
        SET     LMPBIT,(HL)
        JP      PDMN
PDPRF   LD      HL,PDDIMK
        RES     LMPBIT,(HL)
        JP      PDMF

PDPSN   LD      HL,PDRDMK
        SET     LMPBIT,(HL)
        JP      PDMN
PDPSF   LD      HL,PDRDMK
        RES     LMPBIT,(HL)
        JP      PDMF

SWMN    LD      HL,SWSC
        INC     (HL)
        JR      SWMDO
SWMF    LD      HL,SWSC
        DEC     (HL)
SWMDO   TST     (SWKC)
        JR      Z,SWMDOO
        TST     (HL)
        JR      Z,SWMDOO
SWMDO1  LD      HL,SWPRMK
        SET     LMPBIT,(HL)
        LD      HL,SWFLMK
        SET     LMPBIT,(HL)
        LD      A,B2
        JP      PDMN1
SWMDOO  LD      HL,SWPRMK
        RES     LMPBIT,(HL)
        LD      HL,SWFLMK
        RES     LMPBIT,(HL)
        LD      A,255-B2
        JP      PDMNO

HMN     LD      HL,HMC
        INC     (HL)
        JR      HMDO
HMF     LD      HL,HMC
        DEC     (HL)
HMDO    TST     (GTKC)
        JR      Z,HMDOO
        TST     (HMC)
        JR      Z,HMDOO
        LD      HL,HMK
        SET     LMPBIT,(HL)
        LD      A,B3
        JP      PDMN1
HMDOO   LD      HL,HMK
        RES     LMPBIT,(HL)
        LD      A,255-B3
        JP      PDMNO

SWRN    LD      HL,SWRC
        INC     (HL)
        JR      SWRDO
SWRF    LD      HL,SWRC
        DEC     (HL)
SWRDO   TST     (SWRC)
        JR      Z,SWRDO2
        TST     (SWKC)
        JR      NZ,SWRDO1
SWRDO2  TST     (PDKC)
        JR      Z,SWRDOO
        TST     (PDRC)
        JR      Z,SWRDOO
SWRDO1  LD      HL,SWRDMK
        SET     LMPBIT,(HL)
        LD      A,B4
        JR      PDMN1
SWRDOO  LD      HL,SWRDMK
        RES     LMPBIT,(HL)
        LD      A,255-B4
        JR      PDMNO

PDRN    LD      HL,PDRC
        INC     (HL)
        JR      SWRDO
PDRF    LD      HL,PDRC
        DEC     (HL)
        JR      SWRDO

PDMN    LD      HL,PDSC
        INC     (HL)
        JR      GTMDO
PDMF    LD      HL,PDSC
        DEC     (HL)
        JR      GTMDO
```

```
GTMN     LD      HL,GTSC
         INC     (HL)
         JR      GTMDO
GTMF     LD      HL,GTSC
         DEC     (HL)
GTMDO    TST     (GTSC)
         JR      Z,GTMDO2
         TST     (GTKC)
         JR      NZ,GTMDO1
GTMDO2   TST     (PDKC)
         JR      Z,GTMDOO
         TST     (PDSC)
         JR      Z,GTMDOO
GTMDO1   LD      HL,GTPRMK
         SET     LMPBIT,(HL)
         LD      HL,GTFLMK
         SET     LMPBIT,(HL)
         LD      A,B5
         JR      PDMN1
GTMDOO   LD      HL,GTPRMK
         RES     LMPBIT,(HL)
         LD      HL,GTFLMK
         RES     LMPBIT,(HL)
         LD      A,255-B5
         JR      PDMNO
PDMN1    LD      HL,PDMNX
         OR      (HL)
         LD      (HL),A
         LD      HL,PDMNOF
         SET     LMPBIT,(HL)
         RET

PDMNO    LD      HL,PDMNX
         AND     (HL)
         LD      (HL),A
         RET     NZ
         LD      HL,PDMNOF
         RES     LMPBIT,(HL)
         RET

KCSUB    LD      A,E
         RRA
         RRA
         RRA
         RRA
         AND     15
         ADDHL   A
         RET

* IX -> KCOUNT
* HL -> NOISE KEYER+7
* IY -> STOPS COUNT (16,8,4)

         GLBL    AIRSUB

AIRSUB   LD      E,0
         TST     (IY+0)
         JR      Z,AIR1
         LD      A,E
         ADD     A,(IX+0)
         ADD     A,(IX+1)
         LD      E,A
AIR1     TST     (IY+1)
         JR      Z,AIR2
         LD      A,E
         ADD     A,(IX+0)
         LD      E,A
AIR2     LD      B,2
         LD      C,3
         CALL    AIROUT
         LD      E,0
         TST     (IY+0)
         JR      Z,AIR3
         LD      A,E
         ADD     A,(IX+2)
         ADD     A,(IX+3)
         LD      E,A
AIR3     TST     (IY+1)
         JR      Z,AIR4
         LD      A,E
         ADD     A,(IX+1)
         ADD     A,(IX+2)
         LD      E,A
AIR4     TST     (IY+2)
         JR      Z,AIR5
         LD      A,E
         ADD     A,(IX+0)
         ADD     A,(IX+1)
         LD      E,A
AIR5     LD      B,3
         LD      C,7
         CALL    AIROUT
         LD      E,0
         TST     (IY+1)
         JR      Z,AIR6
         LD      A,E
         ADD     A,(IX+3)
         LD      E,A
AIR6     TST     (IY+2)
         JR      Z,AIR7
         LD      A,E
         ADD     A,(IX+2)
         ADD     A,(IX+3)
         LD      E,A
AIR7     LD      B,3
         LD      C,7
         CALL    AIROUT
         RET

AIROUT   TST     E
         JR      Z,AIR9
         INC     A
         CP      C
         JR      C,AIR9
```

```
        LD      A,C
AIR9    RRA
        JR      NC,*+6
        SET     LMPBIT,(HL)
        JR      *+4
        RES     LMPBIT,(HL)
        DEC     HL
        DJNZ    AIR9
        RET

DUMYMK  RET

*****************************************************************
*                                                               *
*          S T O P     D E F I N I T I O N S                    *
*                                                               *
*****************************************************************


        RSEG    DMARAM

*  bit stream 0

        ORG     DMASTRT

SWFL1K  DS      72              N 13

        DS      67
SWPR1K  DS      1               N 1
        DS      4

        DS      4
SWFL2K  DS      84              N 1

        DS      63
SWPR2K  DS      1               N 13

*  bit stream 1

        ORG     DMASTRT

SWFL3K  DS      64              N 01

        DS      59
SWPR3K  DS      1               N 25
        DS      4

        DS      4
SWFL4K  DS      60              N 25

        DS      47
SWPR4K  DS      1               N 37
```

```
*  bit stream 2

         ORG     DMASTRT

GTFL85K  DS      4                GT,GT SW,SW

GTFL1K   DS      12+24            N 001

         DS      67
GTPR1K   DS      1                N 1
         DS      4

GTFL2K   DS      80               N 01

         DS      47
GTPR2K   DS      1                N 37

*  bit stream 3

         ORG     DMASTRT

         DS      4
GTFL3K   DS      76               N 1

         DS      67
GTPR3K   DS      1                N 1
         DS      4

GTFL4K   DS      96               N 01

         DS      83
GTPR4K   DS      1                N 1
         DS      4

*  bit stream 4

         ORG     DMASTRT

PDPULK   DS      32               N 01

GTCH1K   DS      56               N 29

         DS      55
SWCH1K   DS      1                N 29

GTCH2K   DS      56               N 29

         DS      55
SWCH2K   DS      1                N 29

GTCH3K   DS      56               N 29

         DS      55
SWCH3K   DS      1                N 29

         DS      11
```

```
PREXTK   DS      1              N 1
         DS      4

*  bit stream 5

         ORG     DMASTRT

         DS      4
SWPULK   DS      68             N 1

         DS      71
HCAR1K   DS      1              N 13

GTCH4K   DS      56             N 29

         DS      63
SWTR1K   DS      1              N 01

FLCL1K DS       48             N 13

         DS      47
UCEL1K   DS      1              N 13

*  bit stream 6

         ORG     DMASTRT

GTKR1K   DS      64             N 01

         DS      67
SWTR2K   DS      1              N 1
         DS      4

         DS      4
GTKR2K   DS      68             N 1

         DS      63
SWTR3K   DS      1              N 13

         DS      4
HPCD1K   DS      68             N 1

         RSEG    RAM4
GTFL4C   DS      96
GTFL2C   DS      80
         DS      83
GTPR4C   DS      1
GTFL3C   DS      76
         DS      67
GTPR3C   DS      1
         DS      67
SWTR2C   DS      1
         DS      63
SWTR3C   DS      1
GTCH4C   DS      56
GTCH2C   DS      56
         DS      71
```

```
HCAR1C   DS     1
GTFL85C  DS     4
         DS     47
GTPR2C   DS     1
SWFL4C   DS     60
SWFL2C   DS     84
SWFL1C   DS     72
         DS     55
SWCH2C   DS     1
         DS     47
SWPR4C   DS     1
         DS     59
SWPR3C   DS     1

         STPDEF PD00,2,GTFL1K,0,1
         STPDEF PEDPUL,4,PDPULK,0,1
         STPDEF PD02,3,GTFL4K,GTFL4C,1
         STPDEF PD03,2,GTFL2K,GTFL2C,1
         STPDEF PD04,3,GTPR4K,GTPR4C,-1
         STPDEF PD05,3,GTFL3K,GTFL3C,1
         STPDEF PD06,3,GTPR3K-12,GTPR3C-12,-1
         STPDEF PD07,3,GTFL3K+12,GTFL3C+12,1
         STPDEF PD08,3,GTFL3K+24,GTFL3C+24,1
         STPDEF PD09,3,GTPR4K-31,GTPR4C-31,-1
         STPDEF PD11,6,SWTR2K,SWTR2C,-1
         STPDEF PD12,6,SWTR3K,SWTR3C,-1

         STPDEF GT13,3,GTPR3K,GTPR3C,-1
         STPDEF GT131,4,GTCH3K-16,0,1
         STPDEF GT14,2,GTPR1K,0,-1
         STPDEF GT15,3,GTFL3K,GTFL3C,1
         STPDEF GT151,4,GTCH1K-7,0,1
         STPDEF GT161,2,GTFL2K+12,GTFL2C+12,1
         STPDEF GT162,5,FLCL1K-12,0,1
         STPDEF GT17,3,GTPR4K-12,GTPR4C-12,-1
         STPDEF GT171,5,GTCH4K-4,GTCH4C-4,1
         STPDEF GT18,3,GTFL3K+12,GTFL3C+12,1
         STPDEF GT181,4,GTCH2K+5,GTCH2C+5,1
         STPDUP GT182,GT181,8
         STPDEF GT19,3,GTPR4K-24,GTPR4C-24,-1
         STPDEF GT1985,2,GTFL85K+3,GTFL85C+3,1
         STPDUP GT191,GT171,12
         STPDEF GT20,3,GTFL4K+36,GTFL4C+36,1
         STPDEF GT2085,2,GTFL85K+2,GTFL85C+2,1
         STPDUP GT201,GT181,0
         STPDEF GT21,3,GTFL4K+43,GTFL4C+43,1
         STPDEF GT22,2,GTPR2K+36,GTPR2C+36,-1
         STPDUP GT2215,GT22,24
         STPDEF GT2285,2,GTFL85K+3,GTFL85C+3,1
         STPDEF GT231,2,GTPR2K-65+36,GTPR2C-65+36,-1
         STPDUP GT232,GT231,7
         STPDEF GT24,6,GTKR1K,0,1
         STPDEF GT25,6,GTKR2K,0,1
         STPDEF GT26,6,HPCD1K,0,1
         STPDEF GT27,5,HCAR1K+12,HCAR1C+12,-1
         STPDEF GT28,5,HCAR1K+24,HCAR1C+24,-1
```

```
        GLBL    CHMSTP
CHMSTP  EQU     28

        STPDEF  SW31,1,SWFL3K,0,1
        STPDEF  SW32,0,SWPR1K,0,-1
        STPDEF  SW33,5,UCEL1K+12,0,-1
        STPDEF  SW34,0,SWFL2K,SWFL2C,1
        STPDEF  SW341,4,SWCH1K+7,0,-1
        STPDEF  SW35,0,SWPR2K,0,-1
        STPDEF  SW351,4,SWCH3K+4,0,-1
        STPDEF  SW36,0,SWFL1K,SWFL1C,1
        STPDEF  SW361,4,SWCH2K+7,SWCH2C+7,-1
        STPDEF  SW37,0,SWFL2K+19,SWFL2C+19,1
        STPDEF  SW38,0,SWFL1K+12,SWFL1C+12,1
        STPDUP  SW381,SW361,12
        STPDEF  SW3885,2,GTFL85K+1,GTFL85C+1,1
        STPDEF  SW39,1,SWFL4K+4,SWFL4C+4,1
        STPDEF  SW40,1,SWPR4K,SWPR4C,-1
        STPDEF  SW4085,2,GTFL85K+0,GTFL85C+0,1
        STPDEF  SW41,1,SWPR3K+24,SWPR3C+24,-1
        STPDUP  SW4115,SW41,24
        STPDEF  SW4185,2,GTFL85K+0,GTFL85C+0,1
        STPDEF  SW42,5,SWTR1K,0,-1
        STPDEF  SW43,6,SWTR2K,SWTR2C,-1
        STPDEF  SW44,5,SWPULK,0,1
        STPDEF  SW45,6,SWTR3K,SWTR3C,-1


*****************************************************************
*                                                               *
*                  K E Y     C H A N G E                        *
*                                                               *
*****************************************************************


        GLBL    KEYON,KEYOFF

        RSEG    CPROM

* on entry
*       C = man #
*       A = key #

KEYON   LD      E,A
        LD      D,0
        DEC     C               man #
        JP      M,KONSW         was 0
        JP      Z,KONGT         was 1

KONPD   KDOWN   PD,00,00
        KDOWN   PD,02,09
        KDOWN   PD,11,12
        MIXDNR  PEDPUL
        LD      HL,GTKCNT
        CALL    KCSUB
        INC     (HL)
```

```
        LD      HL,PDKC
        LD      A,(HL)
        INC     (HL)
        TST     A
        RET     NZ
        CALL    SWRDO
        CALL    GTMDO
        RET

KONGT   KDOWN   GT,13,30
        LD      HL,GTKCNT
        CALL    KCSUB
        INC     (HL)
        LD      HL,GTKC
        LD      A,(HL)
        INC     (HL)
        TST     A
        RET     NZ
        CALL    HMDO
        TST     (GTSC)
        RET     Z
        JP      GTMDO1

KONSW   KDOWN   SW,31,45
        LD      HL,SWKCNT
        CALL    KCSUB
        INC     (HL)
        LD      HL,SWKC
        LD      A,(HL)
        INC     (HL)
        TST     A
        RET     NZ
        TST     (SWSC)
        CALL    NZ,SWMDO1
        JP      SWRDO

KEYOFF  LD      E,A
        LD      D,0
        DEC     C
        JP      M,KOFSW
        JP      Z,KOFGT

KOFPD   KUP     PD,00,00
        KUP     PD,02,09
        KUP     PD,11,12
        MIXUPR  PEDPUL
        LD      HL,GTKCNT
        CALL    KCSUB
        DEC     (HL)
        LD      HL,PDKC
        DEC     (HL)
        RET     NZ
        CALL    SWRDO
        JP      GTMDO

KOFGT   KUP     GT,13,30
        LD      HL,GTKCNT
        CALL    KCSUB
        DEC     (HL)
        LD      HL,GTKC
        DEC     (HL)
        RET     NZ
        CALL    HMDO
        JP      GTMDO

KOFSW   KUP     SW,31,45
        LD      HL,SWKCNT
        CALL    KCSUB
        DEC     (HL)
        LD      HL,SWKC
        DEC     (HL)
        RET     NZ
        CALL    SWMDOO
        JP      SWRDO

*****************************************************************
*                                                               *
*                    M I X T U R E S                            *
*                                                               *
*****************************************************************

        RSEG    CPROM

*  great IV-V

GT22DN  LD      A,E
        CP      53
        JR      C,GT22DNO
        MX85DN  GT2215,GT2285,60
GT22DNO PUSH    DE
        CALL    GT22SUB
```

```
GT22DN1 LD      E,(IX+0)
        ADD     HL,DE
        ADD     IY,DE
        INC     (HL)
        SET     GT22B,(IY+0)
        INC     IX
        DJNZ    GT22DN1
        POP     DE
        RET

GT22UP  LD      A,E
        CP      53
        JR      C,GT22UP0
        MX85UP  GT2215,GT2285,60
GT22UP0 PUSH    DE
        CALL    GT22SUB
GT22UP1 LD      E,(IX+0)
        ADD     HL,DE
        ADD     IY,DE
        DEC     (HL)
        JR      NZ,GT22UP2
        RES     GT22B,(IY+0)
GT22UP2 INC     IX
        DJNZ    GT22UP1
        POP     DE
        RET

GT22SUB LD      A,E
        LD      DE,7
        LD      IX,GT22T+2
GT22S1  CP      (IX-2)
        JR      NC,GT22S2
        ADD     IX,DE
        JR      GT22S1
GT22S2  LD      E,A
        LD      HL,GT22AK
        SBC     HL,DE
        PUSH    HL
        POP     IY
        LD      HL,GT22AC
        SBC     HL,DE
        LD      D,-1
        LD      B,(IX-1)
        RET

GT22T   DC      53,3,-7,-5,-7,0,0
        DC      48,4,-12,-7,-5,-7,0
        DC      41,5,-12,-7,-5,-7,-5
        DC      30,5,-19,-5,-7,-5,-7
        DC      24,5,-24,-7,-5,-7,-5
        DC      12,4,-31,-5,-7,-5,0
        DC      0,4,-36,-7,-5,-7,0

* PEDAL V

PD09DN  PUSH    DE
        CALL    PD09SUB
```

```
PD09DN1 LD      E,(IX+0)
        ADD     HL,DE
        ADD     IY,DE
        INC     (HL)
        SET     PD09B,(IY+0)
        INC     IX
        DJNZ    PD09DN1
        POP     DE
        RET

PD09UP  PUSH    DE
        CALL    PD09SUB
PD09UP1 LD      E,(IX+0)
        ADD     HL,DE
        ADD     IY,DE
        DEC     (HL)
        JR      NZ,PD09UP2
        RES     PD09B,(IY+0)
PD09UP2 INC     IX
        DJNZ    PD09UP1
        POP     DE
        RET

PD09SUB LD      HL,PD09AK+1
        OR      A
        SBC     HL,DE
        PUSH    HL
        POP     IY
        LD      HL,PD09AC+1
        SBC     HL,DE
        LD      D,-1
        LD      A,E
        LD      B,5
        LD      IX,PD09T
        CP      24
        RET     NC
        DEC     HL
        DEC     IY
        INC     IX
        RET
PD09T   DC      -1,-5,-7,-5,-7,-5

* swell IV-V

SW41DN  LD      A,E
        CP      53
        JR      C,SW41DN0
        MX85DN  SW4115,SW4185,60
SW41DN0 PUSH    DE
        CALL    SW41SUB
SW41DN1 LD      E,(IX+0)
        ADD     HL,DE
        ADD     IY,DE
        INC     (HL)
        SET     SW41B,(IY+0)
        INC     IX
        DJNZ    SW41DN1
        POP     DE
        RET
```

```
SW41UP   LD      A,E
         CP      53
         JR      C,SW41UP0
         MX85UP  SW4115,SW4185,60
SW41UP0  PUSH    DE
         CALL    SW41SUB
SW41UP1  LD      E,(IX+0)
         ADD     HL,DE
         ADD     IY,DE
         DEC     (HL)
         JR      NZ,SW41UP2
         RES     SW41B,(IY+0)
SW41UP2  INC     IX
         DJNZ    SW41UP1
         POP     DE
         RET

SW41SUB  LD      A,E
         LD      DE,7
         LD      IX,SW41T+2
SW41S1   CP      (IX-2)
         JR      NC,SW41S2
         ADD     IX,DE
         JR      SW41S1
SW41S2   LD      E,A
         LD      HL,SW41AK
         SBC     HL,DE
         PUSH    HL
         POP     IY
         LD      HL,SW41AC
         SBC     HL,DE
         LD      D,-1
         LD      B,(IX-1)
         RET

SW41T    DC      53,3,-7,-5,-7,0,0
         DC      48,4,-12,-7,-5,-7,0
         DC      36,5,-12,-7,-5,-7,-5
         DC      12,5,-19,-5,-7,-5,-7
         DC      0,4,-24,-7,-5,-7,0

GT23DN   CALL    GT23SUB
         MIXDNR  GT231
         MIXDNR  GT232
         LD      E,C
         RET

GT23UP   CALL    GT23SUB
         MIXUPR  GT231
         MIXUPR  GT232
         LD      E,C
         RET
```

```
GT23SUB LD      C,E
        LD      A,E
        ADD     A,7
        SUB     12
        JR      NC,*-2
        ADD     A,12
        LD      E,A
        RET


*****************************************************************
*                                                               *
*            S P E C I A L    K E Y E R S                       *
*                                                               *
*****************************************************************


        GLBL    TOPBK1

        RSEG    CPROM

*  harp

GT27DN  LD      A,E
        CP      12
        RET     C
        MIXDNR  GT27
        RET

GT27UP  LD      A,E
        CP      12
        RET     C
        MIXUPR  GT27
        RET

*  carillon

GT28DN  LD      IX,GT28T
        JR      GT28DNO
GT29DN  LD      IX,GT29T
        JR      GT28DNO
GT30DN  LD      IX,GT30T
GT28DNO PUSH    DE
        CALL    GT28SUB
GT28DN1 LD      E,(IX+0)
        ADD     HL,DE
        ADD     IY,DE
        INC     (HL)
        SET     GT28B,(IY+0)
        INC     IX
        DJNZ    GT28DN1
        POP     DE
        RET

GT28UP  LD      IX,GT28T
        JR      GT28UPO
```

```
GT29UP   LD      IX,GT29T
         JR      GT28UP0
GT30UP   LD      IX,GT30T
GT28UP0  PUSH    DE
         CALL    GT28SUB
GT28UP1  LD      E,(IX+0)
         ADD     HL,DE
         ADD     IY,DE
         DEC     (HL)
         JR      NZ,GT28UP2
         RES     GT28B,(IY+0)
GT28UP2  INC     IX
         DJNZ    GT28UP1
         POP     DE
         RET

GT28SUB  LD      A,E
         CP      12
         JR      C,GT28S9
         SUB     49
         LD      C,A
         JR      C,GT28S8
GT28S9   POP     DE
         POP     DE
         RET
GT28S8   LD      HL,GT28AK
         OR      A
         SBC     HL,DE
         PUSH    HL
         POP     IY
         LD      HL,GT28AC
         SBC     HL,DE
         LD      D,-1
         LD      B,(IX-1)
         INC     C
         RET     NZ
         DEC     B
         RET

* MAJOR
         DC      5
GT28T    DC      -16,-8,-7,-5,-5

* ENGLISH MINOR
         DC      6
GT29T    DC      -15,-9,-7,-5,-5,-7

* FLEMISH
         DC      7
GT30T    DC      -12,-12,-3,-4,-5,-5,-7

*  great flute celeste II

GT16DN   MIXDNR GT161
         LD      A,E
         CP      12
         RET     C
```

```
        CP      60
        RET     NC
        MIXDNR  GT162
        RET

GT16UP  MIXUPR  GT161
        LD      A,E
        CP      12
        RET     C
        CP      60
        RET     NC
        MIXUPR  GT162
        RET

* SWELL 2' FLUTE

SW38DN  LD      A,E
        MX85DN  SW38,SW3885,60
        CP      48
        RET     NC
        MIXDNR  SW381
        RET

SW38UP  LD      A,E
        MX85UP  SW38,SW3885,60
        CP      48
        RET     NC
        MIXUPR  SW381
        RET

* SWELL SIFFLET 1'

SW40DN  CALL    TOPBK1
        MX85DN  SW40,SW4085,48
        TOPBK2
        RET

SW40UP  CALL    TOPBK1
        MX85UP  SW40,SW4085,48
        TOPBK2
        RET

* QUINT

GT21DN  LD      C,E
        LD      A,E
        CP      53
        JR      C,*+2+2+1
        SUB     12
        LD      E,A
        MIXDNR  GT21
        LD      E,C
        RET

GT21UP  LD      C,E
        LD      A,E
        CP      53
```

```
        JR      C,*+2+2+1
        SUB     12
        LD      E,A
        MIXUPR  GT21
        LD      E,C
        RET

SW39DN  LD      C,E
        LD      A,E
        CP      57
        JR      C,*+2+2+1
        SUB     12
        LD      E,A
        MIXDNR  SW39
        LD      E,C
        RET

SW39UP  LD      C,E
        LD      A,E
        CP      57
        JR      C,*+2+2+1
        SUB     12
        LD      E,A
        MIXUPR  SW39
        LD      E,C
        RET

GT13UP  MIXUPR  GT13
        LD      A,E
        CP      17
        RET     C
        MIXUPR  GT131
        RET

GT13DN  MIXDNR  GT13
        LD      A,E
        CP      17
        RET     C
        MIXDNR  GT131
        RET

GT15UP  MIXUPR  GT15
        LD      A,E
        CP      12
        RET     C
        MIXUPR  GT151
        RET

GT15DN  MIXDNR  GT15
        LD      A,E
        CP      12
        RET     C
        MIXDNR  GT151
        RET
```

```
GT17UP  MIXUPR GT17
        LD     A,E
        CP     5
        RET    C
        CP     60
        RET    NC
        MIXUPR GT171
        RET

GT17DN  MIXDNR GT17
        LD     A,E
        CP     5
        RET    C
        CP     60
        RET    NC
        MIXDNR GT171
        RET

GT18UP  MIXUPR GT18
        LD     A,E
        CP     12
        RET    C
       IFLESS 44
        MIXUPR GT182
        RET
       FI
        MIXUPR GT181
        RET

GT18DN  MIXDNR GT18
        LD     A,E
        CP     12
        RET    C
       IFLESS 44
        MIXDNR GT182
        RET
       FI
        MIXDNR GT181
        RET

GT19UP  LD     A,E
        MX85UP GT19,GT1985,60
        CP     48
        RET    NC
        MIXUPR GT191
        RET

GT19DN  LD     A,E
        MX85DN GT19,GT1985,60
        CP     48
        RET    NC
        MIXDNR GT191
        RET

GT20UP  LD     A,E
        MX85UP GT20,GT2085,60
        CP     51
```

```
        RET     NC
        CP      12
        RET     C
        MIXUPR  GT201
        RET

GT20DN  LD      A,E
        MX85DN  GT20,GT2085,60
        CP      51
        RET     NC
        CP      12
        RET     C
        MIXDNR  GT201
        RET

SW33DN  LD      A,E
        CP      12
        RET     C
        CP      60
        RET     NC
        MIXDNR  SW33
        RET

SW33UP  LD      A,E
        CP      12
        RET     C
        CP      60
        RET     NC
        MIXUPR  SW33
        RET

SW34DN  MIXDNR  SW34
        LD      A,E
        CP      12
        RET     C
        MIXDNR  SW341
        RET

SW34UP  MIXUPR  SW34
        LD      A,E
        CP      12
        RET     C
        MIXUPR  SW341
        RET

SW36DN  MIXDNR  SW36
        LD      A,E
        CP      8
        RET     C
        MIXDNR  SW361
        RET

SW36UP  MIXUPR  SW36
        LD      A,E
        CP      8
        RET     C
        MIXUPR  SW361
        RET
```

```
SW35DN   MIXDNR SW35
         LD     A,E
         CP     5
         RET    C
         CP     60
         RET    NC
         MIXDNR SW351
         RET

SW35UP   MIXUPR SW35
         LD     A,E
         CP     5
         RET    C
         CP     60
         RET    NC
         MIXUPR SW351
         RET


*****************************************************************
*                                                               *
*          S T A N D A R D    K E Y E R S                       *
*                                                               *
*****************************************************************


         RSEG   CPROM

         STDKEY PD00
         STDKEY PD02
         STDKEY PD03
         STDKEY PD04
         STDKEY PD05
         STDKEY PD06
         STDKEY PD07
         STDKEY PD08
         STDKEY PD11
         STDKEY PD12

         STDKEY GT14
         STDKEY GT24
         STDKEY GT25
         STDKEY GT26

         STDKEY SW31
         STDKEY SW32
         STDKEY SW37
         STDKEY SW42
         STDKEY SW43
         STDKEY SW44
         STDKEY SW45

         RSEG   DMARAM
         ORG    DMASTRT+4*DMAEND4

   END
```

While I have shown and described a preferred embodiment or my invention, it will be apparent to those skilled in the art that many changes and modifications may be made without departing from my invention in its broader aspects. I therefore intend the appended claims to cover all such changes and modifications as fall within the true spirit and scope of my invention.

I claim:

1. In an electronic organ provided with a plurality of input keyboard keys, a plurality of stops, plural input circuits for providing input waveform signals of different frequencies, and keyer circuits operative in response to actuation of selected keys for gating waveform signals from said input circuits to keyer output circuitry, separate means each effective for providing enabling pulses for operating a given keyer to an on condition for coupling a said waveform signal, each of said separate means being controllable to provide a different enabling pulse at a different time for a controllably different length of time to said given keyer, wherein each of said separate means is responsive to a key of said keyboard for operating said given keyer to an on condition, with the separate means being separately responsive according to operation of stops of said organ.

2. The organ according to claim 1 wherein said separate means comprise registers, and further including programmed processor means interposed between said keys and stops as an input and said keyers as an output.

3. The organ according to claim 2 wherein said registers comprise shift registers receiving serial key actuation information from said processor means, separate registers being separately controlled to provide different length pulses to said given keyer at different times, wherein the information provided a given register by said processor means relates to keys that are actuated to play a given stop.

4. In an electronic organ provided with a plurality of input keyboard keys, a plurality of stops, plural signal waveform circuits, and keyer circuits operative in response to actuation of selected keys for coupling signal waveforms to keyer output circuitry, wherein said keyers are effective for gating the signal waveforms to provide predetermined voice effects, means for providing a plurality of pulse inputs at different times on a cyclic basis for operating a given keyer, each of said pulse inputs being representative of a different stop wherein the duty cycle of each of said plurality of pulse inputs is controlled to produce the effect of a different stop, ones of the said plurality of pulses being applied to said given keyer when the corresponding stops as well as keyboard keys are actuated for playing said corresponding stops.

5. The organ according to claim 4 wherein said means for providing a plurality of pulse inputs includes separate register means for supplying each of said pulse inputs to said given keyer, each of said register means being responsive to a key on said keyboard for operating said given keyer, and each of said register means being representative of a separate stop for energizing said given keyer for a different length of time.

6. In an electronic organ provided with a plurality of input keyboard keys, plural signal waveform circuits, and keyer circuits operative in response to actuation of selected keys for coupling signal waveforms to keyer output circuitry, wherein said keyers are effective for gating the signal waveforms to provide predetermined voice effects, a plurality of registers receiving information in response to keyboard key information and connected for actuating selected keyers to an on condition in response to keyboard key operation, means for coupling outputs of plural registers for actuating a given keyer such that a given keyer can be actuated from plural registers, and means for controlling said registers to provide ones of said plural register outputs to control the operating level of said given keyer.

7. The organ according to claim 6 further provided with a plurality of stops, wherein the presence or absence of outputs from given registers is responsive to operation of different stops of said organ.

8. In an electronic organ provided with a plurality of input keyboard keys, plural signal waveform circuits, and keyer circuits operative in response to actuation of selected keys for coupling signal waveforms to keyer output circuitry, means controlled by said keyboard keys for supplying serial information for actuating said keyers, and plural shift register means receiving said serial information and providing the same in parallel to said keyers for actuating respective keyers to an on condition, including means for coupling a plurality of outputs from different shift register means to a given keyer so that a given keyer can be actuated from plural shift register means, wherein selected shift register means as supply inputs to a given keyer are operative to provide said inputs at different times for different time periods on a cyclic basis to control the operating level at which said given keyer couples the signal waveform provided thereto.

9. The organ according to claim 8 further provided with a plurality of stops, wherein said separate shift register means are provided inputs in accordance with actuation of stops.

10. The organ according to claim 9 wherein said means controlled by said keyboard keys for supplying serial information comprises processor means programmed to provide keyer actuating values in accordance with keyboard keys and stops of said organ that are actuated.

11. In an electronic organ provided with a plurality of keyboard keys, a plurality of stops, and plural input circuits for providing input signal waveforms of different frequencies, separate keyer circuits operative for coupling signal waveforms to keyer output circuitry wherein said keyers are effective for gating the signal waveforms, said keyer circuits including means for shaping the input signal waveforms provided thereto in accordance with selected organ voices, a digital processor including random access memory means, and digital shift register means coupled to said digital processor for receiving output information from said processor relative to the operation of said keyers, wherein individual keyers are operated in parallel from said shift register means such that a given keyer is operable from different outputs of said shift register means to provide different tonal effects, said processor being operative in response to input information from said keys to supply serial information to said shift register means according to keyer inputs required for providing desired outputs.

12. The organ according to claim 11 wherein groups of keyers are effective to provide different voices, the information being provided to said shift register means from said processor by groups according to stop actuation for separately operating said groups of keyers.

13. The organ according to claim 11 wherein said shift register means comprises separate shift register simultaneously operated by said processor.

14. The organ according to claim 11 wherein the information relating to keyer inputs for providing desired tonal effects are as specified in said random access memory means.

15. The organ according to claim 11 further including input shift register means for sampling the status of input keys and stops for providing input to said processor.

16. The organ according to claim 11 wherein individual keyers receive more than one shift register input for operating said individual keyers to provide different voice effects according to the particular values present in said shift register means and presented to said individual keyers.

* * * * *